US006190756B1

(12) United States Patent
Yokoyama et al.

(10) Patent No.: US 6,190,756 B1
(45) Date of Patent: Feb. 20, 2001

(54) HOLLOW CONNECTED BODY AND PACKAGING MATERIAL

(75) Inventors: Yoshimasa Yokoyama, Kohbe; Masahiro Yamamoto, Osaka, both of (JP)

(73) Assignees: Hitachi Zosen Corporation; Yokoyama Sankoh Co., LTD; Yoshimasa Yokoyama, all of (JP)

( * ) Notice: Under 35 U.S.C. 154(b), the term of this patent shall be extended for 0 days.

(21) Appl. No.: 08/894,149

(22) PCT Filed: Sep. 13, 1996

(86) PCT No.: PCT/JP96/02646

§ 371 Date: Nov. 17, 1997

§ 102(e) Date: Nov. 17, 1997

(87) PCT Pub. No.: WO97/10157

PCT Pub. Date: Mar. 20, 1997

(30) Foreign Application Priority Data

Sep. 14, 1995 (JP) ..... 7-237405

(51) Int. Cl.[7] ..... B32B 3/28

(52) U.S. Cl. ..... 428/182; 428/136; 428/156; 428/174; 428/184; 206/814

(58) Field of Search ..... 428/174, 182, 428/99, 136, 156, 188; 206/484, 521, 814

(56) References Cited

U.S. PATENT DOCUMENTS 2,020,639 * 11/1935 Grayson et al. ..... 428/182

FOREIGN PATENT DOCUMENTS 53151871 4/1952 (JP) .
60-32274 3/1985 (JP) .

* cited by examiner

*Primary Examiner*—Donald Loney
(74) *Attorney, Agent, or Firm*—Lorusso & Loud

(57) ABSTRACT

This invention relates to a connected hollow structure and a packaging member suitable for use as a cushioning material, a protection frame material, a core material of a hollow panel and a carrier for carrying adsorbents. A connected hollow structure comprises a large number of hollow structures 10 having an arbitrary sectional shape and connected in parallel to each other. The connected hollow structure is formed from a piece of sheet and takes the shape resembling a unicursal figure in section. It is possible to form a connected hollow structure which shows elasticity and withstanding strength fit for the purpose and also has a smaller apparent specific gravity by properly selecting the quality of a sheet a, and the sectional shape and size of the hollow structures 10.

39 Claims, 45 Drawing Sheets

HOLLOW CONNECTED BODY AND PACKAGING MATERIAL

TECHNICAL FIELD

This invention relates to a connected hollow structure having a large number of parallel hollow portions of a predetermined sectional shape, and a packaging member.

BACKGROUND ART

Corrugated fiberboards are, for instance, typical of a conventional member fabricated from paper sheets having hollow portions parallel to one another.

The corrugated fiberboards are classified into A to E-flute corrugated fiberboards according to the size of flutes, and also classified into a single faced corrugated fiberboard, a double faced corrugated fiberboard, a double wall corrugated fiberboard and a triple wall corrugated fiberboard according to differences in structure.

These corrugated fiberboards are used for forming packaging boxes, cushioning materials and other packaging members. Recently, a proposal has been made that a layered corrugated fiberboard be used for forming cushioning materials for packaging, frame structures for packaging, and core materials of heat-insulating panels or the like.

The corrugated fiberboard and the layered corrugated fiberboard member as described above have the following problems.

Namely, one of the problems is that the corrugated fiberboard must be fabricated by the use of base boards, and as a result, it is not possible to freely select a material (i.e., base board) for the corrugated fiberboard.

Another problem is that since the corrugated fiberboard is a standardized product, there are restrictions on selection of void content (which means a ratio of the sectional area of hollow portions to the whole sectional area in a section crossing at a right angle to the hollow portions) for the corrugated fiberboard.

A further problem is that it is not possible to freely select a sectional shape for the hollow portions.

In connection with the above problems, a still further problem is that cushioning materials, packaging frame structures and other packaging members which are formed by the use of layered corrugated fiberboards are limited in selection of their hardness or the strength of elasticity from the viewpoint of design. Coincidentally, this problem means that their use is restricted within narrow limits.

A yet further problem is that several pieces of base boards and linerboard, and besides, a large number of steps, are required for fabricating a corrugated fiberboard, and as a result, high fabrication cost is inevitable.

DISCLOSURE OF THE INVENTION

It is an object of the present invention to provide a connected hollow structure, in which its material may be more freely selected according to intended purpose (use), and a packaging member comprised of such a connected hollow structure.

Another object of the present invention is to provide a connected hollow structure, in which its void content may be freely designed according to the intended purpose, and a packaging member comprised of such a connected hollow structure.

A further object of the present invention is to provide a connected hollow structure, for which the sectional shape of hollow portions may be freely selected according to the intended purpose, and a packaging member comprised of such a connected hollow structure.

A still further object of the present invention is to provide a connected hollow structure, in which its hardness and the strength of elastic force and withstanding strength may be selected more freely according to the intended purpose, in cooperation with the selection of the material and the freedom of design of the void content and the sectional shape of hollow portions, and a packaging member comprised of such a connected hollow structure.

A yet further object of the present invention is to provide a connected hollow structure, which is fabricated through fewer steps by the use of a piece of sheet, to which various kinds of materials are applied, and a packaging member comprised of such a connected hollow structure.

A yet further object of the present invention is to provide a connected hollow structure which may be used for a variety of purposes.

In order to attain the above objects, a connected hollow structure according to the present invention is formed as follows.

According to a first embodiment of the present invention, a large number of hollow structures of an arbitrary sectional shape are connected in parallel to each other, and the connected hollow structure is comprised of a sheet and takes a shape resembling a unicursal figure in section.

The sheet may be freely selected from a group consisting of ordinary sheets, water-resistant sheets, coated printing sheets having coated surfaces, laminated sheets, styrene paper (formed by solidifying a non-woven fabric into a sheet-like shape by means of heating or using a resin, for instance), hard or semi-hard plastic sheets, thick paper, corrugated fiberboards, thin plywood and so on.

The hollow structures adjacent to each other are bonded together with an adhesive or connected or joined together directly or indirectly through other means.

The connected hollow structure in the first embodiment has cushioning properties depending on the quality of the sheet selected as the material of the connected hollow structure or the sectional shape and apparent specific gravity (i.e., void content) of the hollow structures, since the hollow structures are deformed when an external force is applied to the connected hollow structure in a direction crossing each hollow structure. The connected hollow structure of the first embodiment is suitable for use as a cushioning material, a packaging frame structure or like packaging member by making use of its elasticity depending on the sectional shape of the hollow structures, and besides, may be used for various purposes by making use of the hollow structures.

Thus, it is possible to fabricate a connected hollow structure, which has an apparent specific gravity (void content) suitable for the intended purpose and which shows the withstanding strength or elasticity suitable for the purpose, by freely selecting the shape and sectional area of the hollow structures and the quality of the sheet, as described above.

Further, since the connected hollow structure takes the shape resembling a unicursal figure in section and is comprised of a single sheet, it is possible to fabricate the connected hollow structure through fewer steps at low cost.

Furthermore, the connected hollow structure is designed more freely, and therefore, may be used for a variety of purposes.

In a second embodiment of the present invention, the hollow structures include first and second hollow structures each having a corner portion of a convex angular section. Each first hollow structure having the corner portion directed toward one surface of the connected hollow structure and a partial circumference facing the other surface of the connected hollow structure and each second hollow structure having the corner portion directed toward the other surface of the connected hollow structure and a partial circumference facing one surface of the connected hollow structure, are formed in an alternate arrangement, and the first and second hollow structures adjacent to each other share in common at least a part of side walls, which include each corner portion.

The connected hollow structure in the second embodiment is easily patterned according to the intended purpose by selecting the sectional shape and size of the hollow structures, since the first and second hollow structures are formed in an alternate arrangement such that the corner portion of each first hollow structure is directed to be substantially reverse to that of each second hollow structure.

Further, the first and second hollow structures are formed in a dense arrangement, since the first and second hollow structures adjacent to each other share in common at least a part of the side walls, which include the corner portion of each hollow structure. Therefore, the connected hollow structure in the second embodiment is suitable for use as not only a packaging member, but also as a core material of a heat-insulating panel or like panel and as a carrier for carrying adsorbents by forming a layered connected hollow structure such that the hollow structures are in parallel with each other.

Furthermore, the hollow structures are easily connected together through a mechanical means by joining or connecting the first hollow structures together in a portion of the corner portion of each second hollow structure positioned between the adjacent first hollow structures or joining or connecting the second hollow structures together in a portion of the corner portion of each first hollow structure positioned between the adjacent second hollow structures.

In a third embodiment of the present invention, the first and second hollow structures have a polygonal section, and the connected hollow structure is formed by folding the sheet along folds formed on the sheet.

Therefore, the connected hollow structure in the third embodiment is patterned more easily, and also formed by machining more easily.

Further, it is possible to fabricate a connected hollow structure which takes various shapes according to the purpose by properly selecting the sectional shape of the hollow structures.

In a fourth embodiment of the present invention, the first and second hollow structures in portions other than at least both ends of the connected hollow structure have a polygonal section including sides of the same number. with the connected hollow structure of the fourth embodiment, it is possible to design a connected hollow structure which takes various shapes according to the purpose, such as a connected hollow structure, in which hollow structures have a similar or non-similar sectional shape. Otherwise, a connected hollow structure which is uniform in apparent thickness on the whole, and has a cylindrical shape, a gutter-like shape, a channel-like shape or the like may be designed by properly selecting the sectional size of the hollow structures. Further, since the sides included in the sectional shape of the first and second hollow structures are of the same number, the connected hollow structure in the fourth embodiment is formed by machining more easily.

Connected hollow structures in fifth to eighth embodiments of the present invention are typical of the connected hollow structure in the fourth embodiment.

Namely, according to the connected hollow structure in the fifth embodiment, the first and second hollow structures have a triangular section.

According to the fifth embodiment, since the hollow structures have a polygonal section including the fewest sides, it is the easiest to form the folds on the sheet and to fold the sheet by machining, and it is possible to fabricate a connected hollow structure most efficiently.

According to the connected hollow structure in the sixth embodiment of the present invention, the first and second hollow structures have an isosceles triangular or right-angled triangular section.

With the sixth embodiment, it is possible to fabricate a panel-shaped connected hollow structure, which is uniform in apparent thickness of each portion, by designing the first and second hollow structures, for instance, so as to have the isosceles triangular section, to be of the same sectional size, and to be arranged such that the base surfaces of the first and second hollow structures respectively face opposing surfaces of the connected hollow structure. Since a planar pressure acts on the connected hollow structure, mainly on two equal side walls of each hollow structure, the connected hollow structure shows withstanding strength against the planar pressure more uniformly in each portion of the connected hollow structure. Further, when the connected hollow structure is exposed to a relatively high planar pressure, the hollow structures are transformed such that two same-sized and angled side walls of the hollow structures are bent. Thus, the connected hollow structure shows elasticity against the planar pressure substantially uniformly in each portion of the connected hollow structure.

Further, with the sixth embodiment, it is possible to fabricate a connected hollow structure, which is uniform in apparent thickness of each portion and has a cylindrical shape on the whole or a semicylindrical channel-like shape, by designing the first and second hollow structures so as to have the isosceles triangular section, to be of the same height in section and to form the base surface of each first hollow structure narrower than that of each second hollow structure (i.e., to intersect two equilateral surfaces at a small angle).

Furthermore, with the sixth embodiment it is possible to fabricate a panel-shaped connected hollow structure, which is uniform in apparent thickness of each portion, by designing the first and second hollow structures so as to have the right-angled triangular section, to be of the same sectional size, and to be arranged such that one of the side surfaces including a right angle faces each surface of the connected hollow structure. In this case, a planar pressure acts on the connected hollow structure, mainly on vertical side walls and inclined side walls of the hollow structures. However, the connected hollow structure shows high withstanding strength against the planar pressure, since the vertical side walls of the hollow structures are arranged at predetermined intervals.

In the connected hollow structure of the seventh embodiment the first and second hollow structures have a quadrangular or pentagonal section. Thus, it is possible to fabricate a connected hollow structure which takes various shapes according to the intended purpose, such as a connected hollow structure which has a panel-like shape with uniform thickness of each portion, or a cylindrical shape, a channel-like shape, a gutter-like shape or the like, by designing the first and second hollow structures to have a special section.

In the connected hollow structure of the eighth embodiment, the first and second hollow structures have a hexagonal or more polygonal section. Thus, each hollow structure of the connected hollow structure in the eighth embodiment has a large number of side surfaces and when the side surfaces of the hollow structures are of the same size, the connected hollow structure shows high withstanding strength against an external force applied to the hollow structures in the length direction. Further, this connected hollow structure shows more flexible elasticity against a planar pressure, since, when the connected hollow structure is exposed to a planar pressure, the hollow structures are transformed and absorb such a planar pressure. Furthermore, this connected hollow structure is suitable for use as a frame structure for packaging rod-shaped articles such as linear fluorescent lamps by inserting such articles into the hollow structures, for instance.

In a ninth embodiment of the present invention, the first and second hollow structures, in portions other than at least both ends of the connected hollow structure, have a polygonal section including sides of the same number, and the polygonal section of the first hollow structures is different from that of the second hollow structures in number of sides.

Connected hollow structures in tenth and eleventh embodiments of the present invention are typical of the connected hollow structure in the ninth embodiment.

In a tenth embodiment, either the first or second hollow structures have a triangular section, and the others have a quadrangular or pentagonal section.

In an eleventh embodiment, either the first or second hollow structures have a quadrangular section, and the others have a pentagonal section.

According to the tenth and eleventh embodiments, it is possible to fabricate a connected hollow structure which takes various shapes according to the purpose, such as a connected hollow structure which has a panel-like shape with uniform thickness in each portion, or a cylindrical shape, a channel-like shape, a gutter-like shape or the like, by designing the first and second hollow structures so as to have a special section, and by properly selecting the sectional size of these hollow structures.

A twelfth embodiment of the present invention is a modification of the third embodiment wherein either the first or second hollow structures in portions other than at least both ends of the connected hollow structure have a polygonal section including sides of the same number, and the others include hollow structures respectively having polygonal sections different in number of sides.

Connected hollow structures in thirteenth and fourteenth embodiments of the present invention are typical of the connected hollow structure in the twelfth embodiment.

In the connected hollow structure of the thirteenth embodiment, either the first or second hollow structures have a triangular section, and the others include hollow structures having a quadrangular section and those having a pentagonal section.

In the connected hollow structure of the fourteenth embodiment, either the first or second hollow structures have a triangular section, and the others include hollow structures having a triangular section and those having a pentagonal section.

With the thirteenth and fourteenth embodiments, it is possible to fabricate a connected hollow structure which takes various shapes according to the intended purpose, such as a connected hollow structure which has a panel-like shape with uniform thickness in each portion, or a cylindrical shape, a channel-like shape, a gutter-like shape or the like, by designing the others of the first and second hollow structures to have a special section, and by properly selecting the sectional size of the hollow structures.

In a fifteenth embodiment of the present invention, the first and second hollow structures in portions other than at least both ends of the connected hollow structure include hollow structures respectively having polygonal sections different in number of sides.

Connected hollow structures in sixteenth and seventeenth embodiments of the present invention are typical of the connected hollow structure in the fifteenth embodiment.

In the sixteenth embodiment, the first and second hollow structures include hollow structures having a triangular section and those having a quadrangular or pentagonal section.

In the seventeenth embodiment, the first and second hollow structures include hollow structures having a quadrangular section and those having a pentagonal section.

With the sixteenth and seventeenth embodiments, it is possible to fabricate a connected hollow structure which takes various shapes according to the intended use, such as a connected hollow structure which has a panel-like shape with uniform thickness in each portion, or a cylindrical shape, a channel-like shape, a gutter-like shape or the like, by designing the hollow structures other than those having the triangular section to have a special section, and by properly selecting the sectional size of the hollow structures.

The connected hollow structure of an eighteenth embodiment of the present invention is a modification of the connected hollow structure in any of the fifth, seventh, tenth, thirteenth, fourteenth, sixteenth and seventeenth embodiments, wherein one side surface of the first and second hollow structures in portions other than at least both ends of the connected hollow structure forms the partial circumferences (i.e., partial circumferences facing opposite surfaces of the connected hollow structure) of the first and second hollow structures described above.

The connected hollow structure in the eighteenth embodiment has an advantage in being fabricated without forming irregularities on the surface.

A nineteenth embodiment of the present invention is a modification of the eighteenth embodiment wherein the partial circumferences of the first hollow structures and those of the second hollow structures are respectively connected together, and the connected hollow structure has a panel-like shape substantially uniform in apparent thickness.

The connected hollow structure of the nineteenth embodiment has opposing substantially smooth surfaces and a panel-like shape, and therefore, is suitable for use as a packaging member for packaging articles, and as a core material of a heat-insulating panel or like hollow panel.

The twentieth embodiment of the present invention is a modification of the eighteenth embodiment, wherein the partial circumferences of the first hollow structures and those of the second hollow structures are respectively connected together, and the connected hollow structure has a cylindrical or gutter-like overall shape.

The connected hollow structure in the twentieth embodiment is suitable for use as a frame structure for packaging bottles or like articles having a rod-shaped drum portion.

In a twenty-first embodiment of the present invention, the connected hollow structure of the eighteenth embodiment is modified so that the partial circumferences of the first hollow structures and those of the second hollow structures are respectively connected together, and the connected hollow structure has a rising portion formed at least on one surface so as to gradually rise from one portion to the other.

The connected hollow structure of the twenty-first embodiment is suitable for use as a member for packaging an article by forming the rising portion on one surface so as to be fit for the external shape of the article, for instance.

The connected hollow structure of a twenty-second embodiment of the present invention is a modification of the connected hollow structure in the twenty-first embodiment wherein a pitch of the first and second hollow structures formed in the rising portion is made smaller in proportion to the scale of rising. In the connected hollow structure of the twenty-second embodiment, since the pitch of the hollow structures formed in the rising portion is small, the withstanding strength against a planer pressure applied to the rising portion is easily made uniform with that against the planar pressure applied to a portion other than the rising portion.

A twenty-third embodiment of the present invention is a modification of any of the nineteenth, twenty-first and twenty-second embodiments wherein the hollow structure positioned at both ends of the connected hollow structure has a chamfered inclined side surface extending in the length direction of the hollow structure. In this embodiment, the hollow structure positioned at opposing ends of the connected hollow structure has the chamfered inclined side surface, and therefore, even when another object contacts the chamfered surface of the connected hollow structure, neither the other object or the chamfered surface of the connected hollow structure is damaged.

The a twenty-fourth embodiment of the present invention is a modification of the eighteenth embodiment wherein the connected hollow structure has a projection formed at least on one surface so as to extend parallel to the length of the hollow structures, and the partial circumferences of the first or second hollow structures in the projection are connected together. The twenty-fourth embodiment is very convenient for use as a packaging member for packaging an article by forming the projection so as to fit a concave surface of the article.

The twenty-fifth embodiment of the present invention is a modification of the connected hollow structure of the twenty-fourth embodiment wherein the connected hollow structure has a plurality of projections, and a portion between the projections is formed into a channel-like portion. The connected hollow structure of the twenty-fifth embodiment is suitable for use as a packaging member for packaging an article by inserting such an article wholly or partially into the channel-like portion.

The twenty-sixth embodiment of the present invention is a modification of the connected hollow structure of the twenty-fourth or twenty-fifth embodiment wherein a pitch of the first and second hollow structures formed in the projection is made smaller than that of the remainder of the first and second hollow structures. The connected hollow structure of the twenty-sixth embodiment, since the pitch of the hollow structures formed in the projection is small, has a withstanding strength against a planar pressure applied to the projection which is easily made uniform with that against the planar pressure applied to the remainder of the structure.

The twenty-seventh embodiment of the present invention is a modification of the connected hollow structure in any of the twenty-fourth to twenty-sixth embodiments, the hollow structure, at the opposing ends of the projection, has a chamfered inclined side surface extending parallel to the length of the hollow structure. In this embodiment, the hollow structure, at opposing ends of the projection of the connected hollow structure of the twenty-seventh embodiment has the chamfered inclined side surface, and therefore, even when another object is brought into contact with the chamfered surface of the connected hollow structure, neither the other object nor the chamfered surface of the connected hollow structure is damaged. In addition, the chamfered surface functions as a guide for articles to be packaged.

The twenty-eighth embodiment of the present invention is a modification of the connected hollow structure in any of the nineteenth to twenty-seventh embodiments wherein all or part of at least either the first or second hollow structures have surfaces in the form a circular arc facing the surface of the connected hollow structure, and therefore, when this connected hollow structure receives a planar force, the circular arc surfaces of the hollow structures provide elasticity (cushioning properties) and partially absorb the planar force.

In the twenty-ninth embodiment of the present invention, a modification of the connected hollow structure of the third embodiment, all or part of at least either the first or second hollow structures have a plurality of side surfaces substantially uniformly projecting from one surface of the connected hollow structure, and the hollow structures have a quadrangular or more polygonal section. Therefore, when the connected hollow structure receives a planar force, the side surfaces are transformed and partially absorb such a force.

In a thirtieth embodiment of the present invention, a modification of the connected hollow structure of the twenty-ninth embodiment, the first hollow structures and the second hollow structures have longitudinal surfaces respectively connected together, and the connected hollow structure has a panel-like shape substantially uniform in apparent thickness. Therefore, this thirtieth embodiment is suitable for use as a member for packaging articles, and as a core material of a heat-insulating panel or like hollow panel.

In a thirty-first embodiment of the present invention, a modification of the connected hollow structure of the twenty-ninth embodiment, longitudinal surfaces of the first hollow structures and of the second hollow structures are respectively connected together, and the connected hollow structure has a cylindrical or gutter-like overall shape. The thirty-first embodiment is suitable for use as a frame structure for packaging bottles or like articles having a rod-shaped drum portion.

The thirty-second embodiment of the present invention is a modification of the connected hollow structure of the twenty-ninth embodiment wherein the longitudinal surfaces of the first and second hollow structures are respectively connected together, and the connected hollow structure has a rising portion formed at least on one surface to gradually rise from one portion to the other. The connected hollow structure of the thirty-second embodiment is suitable for use as a member for packaging an article by forming the rising portion on one surface so as to fit the external shape of the article.

The thirty-third embodiment of the present invention modifies the connected hollow structure of the thirty-second embodiment to have a pitch of the first and second hollow structures formed in the rising portion smaller in proportion to the scale of rising. Since the pitch of the hollow structures formed in the rising portion is small, the withstanding strength against a planar force applied to the rising portion is equal to that against the planar force applied to a portion other than the rising portion.

The thirty-fourth embodiment of the present invention, which may be a modification of the connected hollow structure of any of the nineteenth to thirty-third embodiments, adjacent side walls common to the first and second hollow structures have an appropriate number of bending node stripes extending parallel to the length of the hollow structures. When a force of not less than a predetermined value is applied perpendicular to the hollow structures of the connected hollow structure in this thirty-fourth embodiment, the side walls common to adjacent first and second hollow structures are bent along the nodes to a certain extent and function as cushions to absorb such a force.

The thirty-fifth embodiment of the present invention is a modification of the connected hollow structure of the thirty-fourth embodiment wherein each bending node takes the shape of a small groove and is formed on one surface of each side wall common to adjacent first and second hollow structures, and the grooves are bent inwardly in a convex shape when the side walls are bent.

The thirty-sixth embodiment of the present invention may be a modification of the connected hollow structure of any of the nineteenth to thirty-third embodiments. In this embodiment at least part of the first and second hollow structures have an appropriate number of holes formed in sides which do not appear at the surfaces of the connected structure. Thus, the weight of the connected hollow structure is reduced in proportion to the number of holes, and the side walls of the hollow structures having the holes easily adsorb a planar force, and as a result, show more flexible elasticity.

The thirty-seventh embodiment of the present invention is a modification of the connected hollow structure of the third embodiment wherein the first and second hollow structures are formed so as to gradually reduce in sectional size from one end toward the other. The thirty-seventh embodiment has a circular or sectorial plane such that the side of each hollow structure having the smaller sectional size forms an inner periphery, and both surfaces of the connected hollow structure are inclined downwards toward the inner periphery. Thus, the connected hollow structure in the thirty-seventh embodiment is suitable for use as a packaging member for protecting the end of a rod-shaped member by bringing the connected hollow structure into contact with the end of the rod-shaped member.

The thirty-eighth embodiment of the present invention is a modification of the connected hollow structure of the third embodiment wherein all or part of at least either the first or second hollow structures have a plurality of small hollow portions. Since the hollow structures have the plurality of small hollow portions, the withstanding strength against a planar force is increased. Thus, the connected hollow structure in the thirty-eighth embodiment is suitable for use as a carrier for carrying adsorbents by utilizing the small hollow portions of the hollow structures.

In a thirty-ninth embodiment of the present invention, which is a modification of the connected hollow structure of the third embodiment, the first and second hollow structures have a pentagonal or more polygonal section, and either the first or second hollow structures have a portion of a concave section formed in the side wall common to adjacent first and second hollow structures adjacent to each other. When a planar load is applied to the connected hollow structure of the thirty-ninth embodiment, the side walls are further bent along the concave portions so as to enlarge the concave portions, and satisfactorily function as cushions to absorb such a planar load.

The fortieth embodiment of the present invention is a modification of the connected hollow structure of the first embodiment wherein parallel connecting sheet portions are bonded together, and a large number of cylindrical hollow structures are formed by bonding lengthwise joint portions between adjacent connecting sheet portions. The fortieth embodiment is suitable for use as a packaging member for protecting linear fluorescent lamps or like rod-shaped or cylindrical articles to be packaged by inserting such articles into the cylindrical hollow structures, or as other packaging members such as a cushioning material by making use of flexible cushioning properties of the hollow structures.

The forty-first embodiment of the present invention is a modification of the connected hollow structure of the fortieth embodiment wherein the hollow structures have a circular or elliptical section. Therefore, the forty-first embodiment is more suitable for use as a packaging member for protecting rod-shaped or cylindrical articles to be packaged by inserting such articles into the hollow structures, or as other packaging members such as a cushioning material by making use of the cushioning properties of the hollow structures.

The forty-second embodiment of the present invention is a modification of the connected hollow structure of the fortieth or forty-first embodiment wherein the connected hollow structure has a cylindrical shape with the hollow structures positioned along the inner periphery. The connected hollow structure in the forty-second embodiment is suitable for use as a cushioning material for articles to be packaged, or as other packaging members for protecting bottles or like articles having a drum portion by inserting such articles into the connected hollow structure.

The forty-third embodiment of the present invention is a modification of the connected hollow structure of the first embodiment wherein a large number of first and second hollow structures having a drop-shaped or pseudo drop-shaped section are formed in an alternate arrangement and in an alternately inverse position by forming portions having the sectional shape of a letter S and portions having the sectional shape of an inverted letter S in an alternate arrangement such that the side of each portion having the shape of the letter S is connected to the side of the adjacent portion having the shape of the inverted letter S. The connected hollow structure of the forty-third embodiment is suitable for use as a packaging member for protecting rod-shaped or cylindrical articles to be packaged by inserting such articles into the hollow structures, or as other packaging members such as a cushioning material by making use of the cushioning properties of the hollow structures.

In the forty-fourth embodiment of the present invention either the first or second hollow structures are smaller in sectional size than the others, and the connected hollow structure has an overall cylindrical shape with the hollow structures of the smaller sectional size positioned along the inner periphery. The connected hollow structure of the forty-fourth embodiment is suitable for use as a cushioning material for articles to be packaged, or as other packaging members for protecting bottles or like articles having a drum portion by inserting such articles into the connected hollow structure.

The forty-fifth embodiment of the present invention is a modification of the connected hollow structure of the first embodiment wherein a large number of hollow structures are formed in a dense arrangement in parallel to each other such that first hollow portions having an angular section and second hollow portions having an inverted angular section are combined together in a symmetrical shape, and the hollow structures adjacent to each other are connected together substantially in the shape of a letter S or an inverted letter S. Since the hollow structures composed of the hollow portions show flexible elasticity, the connected hollow structure of the forty-fifth embodiment is suitable for use as a packaging member such as a cushioning material for articles to be packaged, and as other packaging members for protecting linear fluorescent lamps or like rod-shaped or cylindrical articles to be packaged by inserting such articles into the hollow portions. Further, when the connected hollow structure of the forty-fifth embodiment has more hollow structures which are rounded in a cylindrical shape on the whole, the hollow portions positioned along the cylindrical inner surface are compressively transformed to easily form a connected hollow structure of a cylindrical shape. Thus, the connected hollow structure of the forty-fifth embodiment is suitable for use as a packaging member for protecting bottles or like articles.

The forty-sixth embodiment of the present invention is a modification of the connected hollow structure of the forty-fifth embodiment wherein either the first or second hollow portions have a semicircular, trapezoidal or triangular section, and the others have a semicircular, trapezoidal or triangular section in inverse relation to the aforementioned hollow portions. The connected hollow structure in the forty-sixth embodiment has an advantage in being easily fabricated, since the hollow portions have the shape as described above.

The forty-seventh embodiment of the present invention is wholly or partly formed of the connected hollow structure of any of the first to forty-sixth embodiments. The packaging member of the forty-eighth embodiment of the present invention is composed of a connected bottom structure, a connected side structure placed uprightly on the side of the connected bottom structure, and a connected rear structure placed uprightly on the rear of the connected bottom structure and at a right angle with the connected side structure. The connected bottom structure, the connected side structure and the connected rear structure are respectively formed of the connected hollow structure. The packaging member of the forty-eighth embodiment is suitable for use as a corner protection frame for protecting an article having a corner including three sides at right angles to one another by bringing the corner portion of such an article into contact with the inside of the packaging member.

The forty-ninth embodiment of the present invention is a modification of the packaging member of the forty-eighth embodiment wherein the connected side structure is placed on the connected bottom structure such that first and second hollow structures of the connected side structure are substantially at right angles with first and second hollow structures of the connected bottom structure; the connected rear structure is placed on the connected bottom structure such that first and second hollow structures of the connected rear structure extend along the first and second hollow structures of the connected bottom structure, while being oriented at an angle of 90° with the first and second hollow structures of the connected bottom structure; the connected side structure and the connected rear structure are connected to the connected bottom structure through individual connecting sheet portions; and the connected bottom structure, the connected side structure and the connected rear structure respectively have the first and second hollow structures of the same sectional shape and are comprised of a piece of sheet. Since the packaging member of the forty-ninth embodiment is formed as described above, the connected bottom structure, the connected side structure and the connected rear structure are substantially uniform in withstanding strength and elasticity. Further, this packaging member is comprised of a piece of sheet, and as a result, is formed economically.

The fiftieth embodiment of the present invention is a modification of the packaging member in the forty-eighth or forty-ninth embodiment wherein the surfaces which face the inside of the packaging member, of at least part of hollow structures have a circular arc section. Thus, when a planar force is applied to the connected hollow structure, the inside facing surfaces of the circular arc section show elasticity (cushioning properties) and partially absorb such a planar force.

The fifty-first embodiment of the present invention is a modification of the layered connected hollow structure of the nineteenth embodiment formed in block shape such that hollow portions of each layer are in parallel with each other. The packaging member of the fifty-first embodiment is suitable for use as a packaging support block or cushioning block, and as a packaging frame structure for encasing bottles or like articles by inserting such articles into the hollow structures.

The fifty-second embodiment of the present invention is a modification of the packaging member of the fifty-first embodiment, wherein a hole is formed perpendicularly to the hollow structures of the connected hollow structure. The packaging member of the fifty-second embodiment is suitable for use as a packaging frame structure and also serves as a cushioning material for packaging an article having a portion fit to the shape of the hole by inserting such a portion of the article into the hole.

The fifty-third embodiment of the present invention is a modification of the fifty-first or fifty-second embodiment wherein the first and second hollow structures of the connected hollow structures of the layers are formed in parallel with each other in a symmetrical arrangement in section, and the connected hollow structures of the layers adjacent to each other are connected together as one body and comprised of a single sheet. In the packaging member of the fifty-third embodiment each layer shows substantially uniform elasticity and withstanding strength against a planar force. Further, the packaging member of the fifty-third embodiment is wholly comprised of a single sheet, and as a result, is formed economically.

The fifty-fourth embodiment of the present invention is composed of a connected bottom structure, a pair of connected side structures placed uprightly on both sides of the connected bottom structure, a connected front structure placed uprightly on the front of the connected bottom structure and at right angles with the connected side structures, and a connected rear structure placed uprightly on the rear of the connected bottom structure and at right angles with the connected side structures, and the connected bottom structure. The connected side structures, the connected front structure and the connected rear structure are formed of the connected hollow structure. The packaging member of the fifty-fourth embodiment takes the overall shape of a relatively high-edged tray, and therefore is suitable for use as a protecting frame for packaging an article having a portion fit for the internal shape of the packaging member by inserting such a portion of the article into the packaging member, or as a pallet for carrying articles and so on.

The fifty-fifth embodiment of the present invention is a modification of the packaging member of the fifty-fourth embodiment wherein the connected front structure and the connected rear structure are placed on the connected bottom structure such that the first and second hollow structures of the connected front structure and the connected rear structure extend along the first and second hollow structures of the connected bottom structure, while being oriented at an angle of 90° with the first and second hollow structures of the connected bottom structure. Both the connected side structures are placed on the connected bottom structure such that the first and second hollow structures of the connected side structures are substantially at right angles with the first and second hollow structures of the connected bottom structure. The connected front structure and the connected rear structure are connected to the connected bottom structure through connecting sheet portions. The connected front structure and one connected side structure, and the connected rear structure and the other connected side structure are respectively connected together through individual connecting sheet portions. The connected bottom structure, both the connected side structures, the connected front structure and the connected rear structure have the first and second hollow structures of the same sectional shape and are comprised of a single sheet.

In the fifty-fifth embodiment, the connected bottom structure, both the connected side structures, the connected front structure and the connected rear structure show substantially uniform withstanding strength and elasticity. Further, the packaging member in the fifty-fifth embodiment is wholly comprised of a single sheet, and as a result, is formed economically.

DESCRIPTION OF THE PREFERRED EMBODIMENTS

Hereinafter will be described connected hollow structures according to the preferred embodiments of the present invention in detail with reference to the accompanying drawings.

(First embodiment)

Figure 1:
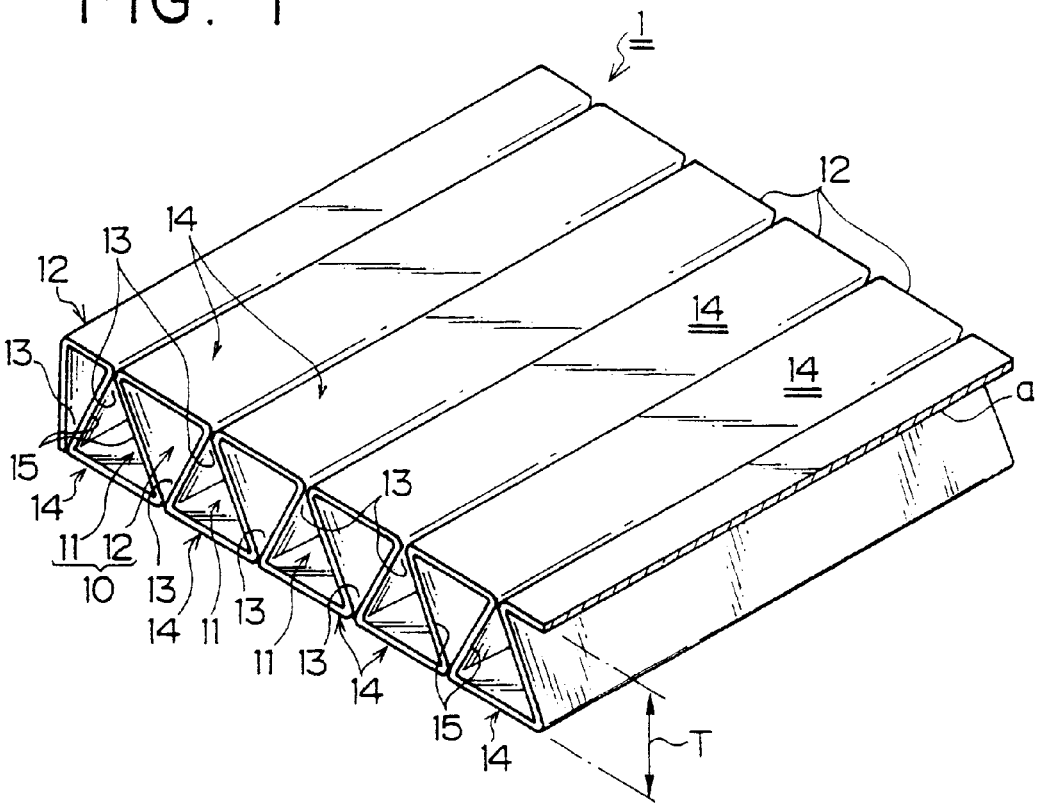
FIG. 1 is a fragmentary perspective view of a connected hollow structure in a first embodiment according to the present invention.

FIG. 1 shows that the connected hollow structure 1 in a first embodiment is fabricated from a sheet a (See FIG. 2) consisting of a piece of board. The connected hollow structure 1 comprises hollow structures including first hollow structures 11, which are of the substantially same size and have an isosceles triangular section (close to a regular triangular section in this embodiment), and second hollow structures 12 which are substantially equal in size and sectional shape to the first hollow structures. However, the second hollow structure 12 at both ends of the connected hollow structure 1 has a right-angled triangular section, and is equal in height to other second hollow structures 12.

The first and second hollow structures 11, 12 are formed such that a corner portion (i.e., an angular portion included in two equilaterals) 13 of each first hollow structure 11 and that of each second hollow structure 12 are directed to be reverse to each other, and a partial circumference 14 forming one side surface (i.e., a base surface) of each first hollow structure 11 and that forming one side surface of each second hollow structure 12 face the opposite surfaces of the connected hollow structure 1.

The first hollow structures 11, 11 adjacent to each other are bonded together in a portion of the corner portion 13 of each second hollow structure 12 positioned between the first hollow structures 11, 11 adjacent to each other. The second hollow structures 12, 12 adjacent to each other are bonded together in a portion of the corner portion 13 of each first hollow structure 11 positioned between the second hollow structures 12, 12 adjacent to each other.

The first and second hollow structures 11, 12 adjacent to each other have common side walls 15, which form the borders between the first and second hollow structures adjacent to each other. Therefore, each side wall 15 in the border between the first and second hollow structures adjacent to each other has the same thickness as the sheet a which is used as the material of the connected hollow structure.

According to the connected hollow structure 1 formed as described above, the partial circumferences 14 of the first hollow structures 11 adjacent to each other and those of the second hollow structures 12 adjacent to each other are respectively connected together. Thus, the connected hollow structure 1 has a panel-like shape substantially uniform in apparent thickness T, and takes the shape resembling a unicursal figure in section.

Figure 3:
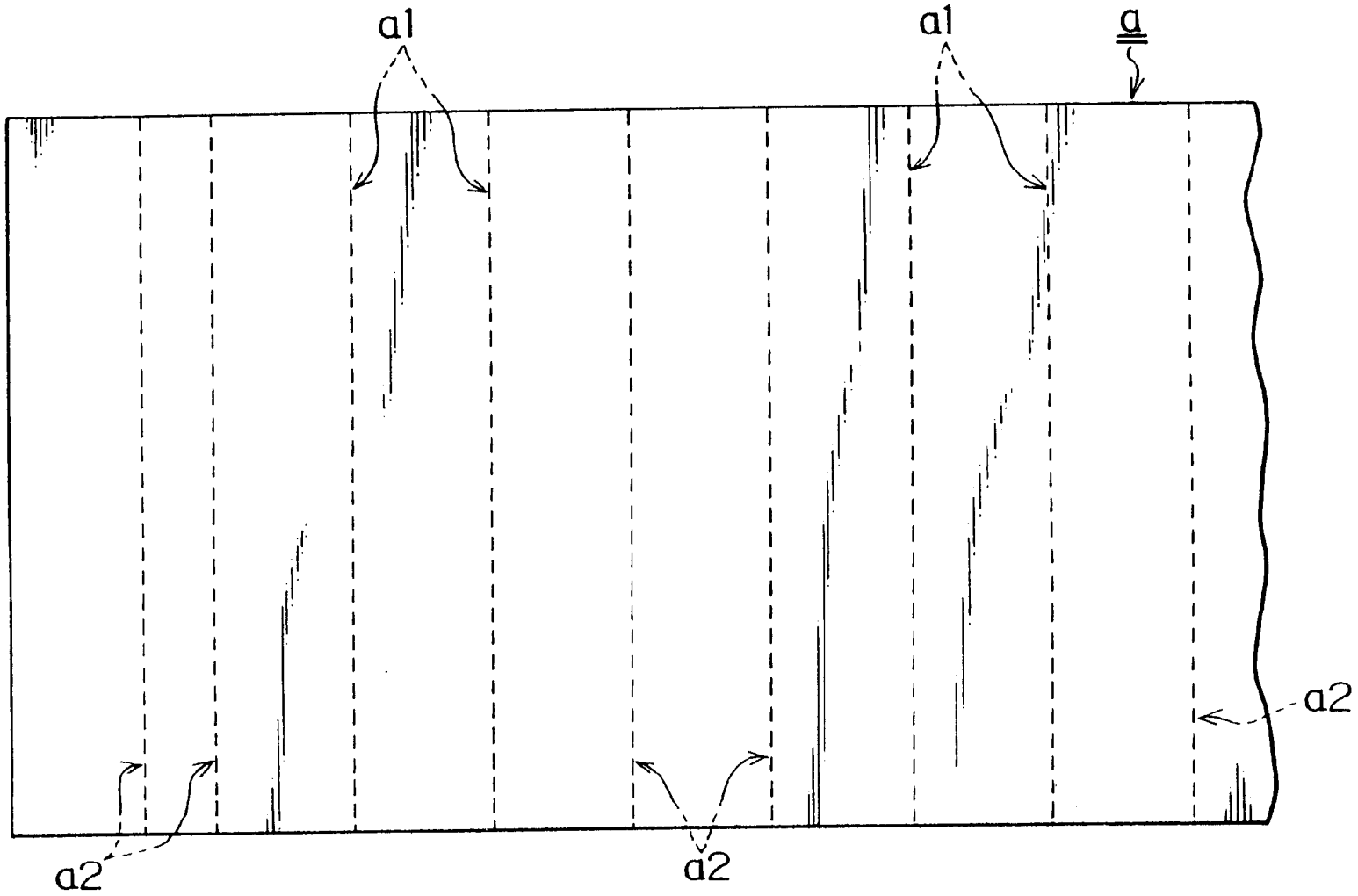
FIG. 3 is a fragmentary the connected hollow structure developed plan view of FIG. 1.

The connected hollow structure 1 in the first embodiment is fabricated as follows. Firstly, as shown in FIG. 3, while the sheet a used as the material of the connected hollow structure is being delivered, convex folds a2, a2, along which the sheet a is folded in a convex shape (i.e., the shape of an inverted letter V in section), and concave folds a1, a1, along which the sheet a is folded in a concave shape (i.e., the shape of a letter V), are formed on the sheet a so as to extend in the traverse direction of the sheet in an alternate arrangement every two rows and in parallel to each other by using, for instance, a press or rotary press cutter. When a corrugated fiberboard is applied to the sheet a, the folds a1, a2 are formed so as to intersect flutes (not shown) of the corrugated fiberboard at a predetermined angle.

The distance between the concave folds a1, a1, that between the convex folds a2, a2 and that between the concave and convex folds a1, a2 adjacent to each other are determined according to the sectional size of the hollow structures 11, 12.

Subsequently, the top surface of the sheet a at portions of the convex folds a2 and the undersurface of the sheet a at portions of the concave folds a1 are respectively coated with glue (i.e., an adhesive). Thereafter, the sheet a is folded in sequence along the folds a1, a2 from the leading end of the sheet a in the delivery direction to form the upper and lower partial circumferences 14, 14, and the sides of the upper and lower partial circumferences 14, 14 adjacent to each other are bonded together so as to be flush with each other.

When the sheet a is folded in sequence as described above, the convex folds a2, a2 form upward corner portions 13 of the first hollow structures 11, and the concave folds a1, a1 form downward corner portions 13 of the second hollow structures 12. Thus, it is possible to form the connected hollow structure 1 as shown in FIG. 1 by bonding both sides of the partial circumferences 14, 14 of the mutually-adjacent first hollow structures 11, 11 together, while bonding both sides of the partial circumferences 14, 14 of the mutually-adjacent second hollow structures 12, 12 together, and by cutting the sheet a, which is being delivered, along a required portion.

The connected hollow structure 1 in the first embodiment shows high withstanding strength, which also acts uniformly on the whole, since the hollow structures 11, 12 have the isosceles triangular section, and a planar force is applied to the connected hollow structure 1 so as to substantially uniformly act on the uniformly-inclined side walls common to the adjacent hollow structures 11, 12.

Figure 2:
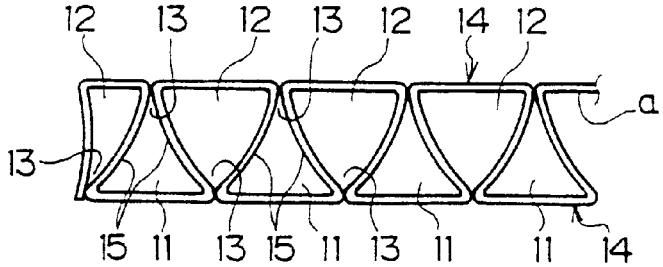
FIG. 2 is a fragmentary end view of the connected hollow structure of FIG. 1, which is transformed under the action of a vertical load.

When the connected hollow structure receives a planar force of not less than a predetermined value, the hollow structures 11, 12 adjacent to each other are transformed such that the inclined side walls thereof are bent as shown in FIG. 2, and as a result, the connected hollow structure 1 shows elasticity (i.e., cushioning properties) within the limit of this transformation.

Thus, the connected hollow structure 1 in this embodiment is used as a panel-shaped packaging member or a cushioning material, and as a core material of a heat-insulating panel or like panels, a wall material, a pallet, and a carrier for carrying adsorbents.

Otherwise, the connected hollow structure 1 in this embodiment is used as a packaging frame structure for wholly packaging bottles, fluorescent tubes, electronic parts or like articles by inserting such articles into hollow portions of the hollow structures 11, 12.

An A-flute corrugated fiberboard (having a flute height of 5.5 mm) consisting of a kraft linerboard of 160 g/m$^2$ and a corrugating medium of 125 g/m$^2$ was fabricated as well as a connected hollow structure, which has a sectional shape similar to that of the connected hollow structure 1 in this embodiment and shows withstanding strength against a planar force substantially similar to that of the A-flute corrugated fiberboard. In this case, the latter was about one-seventh to one-tenth as heavy as the former.

Thus, the connected hollow structure 1 of the sectional shape like the first embodiment is extremely higher in withstanding strength against a planar force and also far smaller in apparent specific gravity (g/cc) than the corrugated fiberboard.

Further, the connected hollow structure 1 shows high withstanding strength against an external force applied in the direction of the hollow structures 11, 12, since the hollow structures 11, 12 are connected together in a parallel and dense arrangement.

The strength of elastic force of the connected hollow structure 1 varies depending on the quality and thickness of the sheet a, and the shape and size of the hollow structures 11, 12. When the hollow structures 11, 12 have the isosceles triangular section like the first embodiment, the elasticity is made more flexible, whereas the elastic force or withstanding strength is reduced accordingly as the bases of the hollow structures 11, 12 in section are enlarged.

It is possible to form the connected hollow structure 1, which has the void content according to the purpose and shows the hardness, withstanding strength and elastic force (cushioning force) according to the purpose, by freely selecting the sectional size of the hollow structures 11, 12.

Since the connected hollow structure 1 is not formed as a standardized product (different from the case of corrugated fiberboard), it is possible to select the material or the sectional shape of the hollow structures 11, 12 according to the purpose.

Further, the connected hollow structure 1 takes the shape resembling a unicursal figure in section, and therefore, is fabricated from a single sheet. Thus, bonding a plurality of sheets of various sectional shapes together in layers is not needed (also different from the case of fabricating the corrugated fiberboard) and, as a result, it is possible to fabricate the connected hollow structure 1 through fewer steps at low cost.

(Second embodiment)

Figure 4:
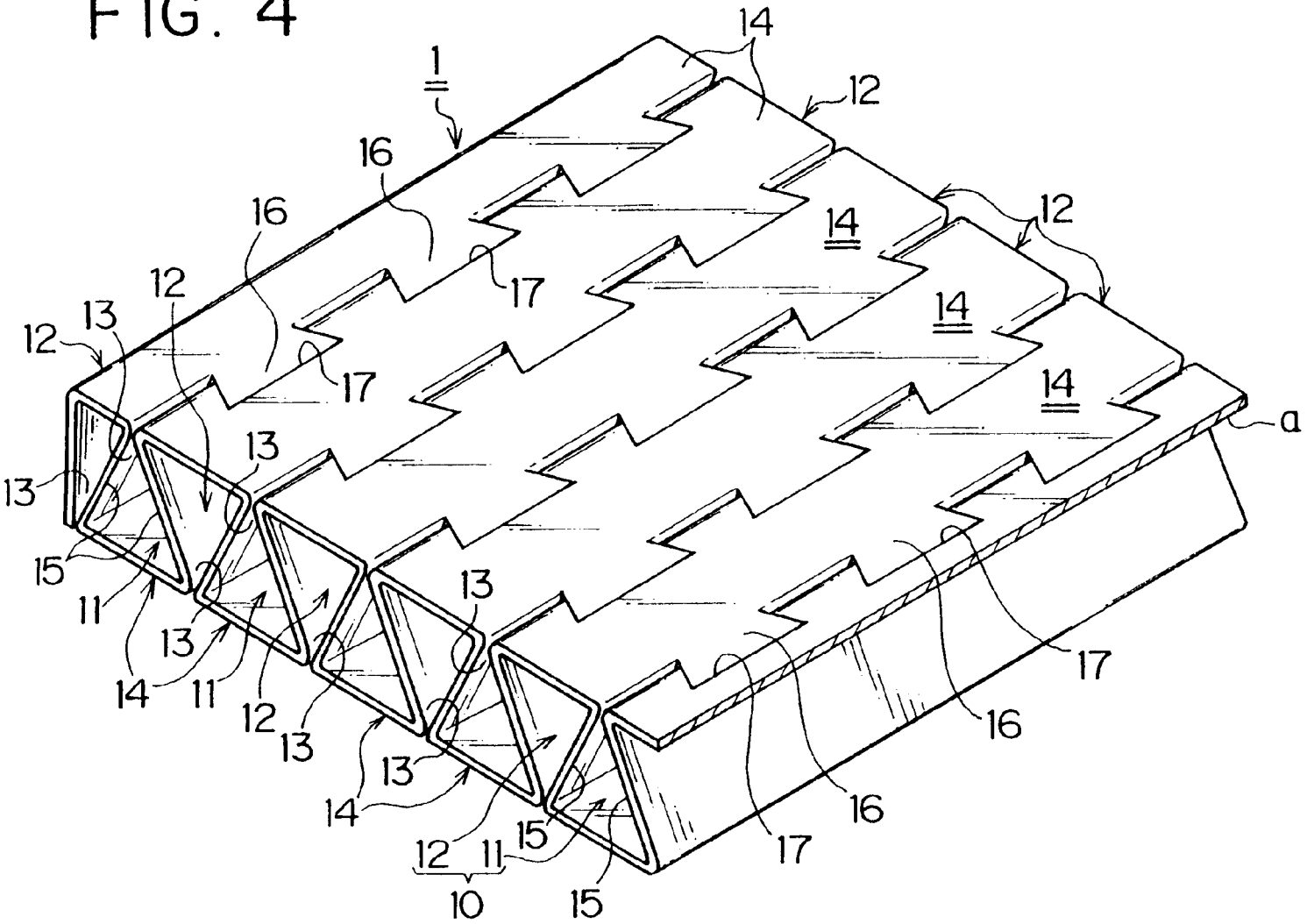
FIG. 4 is a fragmentary perspective view of a connected hollow according to the present invention.
Figure 5:
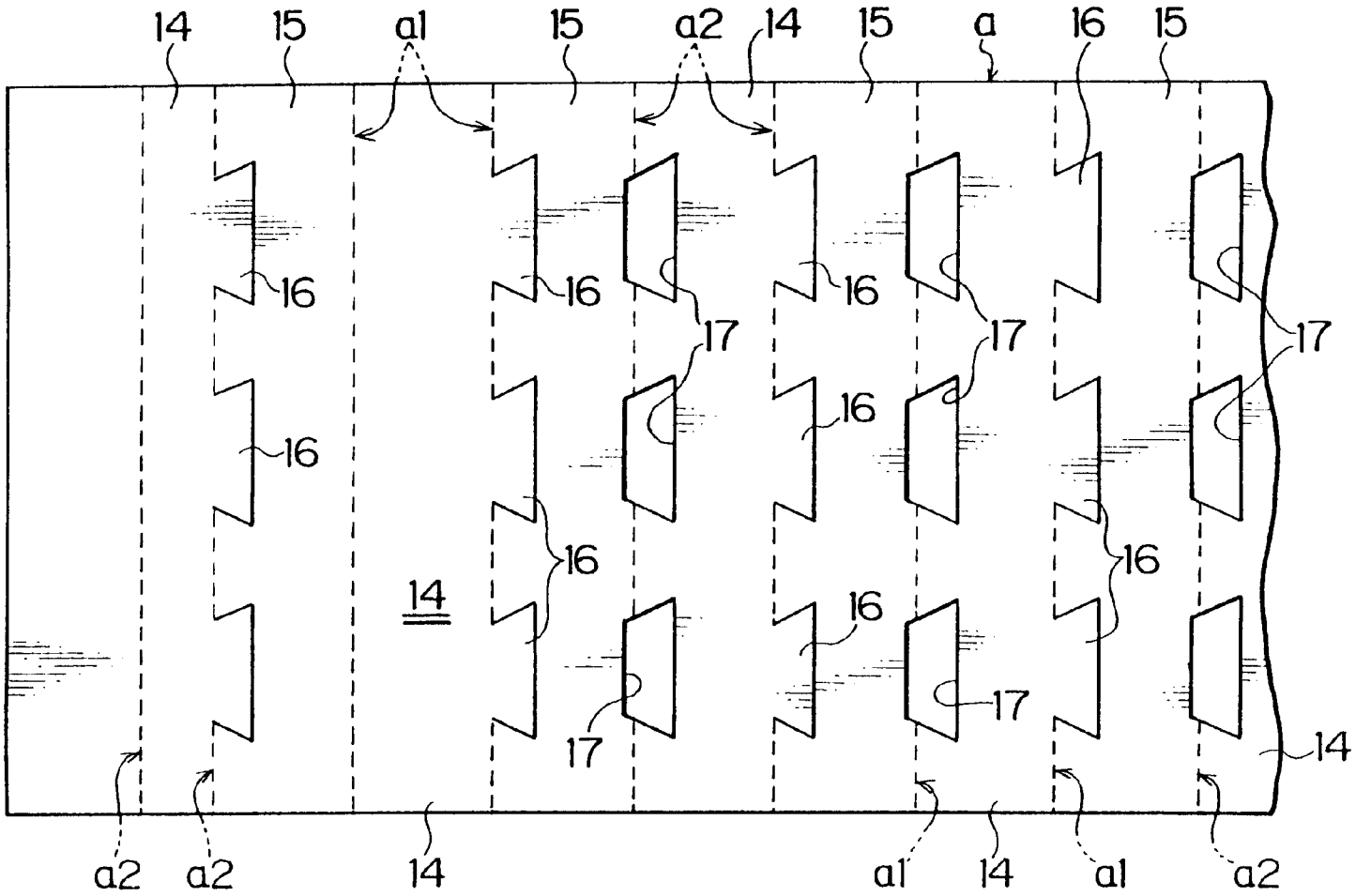
FIG. 5 is a fragmentary developed plan view of the connected hollow structure of FIG. 4.

FIG. 4 is a perspective view showing a connected hollow structure 1 of a second embodiment according to the present invention which is substantially similar in basic constitution to the connected hollow structure in the first embodiment.

Dovetailed projections 16 of a width narrowing toward their bases are formed at certain intervals on both surfaces of the connected hollow structure 1 so as to horizontally project from one side of the partial circumferences 14 of the first hollow structures 11, 11 adjacent to each other and also from one side of the partial circumferences 14 of the second hollow structures 12, 12 adjacent to each other. On the other hand, recess holes 17 fitted to the projections 16 are formed on the other side of the partial circumferences 14. Thus, the first hollow structures 11, 11 adjacent to each other and the second hollow structures 12, 12 adjacent to each other are respectively connected together by fitting the projections 16 into the corresponding recess holes 17.

In order to respectively connect the first hollow structures 11, 11 and the second hollow structures 12, 12 together, the projections 16 are formed by incising the side walls adjacent to the partial circumferences 14 so as to start incising from portions of the folds a1, a2 in case of forming the folds a1, a2 on the sheet a. No folds a1, a1 are formed along the bases of the projections 16.

At the same time, the recess holes 17 fitted to the projections 16 are formed in portions of the side walls 15, 15 such that the recess holes 17 extend over the partial circumference 14 adjacent to each side wall up to an extent corresponding to the thickness of the sheet a.

Figure 6:
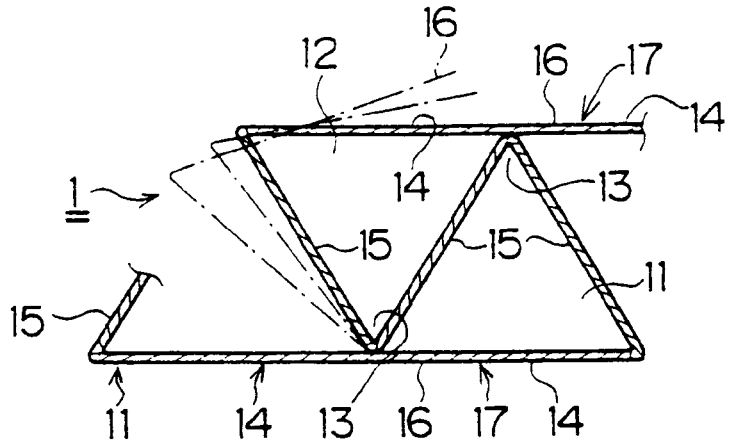
FIG. 6 is a fragmentary enlarged sectional view of the connected hollow structure of FIG. 4.

The projections 16 enter the recess holes 17 so as to cover the recess holes with the projections, as shown on an enlarged scale in FIG. 6, by forming the projections 16 and the recess holes 17 in required portions of the sheet a as described above. Thus, the projections 16 are smoothly fitted into the recess holes 17, in case of folding the sheet a along the folds a1, a2.

The connected hollow structure 1 in the second embodiment is fabricated more simply, since no step of gluing the sheet a is needed in case of respectively connecting the partial circumferences 14, 14 of the mutually-adjacent first hollow structures 11, 11 and those of the mutually-adjacent second hollow structures 12, 12 together.

Other respects of the functions and effects of the connected hollow structure 1 in the second embodiment are substantially similar to those of the connected hollow structure 1 in the first embodiment, and hence, the description thereof will be omitted.

(Third embodiment)

Figure 7:
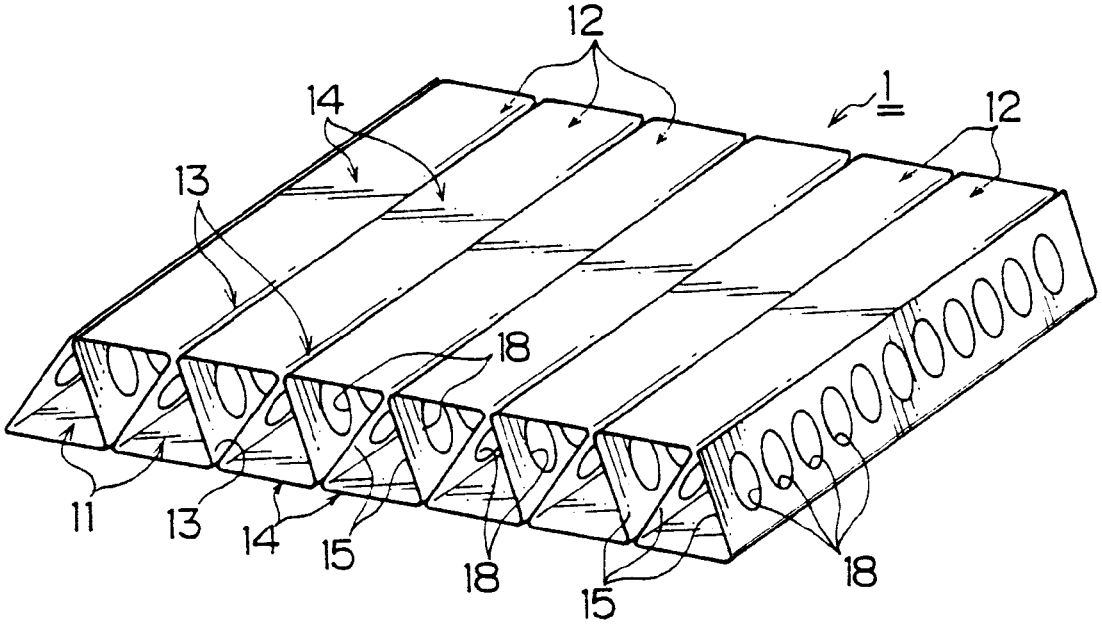
FIG. 7 is a fragmentary perspective view of a connected hollow structure in a third embodiment according to the present invention.

FIG. 7 shows a connected hollow structure 1 of a third embodiment according to the present invention wherein a large number of holes 18 of a predetermined shape are formed in the inclined side walls 15 which form the borders between the hollow structures 11, 12 adjacent to each other.

Since the large number of holes 18 are formed in the side walls 15, the connected hollow structure 1 in this embodiment reduces its overall apparent specific gravity and shows more flexible elasticity (i.e., reduces its elastic force) accordingly.

Thus, it is possible to form a connected hollow structure, which shows desired elasticity, by selecting the shape, size and density of the holes 18.

Other respects of the constitution, functions and effects of the connected hollow structure 1 in the third embodiment are substantially similar to those of the connected hollow structure in the first embodiment, and hence, the description thereof will be omitted.

(Fourth embodiment)

Figure 8:
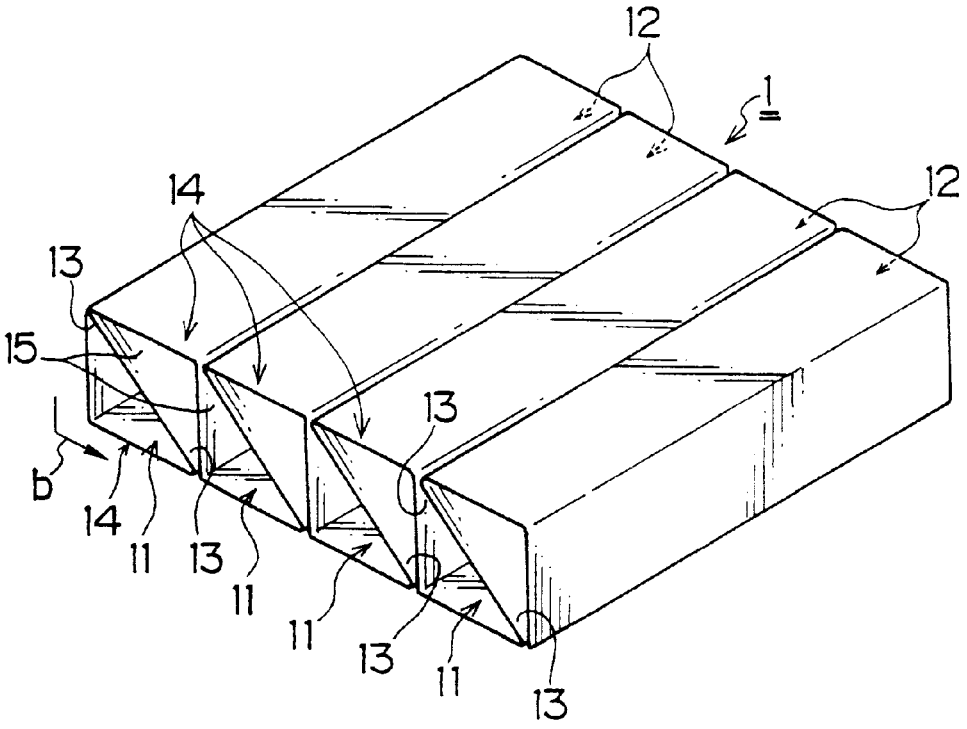
FIG. 8 is a perspective view of a connected hollow structure in a fourth embodiment according to the present invention.

FIG. 8 shows a connected hollow structure 1 of a fourth embodiment which has a flat panel-like overall shape similar to the connected hollow structure 1 in the first embodiment, except that first and second hollow structures 11, 12 in the fourth embodiment have a rectangular equilateral triangular section.

The connected hollow structure 1 in this embodiment is fabricated as follows. Firstly, a sheet (not shown) used as a material of the connected hollow structure 1 is folded along concave and convex folds. In this case, the folding of the sheet starts according to the direction as shown by an arrow b in FIG. 8. Subsequently, while the sheet is being folded in sequence, the partial circumferences 14 adjacent to each other are connected together by bonding in portions of upper and lower corner portions 13 such that the hollow structures 11, 12 of the rectangular equilateral triangular section are densely arranged in an alternately inverse position in section.

Figure 9:
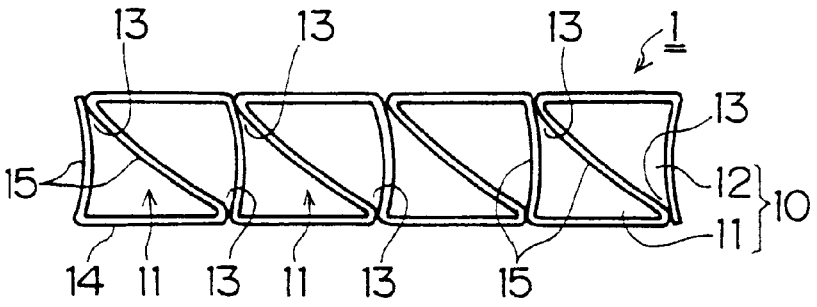
FIG. 9 is an end view of the connected hollow structure of FIG. 8, which is transformed under the action of a vertical load.

The connected hollow structure 1 in this embodiment withstands a planar force mainly by vertical side walls and inclined side walls 15 of the hollow structures 11, 12. Thus, when the connected hollow structure 1 is exposed to a planar force of not less than a predetermined value, the side walls 15 are bent as shown in FIG. 9 and absorb such a planar force.

Other respects of the constitution, functions and effects of the connected hollow structure in the fourth embodiment are substantially similar to those of the connected hollow structure in the first embodiment, and hence, the description thereof will be omitted.

(Fifth embodiment)

Figure 10:
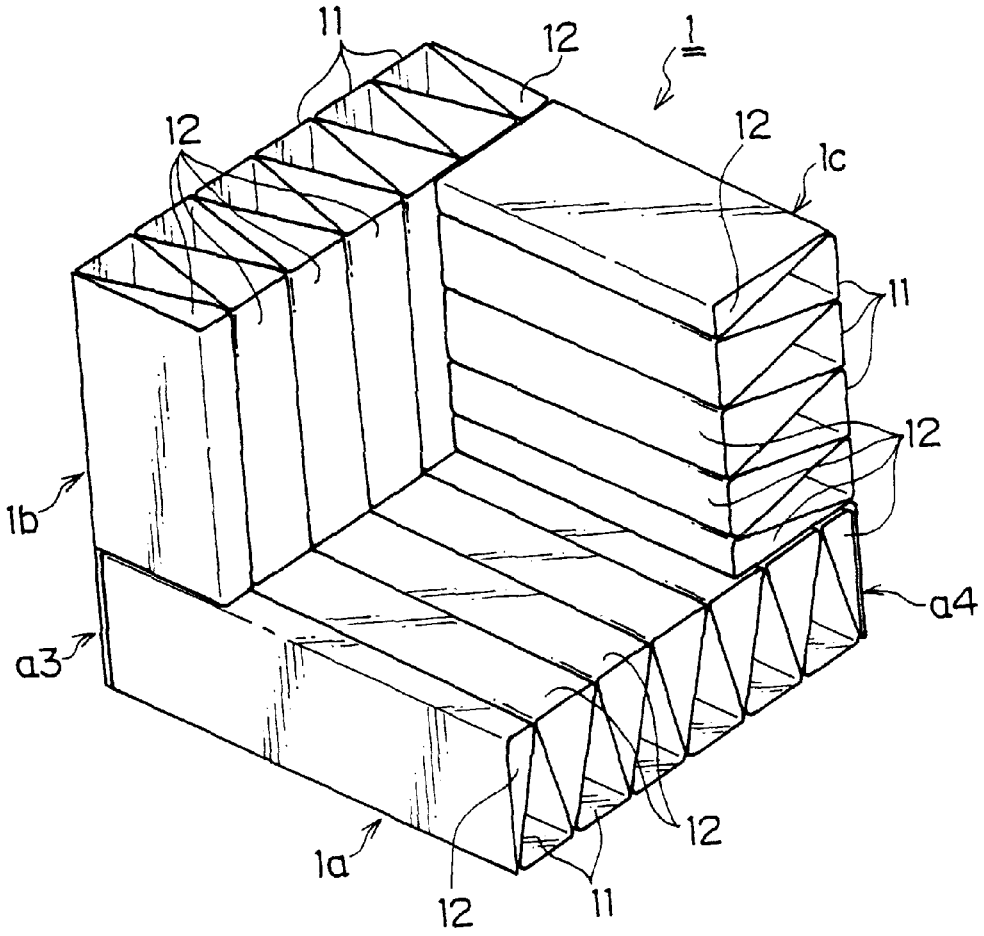
FIG. 10 is a perspective view of a connected hollow structure in a fifth embodiment according to the present invention.

FIG. 10 shows a packaging member comprised of a connected hollow structure 1 of a fifth embodiment which is formed as a corner protection frame, which also serves as a cushioning material for protecting a corner portion of an article when packaged, and is composed of a connected bottom structure 1*a*, a connected side structure 1*b* uprightly placed on the top surface of one side of the connected bottom structure 1*a*, and a connected rear structure 1*c* uprightly and sideways placed on the top surface of the rear side of the connected bottom structure 1*a*. The connected bottom, side and rear structures 1*a*, 1*b*, 1*c* are substantially at right angles with one another.

First and second hollow structures 11, 12 of the connected bottom, side and rear structures 1*a*, 1*b*, 1*c* are of the same size and have an isosceles triangular section. However, the second hollow structures 12 on both ends of the connected bottom, side and rear structures 1*a*, 1*b*, 1*c* have a right-angled triangular section.

The connected bottom structure 1*a* and the connected side structure 1*b* are connected together as one body through connecting sheet portions a3, and the connected bottom structure 1*a* and the connected rear structure 1*c* are connected together as one body through another connecting sheet portion a4.

Figure 11:
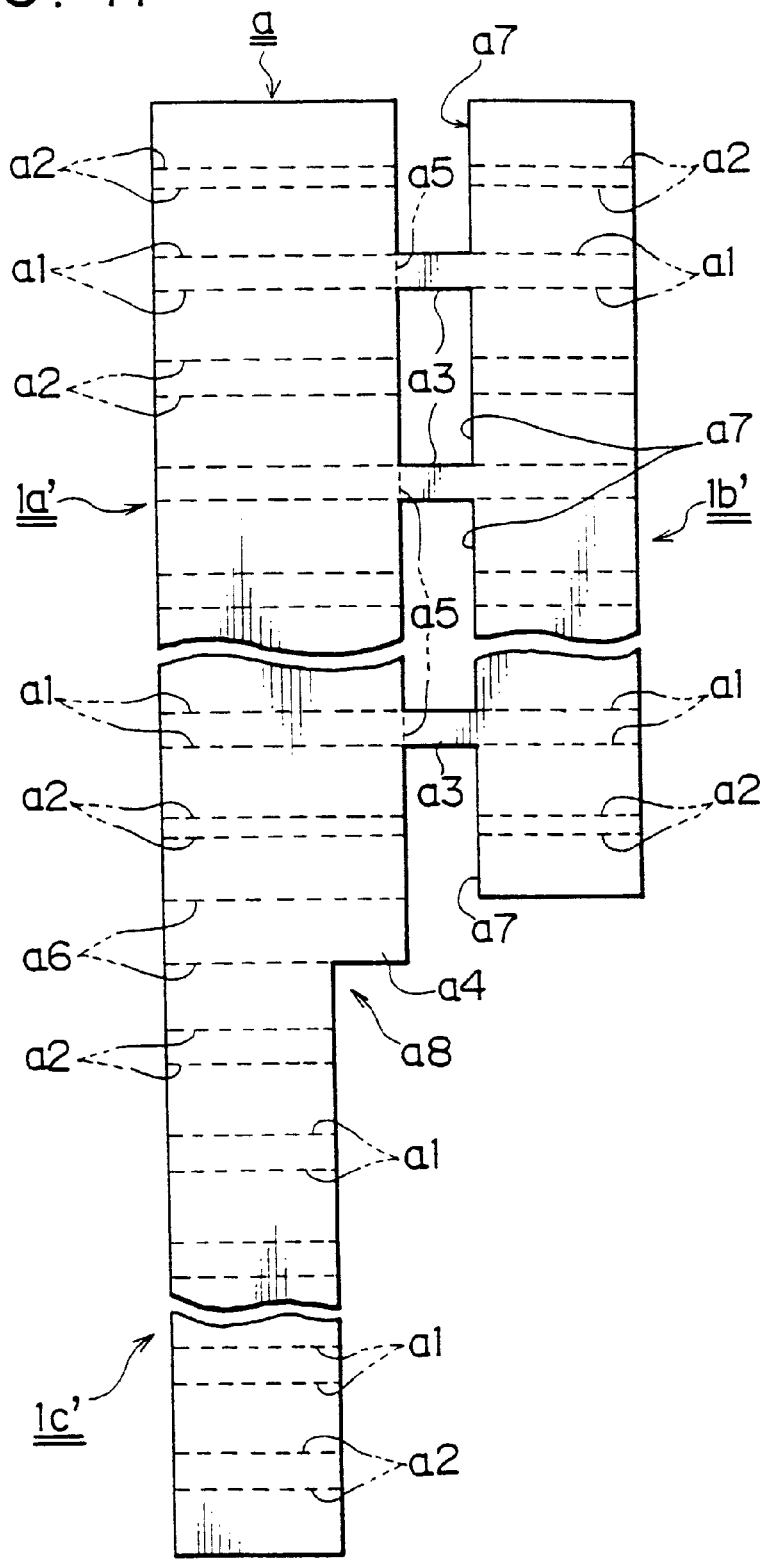
FIG. 11 is a fragmentary developed plan view of the connected hollow structure of FIG. 10.

The connected hollow structure 1 in the fifth embodiment is fabricated as follows. Firstly, as shown in FIG. 11, while a sheet a is being delivered in a certain direction convex folds a2, a2 and concave folds a1, a1 are formed on the sheet a so as to extend in the cross direction of the sheet in an alternate arrangement according to the sectional height and base width of the hollow structures 11, 12, similarly to the case in the first embodiment.

Recess portions a7 of a width corresponding to the sectional height of the hollow structures 11, 12 are formed along the border between a sheet portion 1*a*' which forms the connected bottom structure 1*a* shown in FIG. 10, and a sheet portion 1*b*', which forms the connected side structure 1*b*, by cutting portions other than the connecting sheet portions a3 formed in alignment with portions defined by the adjacent folds a1, a1. A fold a5 is formed on one required end of each connecting sheet portion a3 so as to extend at right angles with the folds a1, a1.

Parallel folds a6, a6 are formed along the border between the sheet portion 1*a*', which forms the connected bottom structure 1*a* shown in FIG. 10, and a sheet portion 1*c*', which forms the connected rear structure 1*c*, such that the folds a6, a6 are positioned on both sides of the connecting sheet portion a4. Further, a recess portion a8 of a width corresponding to the sectional height of the hollow structures 11, 12 is formed from a portion of either fold a6 so as to extend over a portion corresponding to the length of the connected rear structure 1*c*.

The required surface of the sheet a is coated with glue (i.e., an adhesive) along the folds a1, a2 and a6.

Subsequently, while the sheet a is being folded in sequence along the folds a1, a2 and a6 to form the first and second hollow structures 11, 12, the edges of the first hollow structures 11 adjacent to each other and those of the second hollow structures 12 adjacent to each other are bonded together, and the sheet a is cut along a desired portion. However, when a sheet previously cut in a predetermined shape is used, a cutting step is not needed.

Figure 12:
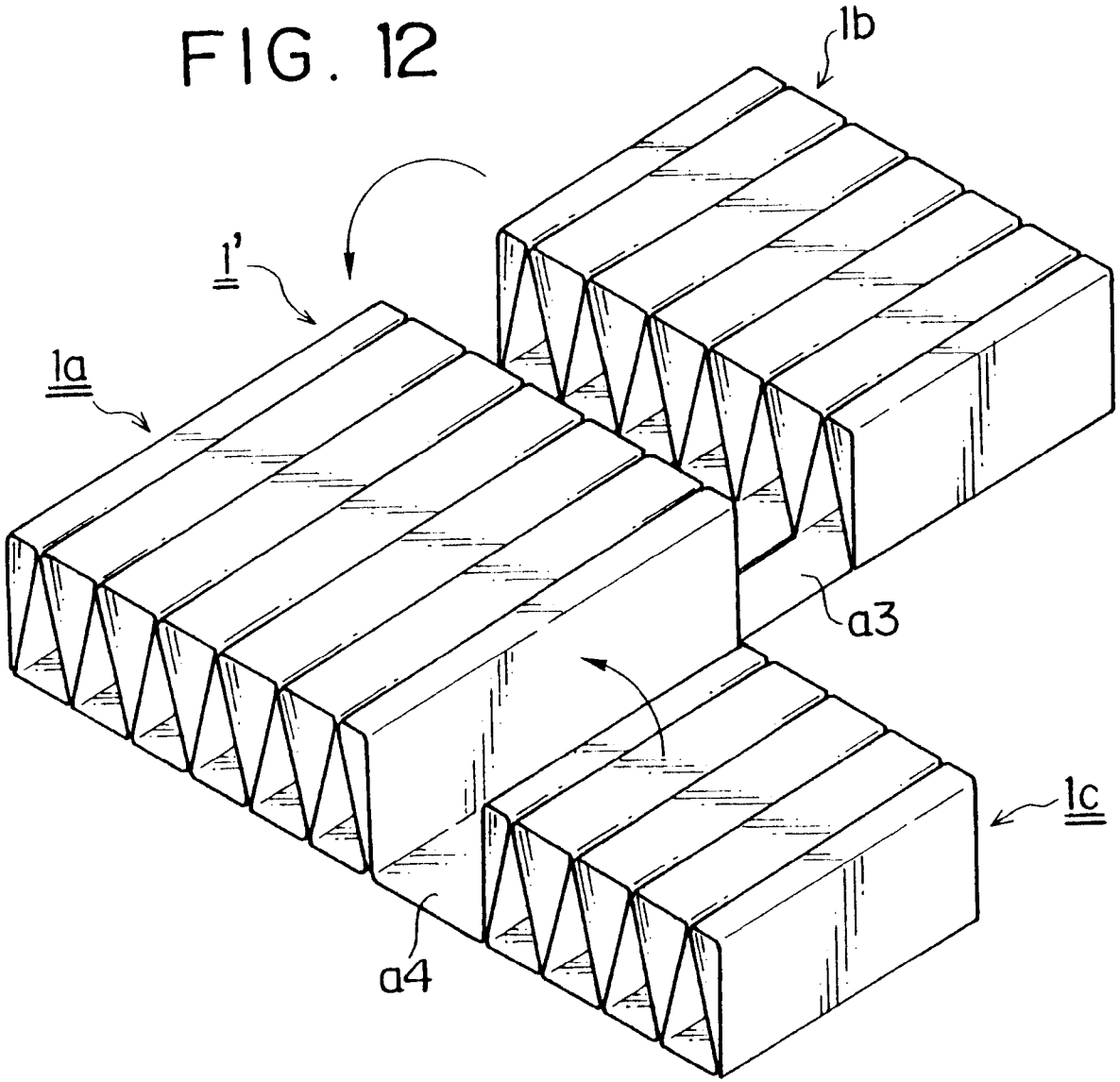
FIG. 12 is a developed perspective view of the connected hollow structure of FIG. 10 immediately before completion.

According to the above procedure, a connected hollow structure 1' in a developed state is formed, in which the connected side structure 1*b* is connected to one end of the connected bottom structure 1*a* through the connecting sheet portions a3, and the connected rear structure 1*c* is connected to the side of the connected bottom structure 1*a* through the connecting sheet portion a4, as shown in FIG. 12.

The connected hollow structure 1' in the developed state shown in FIG. 12 is used in distribution as it is. However, when it is necessary to package articles in a connected hollow structure immediately after the fabrication, the connected hollow structure 1 is formed as shown in FIG. 1 by raising the connected side structure 1*b* and the connected rear structure 1*c* together with the respective connecting sheet portions a3, a4 in the direction shown by arrows in FIG. 12.

For instance, in a case where there is a possibility that the connected hollow structure 1 in the state shown in FIG. 10 is collapsed when packed, the connected side structure 1*b* and the connected rear structure 1*c* may be fixed to the connected bottom structure 1*a* by bonding or other appropriate means, as needed.

In addition to the procedure of fabrication as described above, the connected hollow structure 1 may be fabricated by independently forming the connected bottom structure 1*a*, the connected side structure 1*b* and the connected rear structure 1*c*, then combining these structures with one another as shown in FIG. 10, and consequently connecting or fixing the combined structures together.

The connected hollow structure in the fifth embodiment is comprised of a single sheet as described above, and therefore, may be fabricated through fewer steps at lower cost.

Since each of the hollow structures 11, 12 as the components of the connected hollow structure has the isosceles triangular section having a sectional height larger than a base, the connected bottom, side and rear structures 1*a*, 1*b*, 1*c* show high withstanding strength against a planar force.

Further, since the connected bottom, side and rear structures 1*a*, 1*b*, 1*c* are comprised of the same sheet a, and the hollow structures 11, 12 included in these structures have the same shape and are of the same size, the connected bottom, side and rear structures 1*a*, 1*b*, 1*c* show substantially uniform withstanding strength against a planar force.

Other respects of the constitution, functions and effects of the connected hollow structure in the fifth embodiment are substantially similar to those of the connected hollow structure in the first embodiment, and hence, the description thereof will be omitted.

(Sixth embodiment)

Figure 13:
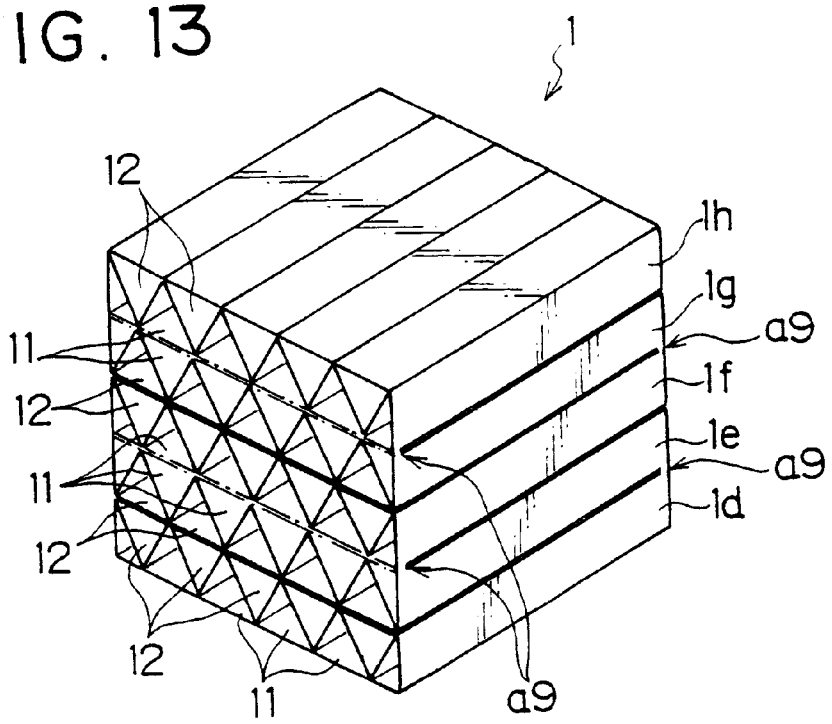
FIG. 13 is a perspective view of a connected hollow structure in a sixth embodiment according to the present invention.

FIG. 13 shows a packaging member formed of a connected hollow structure 1 of a sixth embodiment which is formed as a support block for supporting articles when packaged, and is composed of connected structures 1*d*, 1*e*, 1*f*, 1*g*, 1*h* of the same structure and of the same size, which are formed in layers such that hollow structures 11, 12 (of a regular triangular section) of these connected structures extend in parallel to each other and are arranged in a symmetrical shape.

Figure 15:
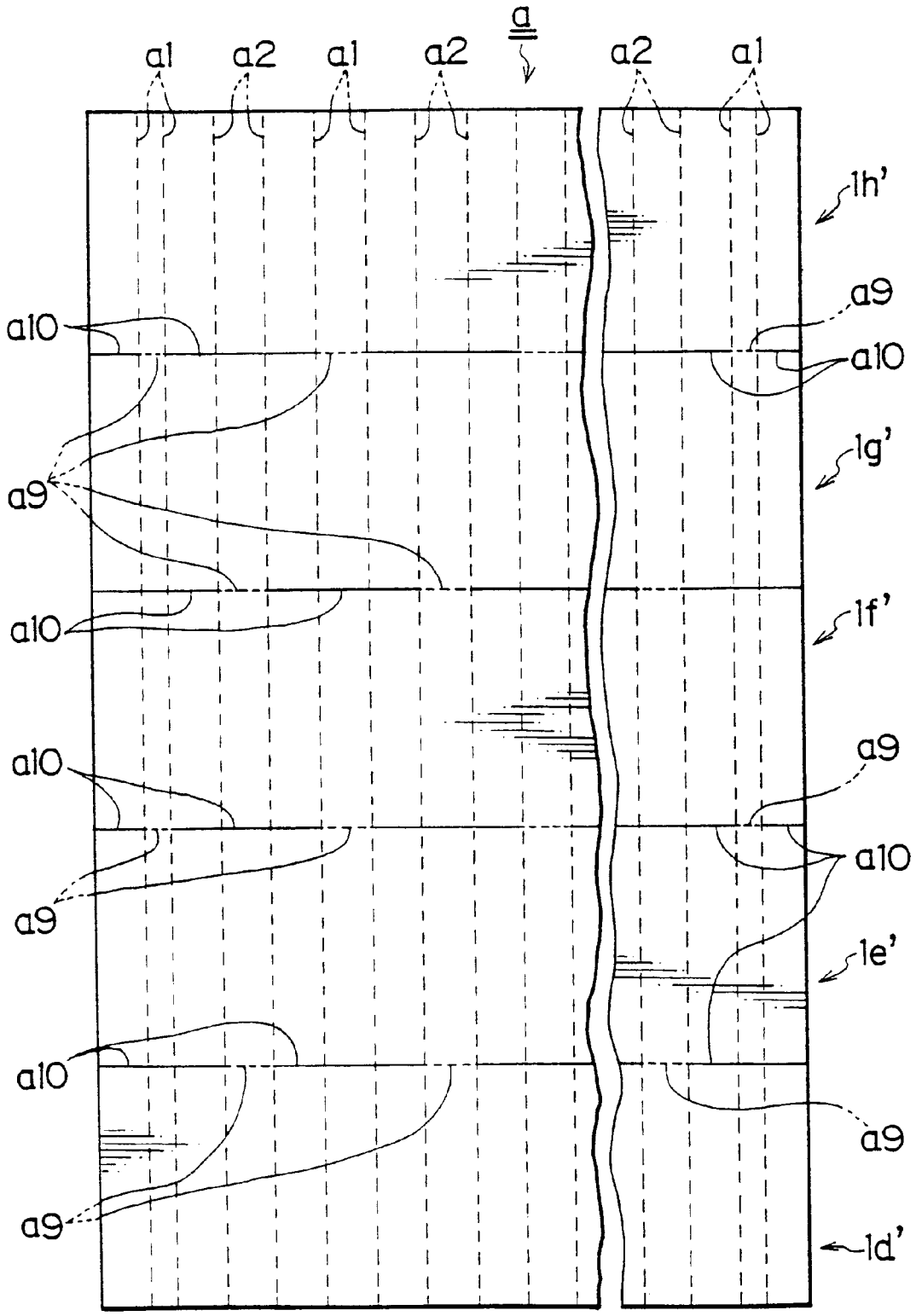
FIG. 15 is a fragmentary developed plan view of the connected hollow structure of FIG. 13.

The connected hollow structure 1 in the sixth embodiment is fabricated as follows. Firstly, as shown in FIG. 15, while a sheet a is being delivered in a certain direction, convex folds a2, a2 and concave folds a1, a1 are formed on the sheet a so as to extend in the transverse direction of the sheet in an alternate arrangement according to the sectional height and base width of the hollow structures 11, 12, similarly to the case in the first embodiment.

Folds a9 are formed between the convex folds a2, a2 along the border between sheet portions 1*d*', 1*e*' , which respectively form the structures 1*d*, 1*e* of FIG. 13, and the border between sheet portions 1*f*', 1*g*' which respectively form the structures 1*f*, 1*g*. Further, breaks a10 are formed along these borders other than portions of the folds a9 so as to be alignment with the folds a9.

On the other hand, folds a9 are formed between the concave folds a1, a1 along the border between sheet portions 1*e*' , 1*f*', which respectively form the structures 1*e*, 1*f*, and the border between sheet portions 1*g*', 1*h*', which respectively form the structures 1*g*, 1*h*. Further, breaks a10 are formed along these borders other than portions of the folds a9 so as to be alignment with the folds a9.

The required surface of the sheet a is coated with glue (i.e., an adhesive) along the folds a1, a2.

Subsequently, while the sheet a is being folded in sequence along the folds a1, a2 to form the hollow structures 11, 12, the edges of the hollow structures 11 adjacent to each other and those of the hollow structures 12 adjacent to each other are respectively bonded together, and the sheet a is cut as required.

Figure 16:
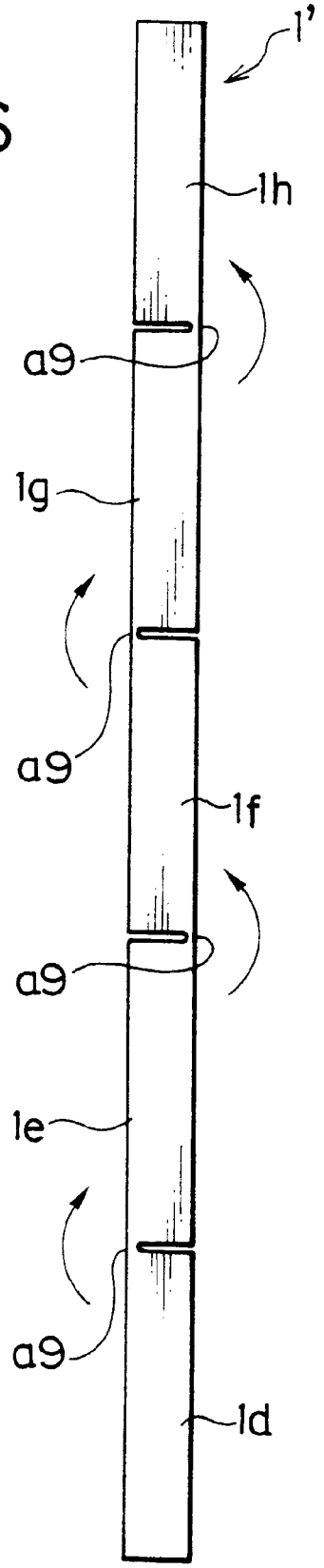
FIG. 16 is a developed side view of the connected hollow structure of FIG. 13 immediately before completion.

According to the above procedure, a connected hollow structure 1' is formed, in which the structures 1*d* to 1*h* are in a developed state, as shown in FIG. 16.

The connected hollow structure 1' in the developed state as shown in FIG. 16 is used for distribution as it is. However, when it is necessary to package articles in a connected hollow structure immediately after the fabrication, a layered connected hollow structure 1 of a block shape is formed as shown in FIG. 13 by alternately making a complete face-about of the structures 1*d* to 1*g* under the hinge action of portions of the folds a9.

For instance, in a case where there is a possibility that the connected hollow structure in the state as shown in FIG. 13 is collapsed when packed, the structures 1*d* to 1*h* may be fixed together by bonding or other appropriate means.

The connected hollow structure 1 in the sixth embodiment is used as the packaging support block and cushioning block as described above, and as a packaging frame structure for packaging bottles or like articles by inserting such articles into the hollow portions. Further, since a large number of hollow portions are arranged densely, the connected hollow structure in this embodiment is suitable for use as a carrier for carrying adsorbents.

The connected hollow structure 1 in the sixth embodiment is comprised of a single sheet as described above, and therefore, may be fabricated through fewer steps at lower cost, and the structures 1*d* to 1*h* show substantially uniform elastic force and withstanding strength against a planar force.

Since each of the hollow structures 11, 12 as the components of the connected hollow structure has the isosceles triangular section having the sectional height larger than the base, the connected hollow structure 1 shows high withstanding strength against a planar force.

Further, since the hollow structures 11, 12 are formed densely in parallel to each other, the connected hollow structure 1 shows high withstanding strength against an external force in the direction of the hollow structures 11, 12. Thus, the connected hollow structure 1 in this embodiment is also suitable for use as a core material of a hollow panel (not shown) by designing the hollow structures 11, 12 to uniformly have a short length, and then inserting the connected hollow structure 1 into the hollow panel such that the hollow structures thus designed extend in the thickness direction of the hollow panel.

As a modification of the sixth embodiment, it is possible to fabricate a connected hollow structure of a block shape by individually forming the structures 1*d* to 1*h* of the respective layers, arranging these structures in layers and then bonding the layered structures together.

In this case, when a connected hollow structure of a block shape is fabricated such that the hollow structures 11, 12 extend at right angles to each other, it is possible to form a layered connected structure which shows high withstanding strength against an external force in every direction.

Other respects of the constitution, functions and effects of the connected hollow structure in the sixth embodiment are substantially similar to those of the connected hollow structure in the first embodiment, and hence, the description thereof will be omitted.

(Seventh embodiment)

Figure 14:
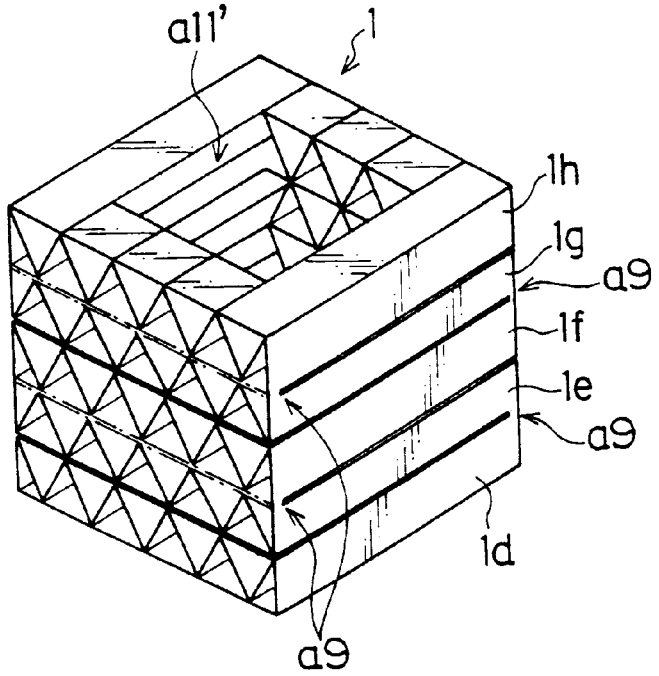
FIG. 14 is a perspective view of a connected hollow structure in a seventh embodiment according to the present invention.

FIG. 14 shows a packaging member formed of a connected hollow structure 1 of a seventh embodiment which is a modification of the connected hollow structure in the sixth embodiment, and is composed of the structures 1*d* to 1*h* which are layered in a block shape by making use of the hinge action of folds a9. A quadrangular hole a11' is formed in the center of the layered connected hollow structure at right angles with the hollow structures 11, 12.

The connected hollow structure 1 in the seventh embodiment is fabricated as follows. Firstly, as shown in FIG. 17, in a step of forming a sheet a constituted substantially similarly to that shown in FIG. 17, in a step of forming a sheet a constituted substantially similarly to that shown in FIG. 15, recess holes all, which form the hole a11' described above, are formed in required portions in the center of sheet portions 1*e* to 1*h* other than a sheet portion 1*d'* which forms the structure 1*d* shown in FIG. 14, and the sheet a is folded according to a procedure similar to that in case of the sixth embodiment.

The connected hollow structure 1 in the seventh embodiment has the holes a11' formed as described above, and therefore, is suitable for use as a packaging frame structure, which also serves as a cushioning material for an article having a portion fit for the shape of the hole a11 by inserting such a portion of the article into the hole a11.

Figure 17:
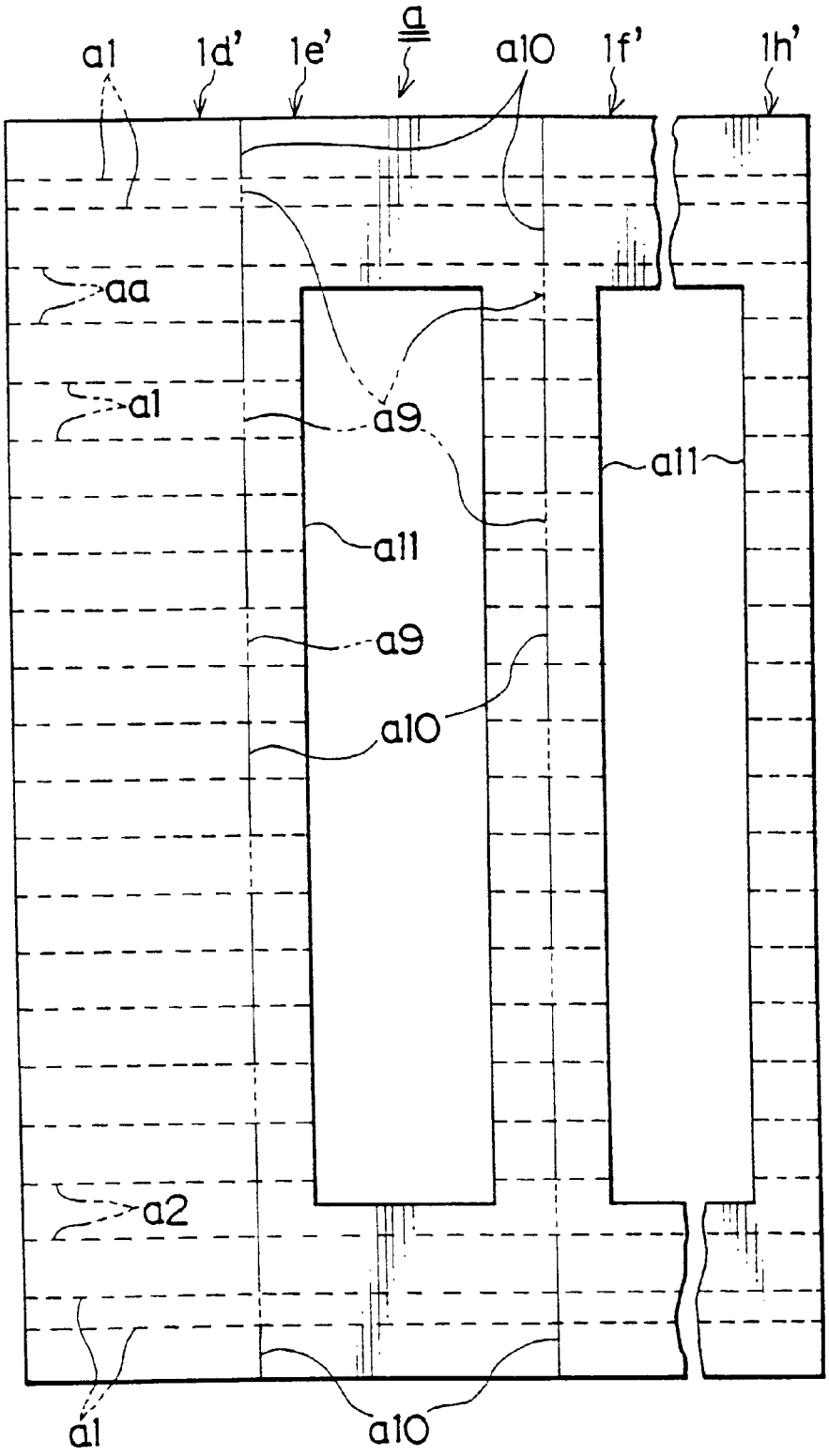
FIG. 17 is a fragmentary developed plan view of the connected hollow structure of FIG. 14.

When a recess hole a22 is formed in the sheet portion 1*d'* of FIG. 17 similarly to the recess holes a11 formed in the sheet portions 1*e* to 1*h*, portions of the holes a11 form a through hole extending through a connected hollow structure 1 of a block shape. The connected hollow structure 1 having the through hole as described above is used for packaging an article fit for the shape of the through hole by inserting such an article through the connected hollow structure 1.

Other respects of the constitution, functions and effects of the connected hollow structure in the seventh embodiment are substantially similar to those of the connected hollow structure in the sixth embodiment, and hence, the description thereof will be omitted.

(Eighth embodiment)

Figure 18:
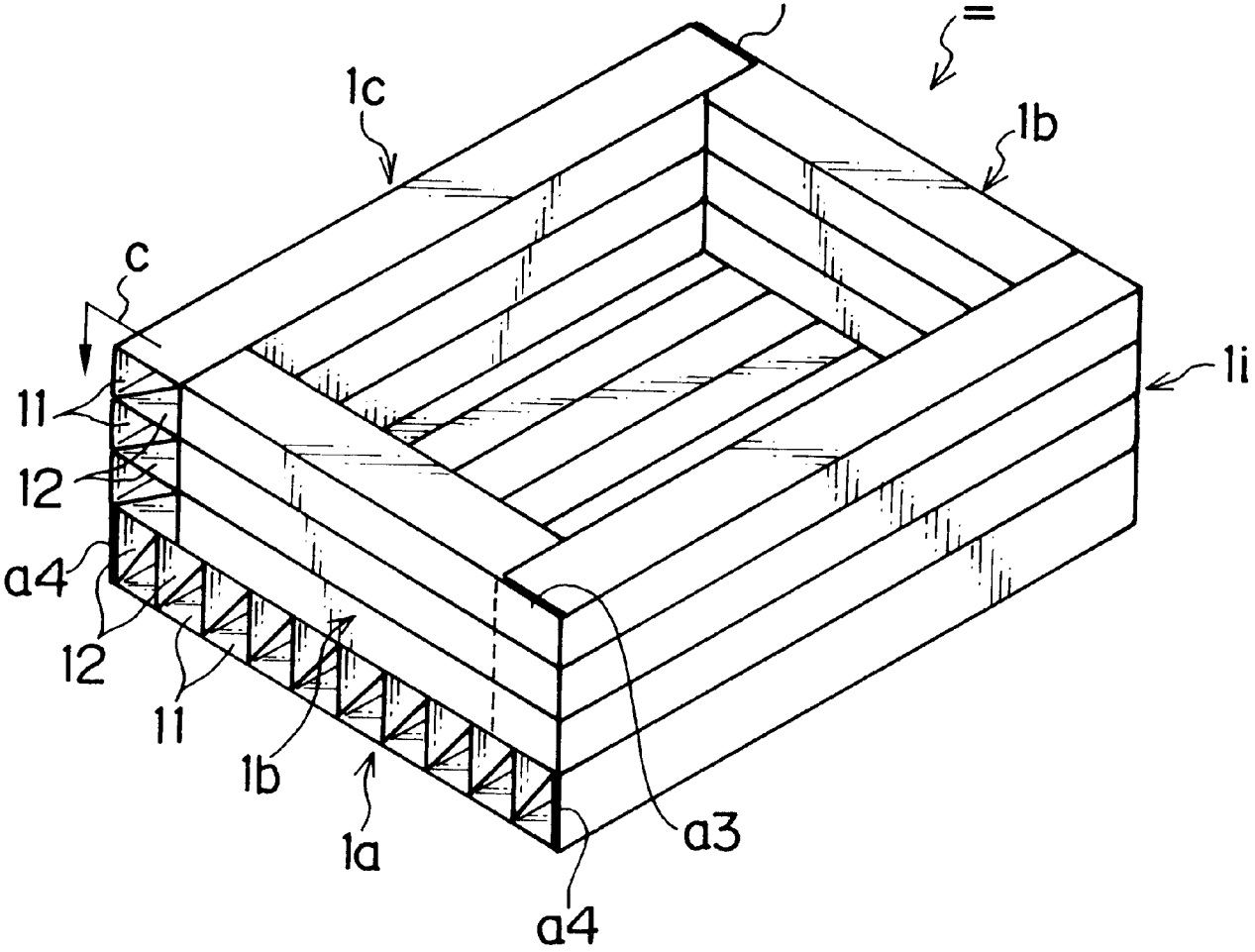
FIG. 18 is a perspective view of a connected hollow structure in an eighth embodiment according to the present invention.

FIG. 18 shows a packaging member formed of a connected hollow structure 1 of an eighth embodiment which has a generally tray-like shape and is composed of a connected bottom structure 1*a*, a pair of connected side structures 1*b*, 1*b* uprightly placed on both ends of the connected bottom structure 1*a*, a connected front structure 1*i* uprightly placed on the front end of the connected bottom structure 1*a*, and a connected rear structure 1*c* uprightly placed on the rear end of the connected bottom structure 1*a*.

The connected bottom structure 1*a* is connected to the connected front structure 1*i* and the connected rear structure 1*c* through respective connecting portions a4, and the connected front structure 1*i* and the connected rear structure 1*c* are connected to the connected side structures 1*b*, 1*b* through respective connecting portions a3.

First and second hollow structures 11, 12 included in the connected bottom, side, front and rear structures 1*a*, 1*b*, 1*i*, 1*c* have a right-angled triangular section having a slightly larger height, and are of the substantially same size.

Figure 19:
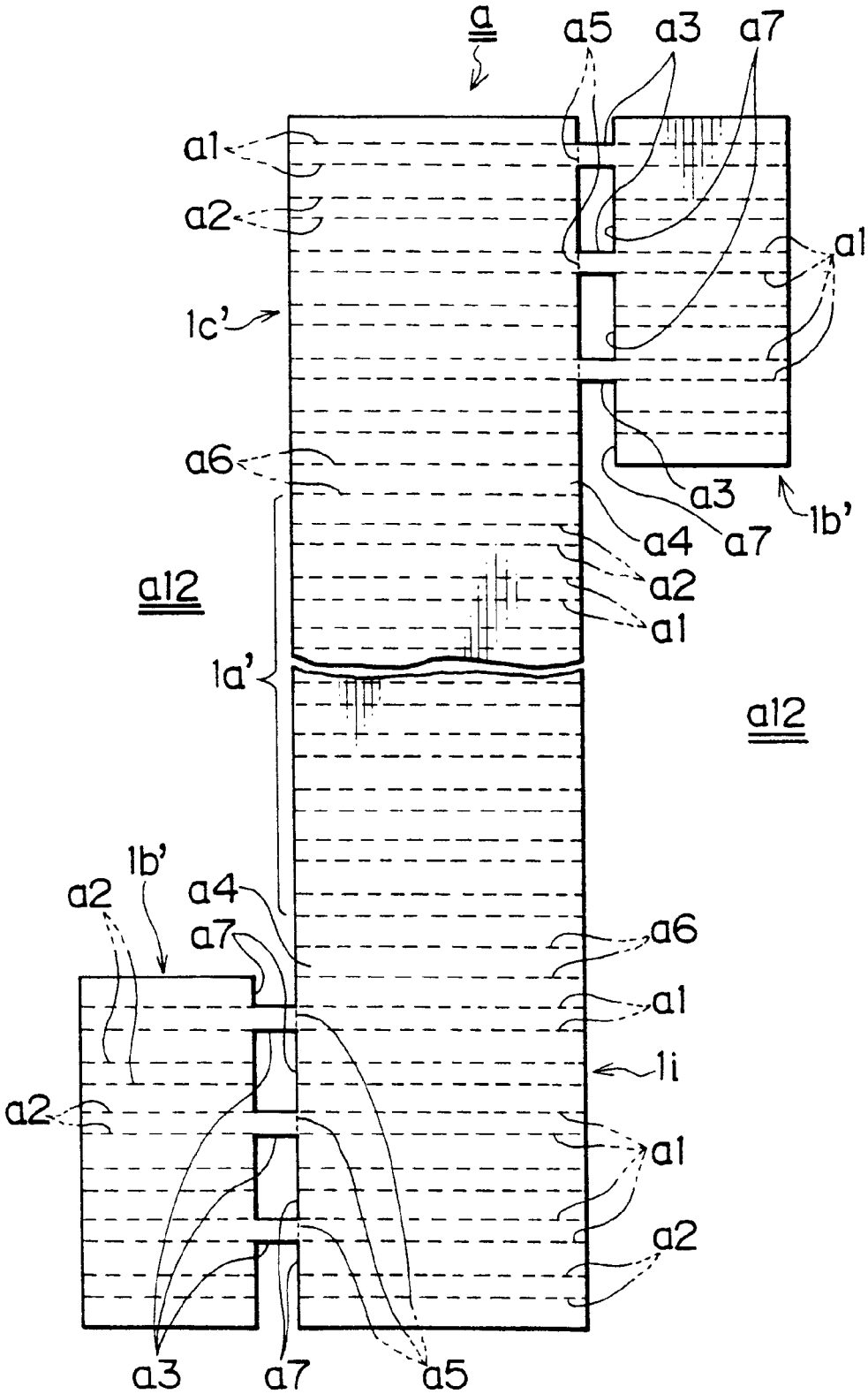
FIG. 19 is a fragmentary developed plan view of the connected hollow structure of FIG. 18.

The connected hollow structure 1 in the eighth embodiment is fabricated as follows. Firstly, as shown in FIG. 19, while a sheet a of a certain width is being delivered in a certain direction, concave folds a1, a1 and convex folds a2, a2 are formed on the sheet a so as to extend in the transverse direction of the sheet in an alternate arrangement according to the sectional height and base width of the hollow structures 11, 12.

Recess portions a7 of a width corresponding to the sectional height of the hollow structures 11, 12 are formed along the border between a sheet portion 1*c'* which forms the connected rear structure 1*c* in FIG. 18, and a sheet portion 1*b'*, which forms the connected side structure 1*b*, and along the border between a sheet portion 1*i'*, which forms the connected front structure 1*i* and the sheet portion 1*b'*, by cutting portions other than connecting sheet portions a3 formed in alignment with portions between the folds a1, a1. Further, a fold a5 is formed on one required end of each connecting sheet portion a3 so as to extend at right angles with the folds a1, a1.

Parallel folds a6, a6 are formed along the border between a sheet portion 1*a*', which forms the connected bottom structure 1*a* of FIG. 18, and the sheet portion 1*i*' and along the border between the sheet portion 1*a*' and the sheet portion 1*c*' such that the folds a6, a6 are positioned along both sides of the connecting sheet portion a4. Further, unnecessary portions a12, a12 corresponding to length portions of the structures 1*b*, 1*b* are cut from portions aligned with either fold a6 of the sheet a.

The required surface of the sheet a is coated with glue (i.e., an adhesive) along the folds a1, a2 and a6.

Subsequently, while the sheet a is being folded in sequence along the folds a1, a2 and a6 to form the hollow structures 11, 12, the edges of the hollow structures 11 adjacent to each other and those of the hollow structures 12 adjacent to each other are respectively bonded together, and the sheet a is cut along a required portion.

The folding of the sheet a starts according to the direction as shown by an arrow C of FIG. 18, for instance.

According to the above procedure, a connected hollow structure in a developed state is formed, in which the connected front and rear structures 1*i*, 1*c* are connected to the front and rear portions of the connected bottom structure 1*a* through the connecting sheet portions a4, and the connected side structures 1*b* are connected to the sides of the connected front and rear structures 1*i*, 1*c* through the connecting sheet portions a3. Incidentally, a developed view thereof will be omitted.

The connected hollow structure in the developed state is used for distribution as it is. However, when it is necessary to package articles in a connected hollow structure immediately after the fabrication, a connected hollow structure of a tray-like shape is formed as shown in FIG. 18 by placing the connected side structures 1*b*, 1*b* and the connected front and rear structures 1*i*, 1*c* on the required portions of the connected bottom structure 1*a*.

The connected side, front and rear structures 1*b*, 1*i*, 1*c* may be fixed to the connected bottom structure 1*a* by bonding or other appropriate means, as needed.

The connected hollow structure 1 in the eighth embodiment is used as a container or box for carrying or transporting fishery products, frozen food or the like by shrink-packing the whole connected hollow structure 1 with a shrink film along the external shape of the connected hollow structure 1, for instance. Further, the whole connected hollow structure may be shrink-packed even in its developed state. Thus, it is possible to enhance heat-insulation, humidity-resistance and water-tightness of the container by shrink-packing the connected hollow structure in this manner.

The connected hollow structure in the eighth embodiment may be also used as a packaging frame structure, which also serves as a cushioning material for packaging articles by partly inserting such articles into the connected hollow structure, without being shrink-packed as described above.

Further, instead of the above procedure of fabrication, the connected hollow structure 1 may be fabricated by individually forming the structures 1*a*, 1*b*, 1*c*, 1*i*, and then connecting or fixing these structures together as shown in FIG. 18.

Other respects of the constitution, functions and effects of the connected hollow structure in the eighth embodiment are substantially similar to those of the connected hollow structure in the fifth embodiment, and hence, the description thereof will be omitted.

(Ninth embodiment)

Figure 20:
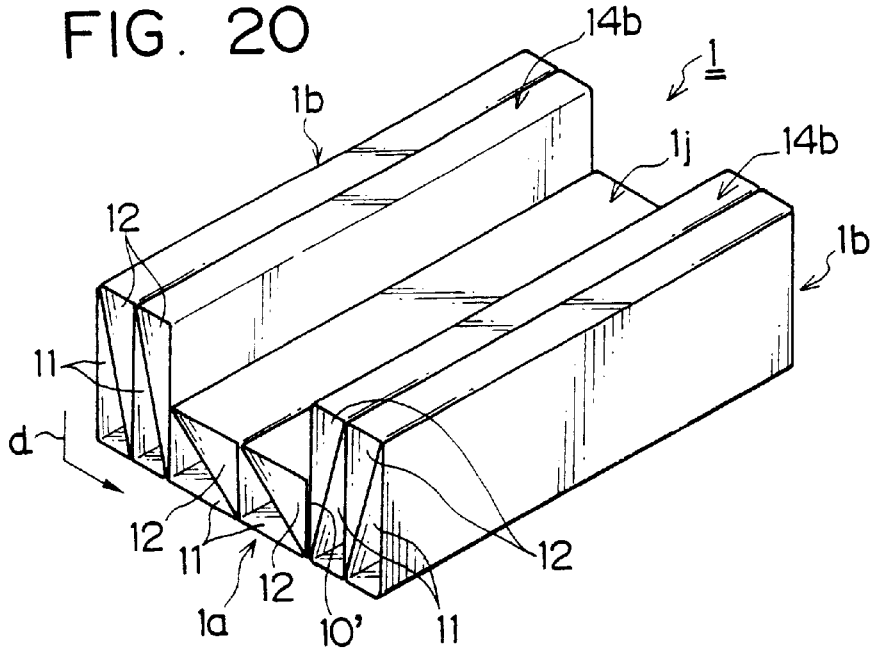
FIG. 20 is a perspective view of a connected hollow structure in a ninth embodiment according to the present invention.

FIG. 20 shows a packaging member formed of a connected hollow structure in a ninth embodiment wherein the connected hollow structure 1 has a generally rectangular gutter-like shape and is composed of a connected bottom structure 1*a*, and a pair of connected side structures 1*c*, 1*c* formed on both sides of the connected bottom structure 1*a* as one body, and a channel-like portion 1*j* is formed in the center of the connected hollow structure so as to extend in the lengthwise direction of hollow structures 11, 12.

First and second hollow structures 11, 12 included in the connected bottom structure 1*a* have a rectangular equilateral triangular section, and first and second hollow structures 11, 12 included in the connected side structures 1*b*, 1*b* have a right-angled triangular section which is larger in height and narrower in base width than the hollow structures 11, 12 of the connected bottom structure 1*a*. Thus, the upper portion of each connected side structure 1*b* forms a projection 14*b* projecting upwards from the upper surface of the connected bottom structure 1*a* through a certain difference in level.

Figure 22:
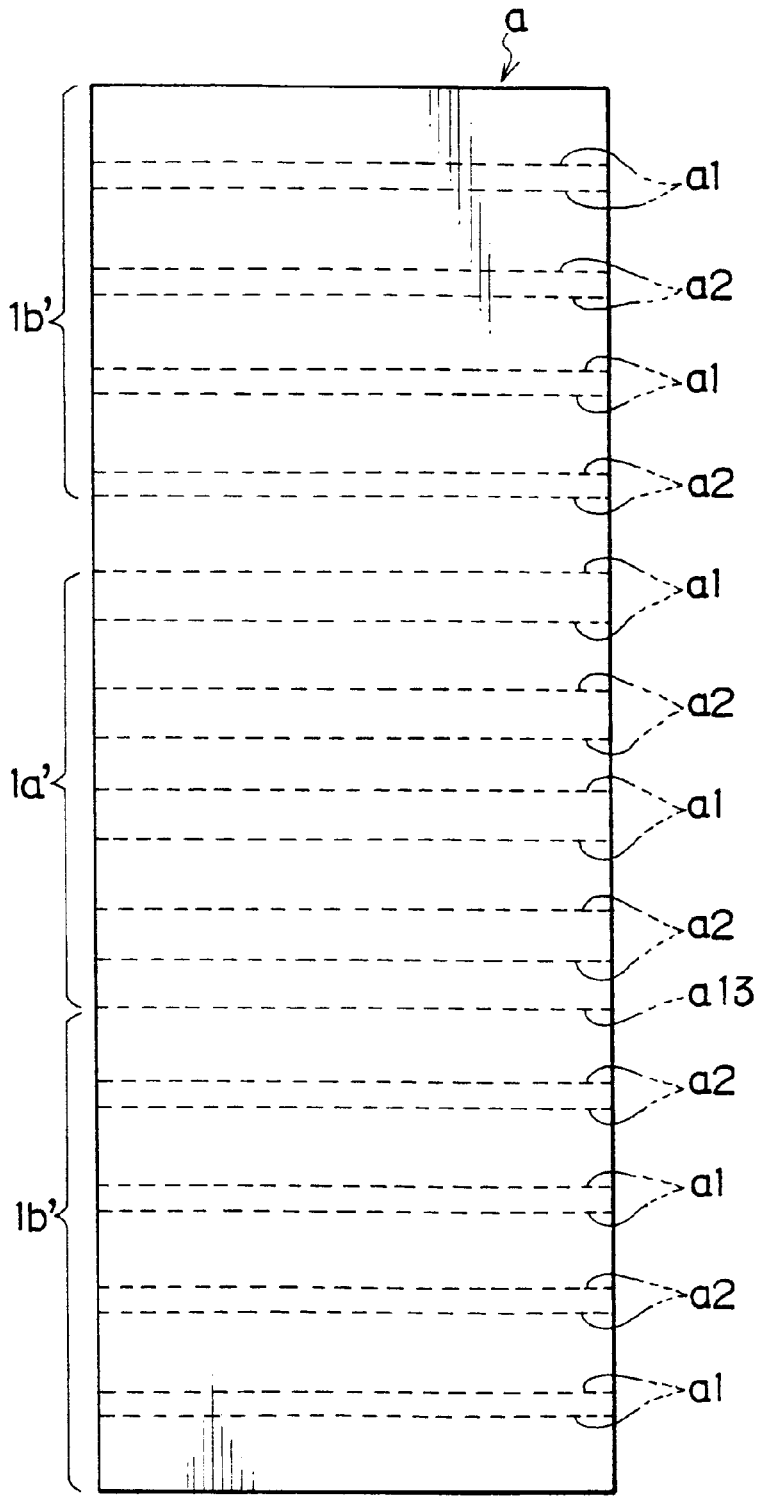
FIG. 22 is a developed plan view of the connected hollow structure of FIG. 20.

The connected hollow structure 1 in the ninth embodiment is fabricated as follows. Firstly, as shown in FIG. 22, while a sheet a of a predetermined width is being delivered, concave folds a1, a1 and convex folds a2, a2 are formed on the sheet a from its leading end so as to extend in the transverse direction of the sheet in an alternate arrangement and in parallel with each other according to the sectional height and base width of the hollow structures 11, 12 of the structures 1*a*, 1*b*.

A fold a13 is formed along the border between a sheet portion 1*a*', which forms the connected bottom structure 1*a* of FIG. 20, and a sheet portion 1*b*', which forms one connected side structure 1*b*. Further, convex folds a2, a2 and concave folds a1, a1 are formed in an alternate arrangement on a sheet portion 1*b*', which forms the other connected side structure 1*b*, and the sheet portions 1*a*', 1*b*'.

The required surface of the sheet a is coated with glue (i.e., an adhesive) along the folds a1, a2.

Subsequently, while the sheet a is being folded along the folds a1, a2 and a13 in sequence to form the hollow structures 11, 12, the edges of the hollow structures 11 adjacent to each other and those of the hollow structures 12 adjacent to each other respectively are bonded together, and the inner surfaces of the structures 1*b*, 1*b* and the edges of both-side upper portions of the hollow structure 1*a* are bonded together. Then, the sheet a is cut as required. Incidentally, the folding of the sheet a starts according to the direction as shown by an arrow d in FIG. 20.

The connected hollow structure 1 in the ninth embodiment is suitable for use as a packaging frame structure, which also serves as a cushioning material for packaging an article by partially inserting such an article into the channel-shaped portion 1*j*.

Alternately, it is possible to form a tray-shaped connected hollow structure as shown in FIG. 18 by fixing other connected structures (not shown) to both ends of the connected hollow structure 1.

The connected hollow structure 1 in the ninth embodiment is designed such that the width of the base of each of the hollow structures 11, 12 in the connected side structures 1*b*, 1*b* having a large sectional height is reduced in inverse proportion to the sectional height, and the hollow structures 11, 12 in the connected side structures 1*b*, 1*b* are formed at a small pitch. Thus, there is not a great difference between withstanding strength against a planar force applied to the connected side structures 1*b*, 1*b* and withstanding strength against a planar force applied to the connected bottom structure 1*a*.

Other respects of the constitution, functions and effects of the connected hollow structure in the ninth embodiment are substantially similar to those of the connected hollow structure in the eighth embodiment, and hence, the description thereof will be omitted.

(Tenth embodiment)

Figure 21:
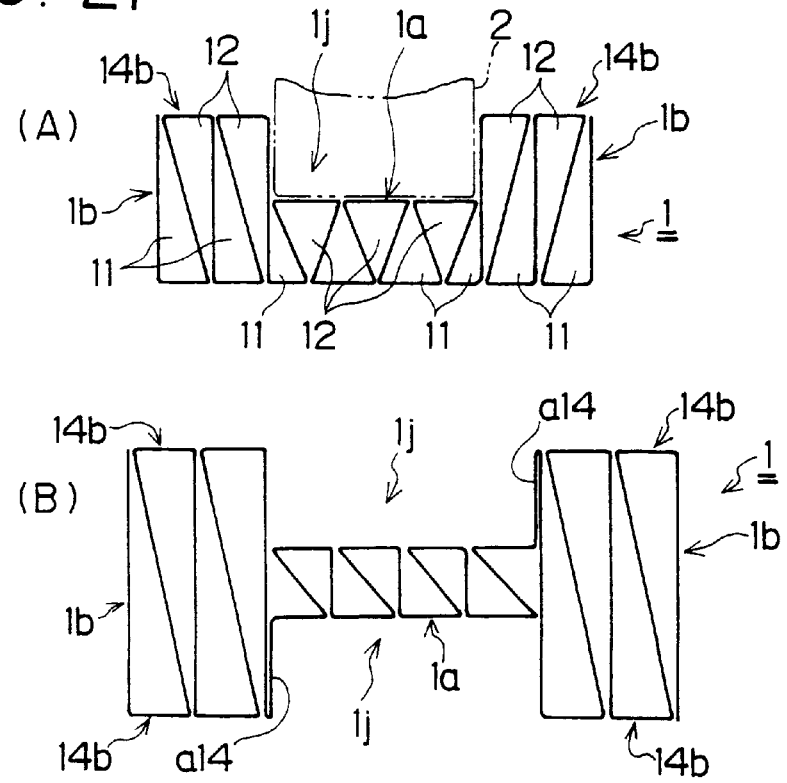
FIG. 21(A) is an end view of a connected hollow structure in a tenth embodiment according to the present invention.
FIG. 21(B) is an end view of a connected hollow structure in an eleventh embodiment according to the present invention.

FIG. 21(A) shows a modification of the connected hollow structure in the ninth embodiment.

A connected hollow structure 1 in a tenth embodiment is substantially similar to the connected hollow structure in the ninth embodiment, except that first hollow structures 11 of a right-angled triangular section in the tenth embodiment are formed at both side portions of a connected bottom structure 1*a*, and hollow structures 11, 12 of an isosceles triangular section in the tenth embodiment are formed at portions other than both side portions of the connected bottom structure 1*a*.

Since the connected bottom structure 1*a* is formed in this manner, it is not necessary to form the fold a13 on the sheet a between the sheet portion 1*a*' and either sheet portion 1*b*' shown in FIG. 22. Thus, no overlap portion 10' of the sheet as shown in FIG. 22 is formed between the connected bottom structure 1*a* and one connected side structure 1*b*, and as a result, a one-fold connected hollow structure is wholly fabricated from a single sheet.

Other respects of the constitution, functions and effects of the connected hollow structure in the tenth embodiment are substantially similar to those of the connected hollow structure in the ninth embodiment, and hence, the description thereof will be omitted.

(Eleventh embodiment)

FIG. 21(B) shows another modification of the connected hollow structure in the ninth embodiment.

A connected hollow structure 1 in an eleventh embodiment is composed of a pair of connected side structures 1*b*, 1*b* having hollow structures 11, 12 higher than those of a connected bottom structure 1*a*, and the connected bottom structure 1*a* formed in the center between the connected side structures in the vertical direction through adjusting sheet portions a14, and channel-shaped portions 1*j*, 1*j* are formed on both upper and lower surfaces of the connected bottom structure 1*a*.

Thus, the upper and lower portions of each connected side structure 1*b* form projections 14*b* projecting from the upper and lower surfaces of the connected bottom structure through a certain difference in level.

Other respects of the constitution, functions and effects of the connected hollow structure 1 in the eleventh embodiment are substantially similar to those of the connected hollow structure in the ninth embodiment, and hence, the description thereof will be omitted.

(Twelfth embodiment)

Figure 23:
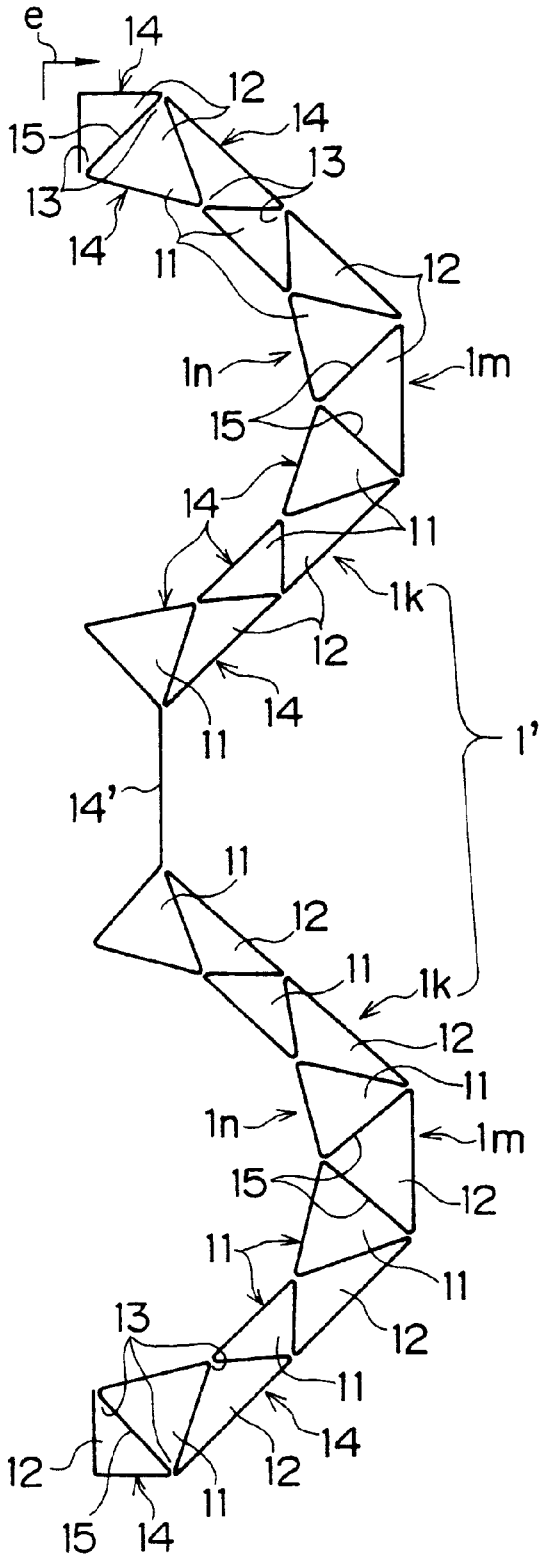
FIG. 23 is a developed side view of a connected hollow structure in a twelfth embodiment according to the present invention before complete development.
Figure 24:
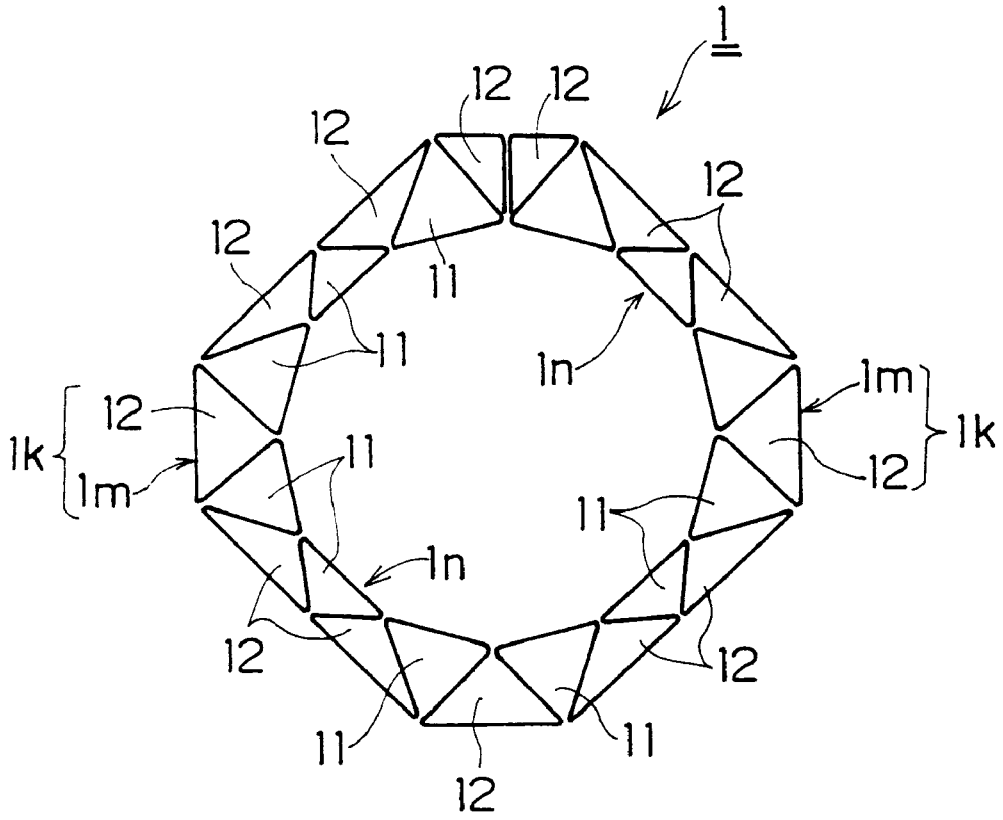
FIG. 24 is a side view of the connected hollow structure of FIG. 23 after completion.

FIGS. 23 and 24 respectively show a connected hollow structure 1 of a twelfth embodiment is composed of two gutter-like connected structures 1*k*, 1*k* each having a substantially smooth right-angled circumference including a longitudinal center formed into a chamfered side surface 1*m*, and an inner surface in of a polygonal section close to a semi-circular shape. The two gutter-like connected structures 1*k*, 1*k* are connected together through a base sheet portion 14' which forms the base surface of one second hollow structure 12 upon completion.

The gutter-like connected structures 1*k* have the same structure and are of the same size, and the first and second hollow structures 11, 12 adjacent to each other as the components of the gutter-like connected structures have a triangular section, and are not similar to each other. The total sum of angles of outward corner portions 13 of the first hollow structures 11 is smaller than that of angles of inward corner portions 13 of the second hollow structures 12. Further, the shape and size of the hollow structures 11, 12 are designed to be fit to form the gutter-like connected structures 1*k* as shown in the drawings.

The second hollow structure 12 positioned on the free end of each gutter-like connected structure 1*k* has a right-angled triangular section such that the inclined side wall 15 of the first hollow structure 11 adjacent to the second hollow structure 12 on the free end forms the inclined side surface of the second hollow structure 12.

The connected hollow structure 1 in the twelfth embodiment is fabricated as follows. Firstly, while a sheet (not shown) of a predetermined width is being delivered, convex folds and concave folds are sequentially formed on the sheet in parallel to each other in a required order at intervals according to the size of the hollow structures 11, 12, and the required surface of the sheet is coated with glue along the folds.

Subsequently, while the sheet is being folded along the folds according to the direction as shown by an arrow e in FIG. 23, the edges of the hollow structures 11 adjacent to each other and those of the hollow structures 12 adjacent to each other are respectively bonded together, and the sheet is cut.

According to the above procedure, the connected hollow structure 1 is formed, in which the hollow structures 11, 12 adjacent to each other have common side walls, which form the border between the hollow structures adjacent to each other and are comprised of a single sheet so as to take the shape resembling a unicursal figure in section, and the sheet as the material of the connected hollow structure is not overlapped on any surfaces of the hollow structures 11, 12.

The connected hollow structure 1 in a semi-developed state as shown in FIG. 23 is used for displaying bottles or like cylindrical articles by placing such articles on the inner surfaces in.

Otherwise, in case of packaging bottles or like articles having a cylindrical portion, a cylindrical connected hollow structure 1 is formed by guiding such articles to be packaged to the inside of either gutter-like connected structure 1*k*, and then fitting the gutter-like connected structures 1*k*, 1*k* face to face with each other such that the inside edges of the first hollow structures 11, 11 adjacent to the center base sheet portion 14' are brought face to face with each other, and the second hollow structures 12, 12 on the free ends of the gutter-like connected structures 1*k*, 1*k* are brought face to face with each other so as to form a second hollow structure 12 of a rectangular equilateral triangular section in the confronting portion of the first hollow structures. Then, the connected hollow structure 1 in this state is packed in a rectangular parallel piped box (not shown).

The connected hollow structure 1 in the twelfth embodiment takes the shape of a truss in section on the whole, and therefore, enables sufficient protection of packaged articles, since, even when an external force is suddenly applied to a portion of the circumference in the state as shown in FIG. 24, the side walls 15 common to the hollow structures 11, 12 are bent and absorb such an external force.

Further, the connected hollow structure 1 takes the shape of a truss in section on the whole, and therefore, shows high withstanding strength even in case of using a thin sheet as the material of the connected hollow structure.

Furthermore, the connected hollow structure 1 in this embodiment has an appearance of a substantially quadrangular section, and therefore, is suitably used for packaging one or a plurality of bottles or like articles having a cylindrical portion at a time.

According to the connected hollow structure 1 in this embodiment, the gutter-like connected structures 1*k*, 1*k* may be separated from each other.

Other respects of the constitution, functions and effects of the connected hollow structure in the twelfth embodiment are substantially similar to those of the connected hollow structure in the first embodiment, and hence, the description thereof will be omitted.

(Thirteenth embodiment)

Figure 25:
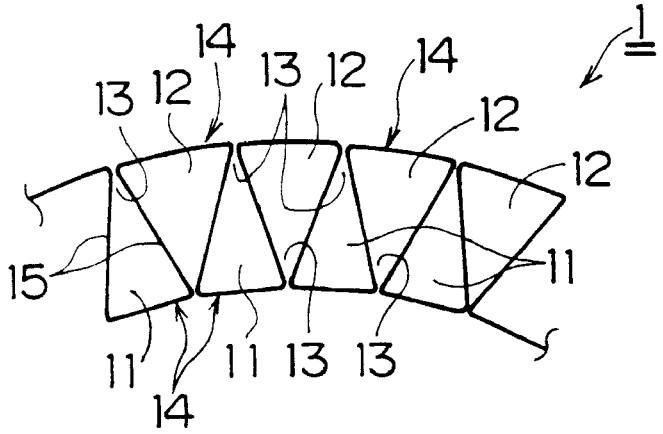
FIG. 25 is a fragmentary side view of a connected hollow structure in a thirteenth embodiment according to the present invention.

FIG. 25 partially shows a connected hollow structure 1 of a thirteenth embodiment which is formed such that first hollow structures 11 of an isosceles triangular section and second hollow structures of an isosceles triangular section, which is equal in height to and wider in base (i.e., partial circumferences 14) than the first hollow structures 11 (i.e., a corner portion 13 of each second hollow structure 12 is larger than that of each first hollow structure 11) are alternately arranged in alternately inverted positions.

Thus, a cylindrical connected hollow structure or a connected hollow structure of a circular-arc section, in which the bottoms of the first hollow structures 11 form the inner surface, is formed by continuously arranging the hollow structures 11, 12.

The sides (edges) of the partial circumferences 14 of the hollow structures 11 adjacent to each other and the sides of the partial circumferences 14 of the hollow structures 12 adjacent to each other are respectively connected together by bonding, and the hollow structures 11, 12 adjacent to each other have the inclined side walls 15 in common.

The connected hollow structure 1 in the thirteenth embodiment in case of having a cylindrical shape is used as a frame structure for packaging and protecting bottles or like articles having a cylindrical or cylindroid portion.

On the other hand, the connected hollow structure 1 in the thirteenth embodiment in case of having a circular gutter-like shape is used as a frame structure for displaying bottles or like articles having a cylindrical or cylindroid portion by placing such articles on the circular-arc inner portion. In addition, a combination of two connected hollow structures 1 is suitable for use as a frame structure for packaging and protecting such articles.

The connected hollow structure 1 in this embodiment shows high withstanding strength against an external force applied in the circumferential direction, and also functions as a cushion, since, when a sudden external force is partially applied in the circumferential direction, the inclined side walls 15 are bent and absorb such an external force.

Other respects of the functions and effects of the connected hollow structure in the thirteenth embodiment are substantially similar to those of the connected hollow structure in the twelfth embodiment, and hence, the description thereof will be omitted.

(Fourteenth embodiment)

Figure 26:
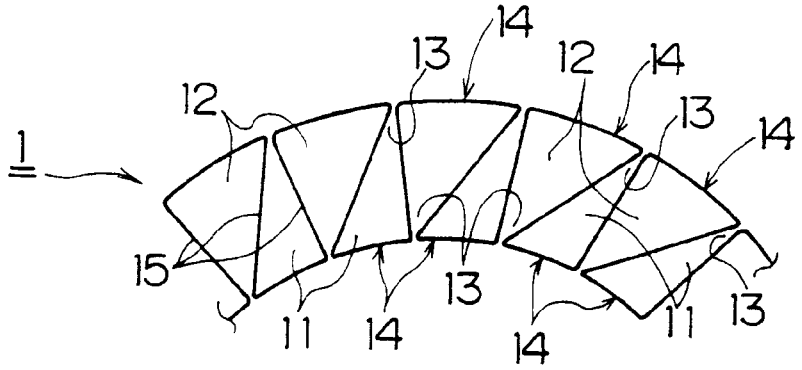
FIG. 26 is a fragmentary side view of a connected hollow structure in a fourteenth embodiment according to the present invention.

FIG. 26 partially shows a connected hollow structure 1 of a fourteenth embodiment which is composed of first and second hollow structures 11, 12 of a triangular section close to a right-angled triangular shape, and the first and second hollow structures 11, 12 are designed to have the same shape and be of the same size.

The width of the partial circumference (i.e., an angle of a corner portion 13) of each hollow structure 11 is designed to be smaller than that of the partial circumference 14 (i.e., an angle of a corner portion 13) of each hollow structure 12. The partial circumferences 14 of the hollow structures 11 form a slightly-concave circular-arc surface, and the partial circumferences 14 of the hollow structures 12 form a slightly-convex circular-arc surface.

The connected hollow structure 1 in this embodiment, in the case of a cylindrical or circular gutter-like overall shape, has an inner surface of a substantially-cylindrical or circular-arc shape. Thus, when the connected hollow structure 1 in this embodiment is used for packaging bottles or like articles having a cylindrical or cylindroid portion, the inner surface of this connected hollow structure 1 sufficiently fits the external shape of such articles to be packaged.

In comparison with the connected hollow structure 1 in the thirteenth embodiment, the connected hollow structure 1 in the fourteenth embodiment shows slightly lower withstanding strength against an external force in the circumferential direction, while it shows more flexible elasticity.

Other respects of the constitution, functions and effects of the connected hollow structure 1 in the fourteenth embodiment are substantially similar to those of the connected hollow structure in the thirteenth embodiment, and hence, the description thereof will be omitted.

(Fifteenth embodiment)

Figure 27:
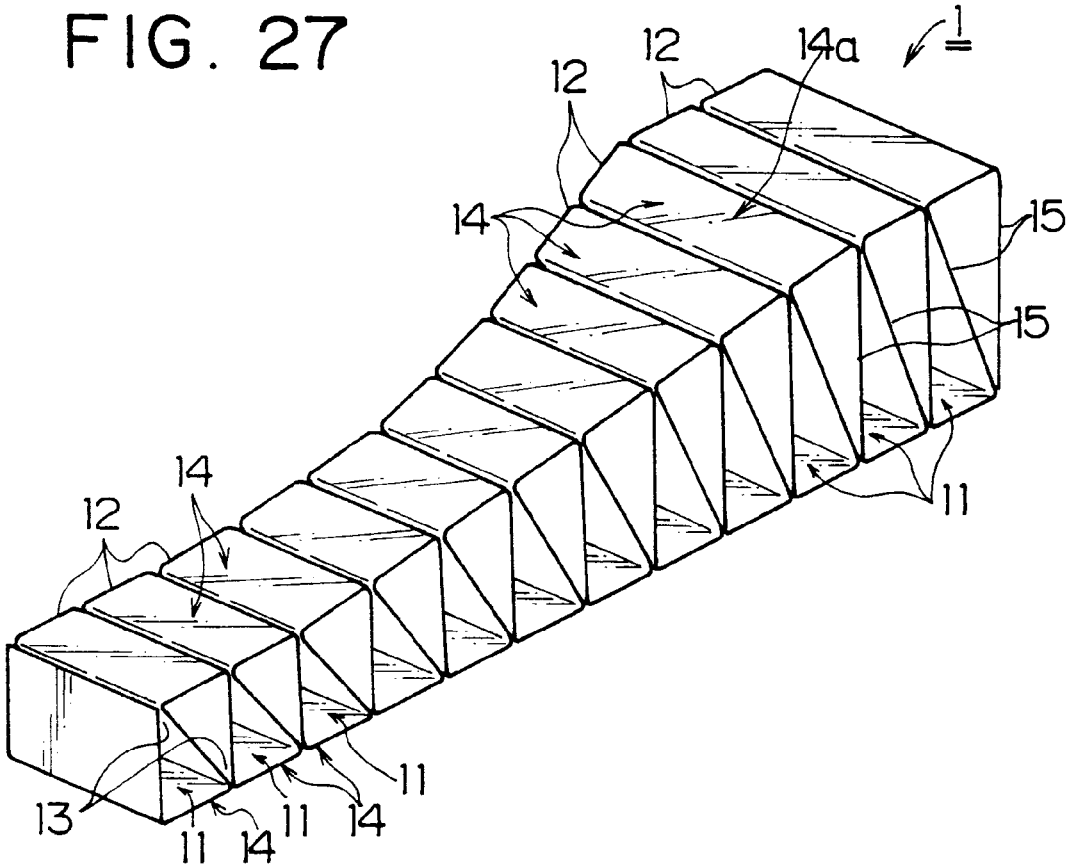
FIG. 27 is a perspective view of a connected hollow structure in a fifteenth embodiment of the present invention.

FIG. 27 shows a connected hollow structure in a fifteenth embodiment according to the present invention wherein the connected hollow structure 1 is formed by folding a single sheet along concave folds and convex folds formed on the sheet so as to extend in the transverse direction of the sheet in parallel to each other. First hollow structures 11 of a right-angled triangular section and different in height, and second hollow structures 12 including hollow structures of a right-angled triangular section and those of a section other than a right-angled triangular section are alternately arranged in an alternately inverted positions, and connected together by bonding.

The connected hollow structure 1 has a substantially smooth lower surface formed by connecting the partial circumferences 14 of the first hollow structures 11, while its upper surface formed by connecting the partial circumferences 14 of the second hollow structures 12 has a rising portion 14*a* gradually rising from one end to the other so as to fit the shape of an article (not shown) to be packaged.

The connected hollow structure 1 in this embodiment varies in withstanding strength against a planar force applied to each portion, since each first hollow structures 11 has a substantially uniform base width (i.e., the width of the partial circumference 14), and the height of the first hollow structure 11 gradually varies. When the connected hollow pressure 1 is exposed to a planar force of not less than a predetermined value, the vertical side walls 15 common to the adjacent first and second hollow structures 11, 12 are bent and absorb such a pressure.

The connected hollow structure 1 in this embodiment is suitable for use as a support table for an article having a bottom fit to the shape of the upper surface of the connected hollow structure 1, or a frame structure for packaging such an article.

Other respects of the constitution, functions and effects of the connected hollow structure in the fifteenth embodiment are substantially similar to those of the connected hollow structure in the first embodiment, and hence, the description thereof will be omitted.

(Sixteenth embodiment)

Figure 28:
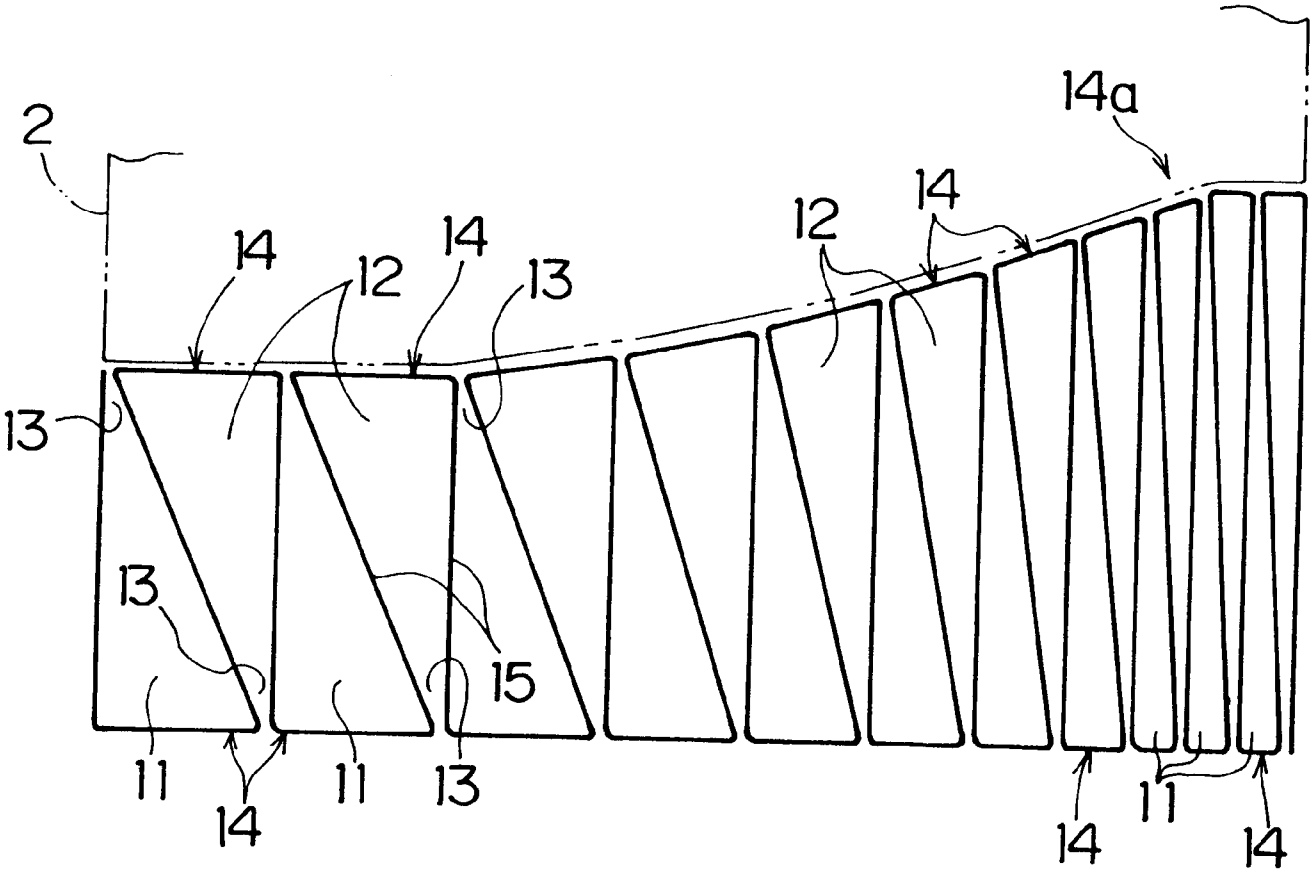
FIG. 28 is a perspective view of a connected hollow structure in a sixteenth embodiment of the present invention.

FIG. 28 shows a connected hollow structure of a sixteenth embodiment according to the present invention wherein the connected hollow structure 1 is formed, substantially similarly to the connected hollow structure 1 in the fifteenth embodiment, such that its upper surface formed by connecting the partial circumferences 14 of second hollow structures 12 has a rising portion 14*a* gradually rising from one end to the other so as to substantially fit the shape of the bottom of an article to be packaged.

On the other hand, the connected hollow structure 1 in the sixteenth embodiment is different from the connected hollow structure in the fifteenth embodiment in that a pitch of the hollow structures 11, 12 formed in the rising portion 14*a* (i.e., the width of the partial circumferences 14 forming the bottom of the hollow structures 11) is made smaller in proportion to the scale of rising.

According to the connected hollow structure 1 in this embodiment, since the pitch of the hollow structures 11, 12 is made smaller in proportion to the scale of rising on the upper surface as described above, withstanding strength against a planar force is easily made uniform in each portion of the connected hollow structure 1.

Other respects of the constitution, functions and effects of the connected hollow structure 1 in the sixteenth embodiment are substantially similar to those of the connected hollow structure in the fifteenth embodiment, and hence, the description thereof will be omitted.

(Seventeenth embodiment)

Figure 29:
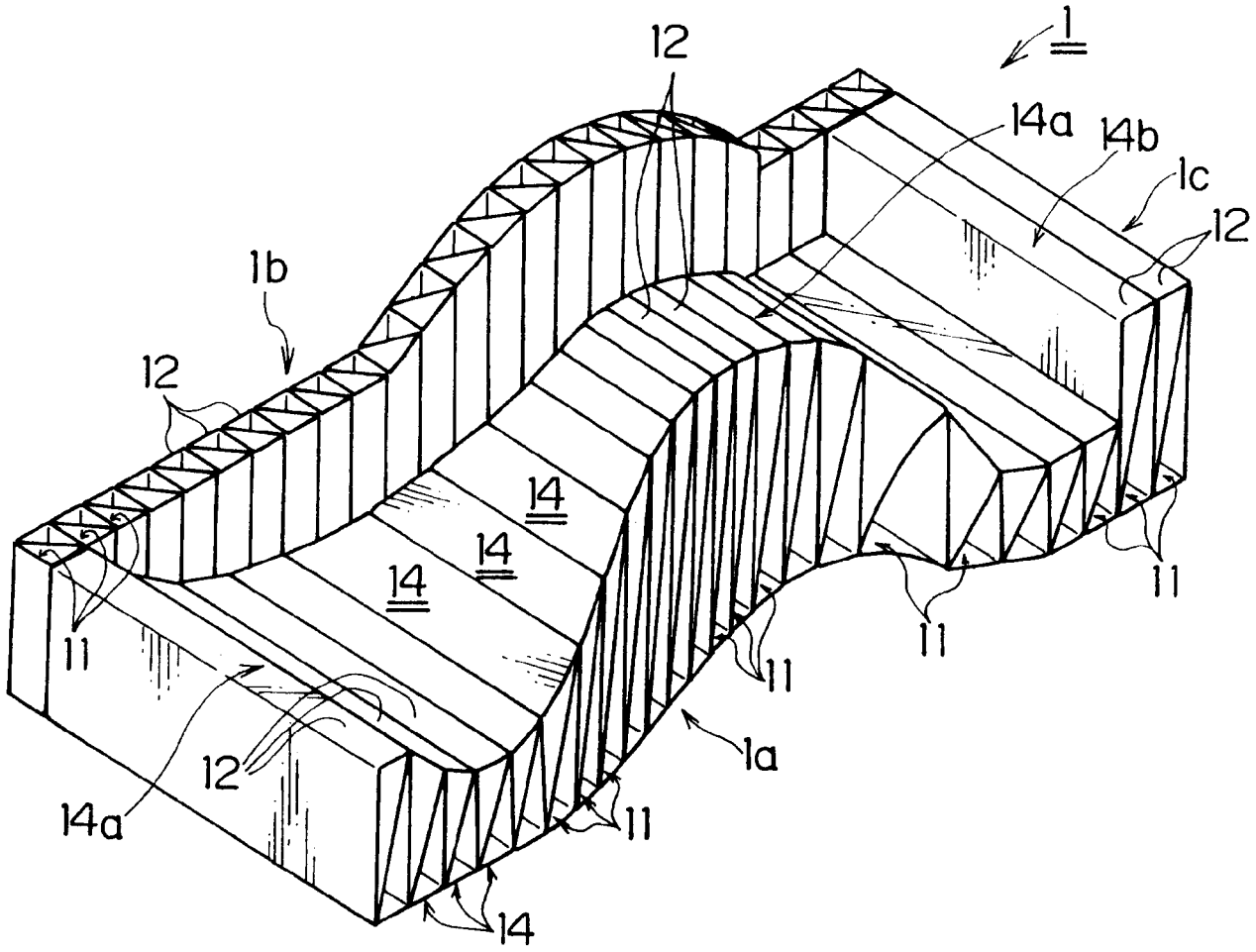
FIG. 29 is a perspective view of a connected hollow structure in a seventeenth embodiment according present invention.

FIG. 29 shows a connected hollow structure in a seventeenth embodiment according to the present invention wherein the connected hollow structure 1, is composed of a connected bottom structure 1*a*, a connected side structure 1*b* uprightly placed on one side of the connected bottom structure 1*a*, and a connected rear structure 1*c* uprightly placed on the rear of the connected bottom structure 1*a*.

The connected bottom structure 1*a* and the connected rear structure 1*c* are formed as one body, and the upper surface of the connected rear structure 1*c* has a projection 14*b* projecting from the upper surface of the end of the connected bottom structure 1*a* through a difference in level.

The connected side structure 1*b* is formed separately from the connected bottom structure 1*a*, and then bonded to one side of the connected bottom structure 1*a*.

The connected bottom, side and rear structures 1*a*, 1*b*, 1*c* are formed by alternately arranging their first and second hollow structures 11, 12 of a triangular section in alternately inverted positions, and then connecting these hollow structures together.

The upper surface of the connected bottom structure 1*a* is formed by connecting the partial circumferences 14, which form the upper surface of the second hollow structures 12, together, and has front and center rising portions 14*a* gradually rising from portions other than the front and center portions. A pitch of the hollow structures 11, 12 formed in these rising portions 14*a* is made small.

The connected bottom structure 1*a* has a smooth bottom and a narrow center portion.

The connected side structure 1*b* has a center rising portion on its upper surface portion other than the left and right ends in the drawing so as to extend substantially in parallel to the rising portion 14*a*.

The hollow structures 11, 12 included in the connected rear structure 1*c* are higher than those included in the connected bottom structure 1*a* adjacent to the connected side structure 1*c*.

The connected hollow structure 1 in this embodiment has a special inner shape defined by the connected bottom structure 1*a*, the connected side structure 1*b* and the connected rear structure 1*c*, and therefore, is suitable for use as a corner protection frame for protecting an article (not shown) partially having a corner portion fit for the inner surface shape of the connected hollow structure by bringing such a corner portion of the article into contact with the inner surface of the connected hollow structure.

Since the pitch of the hollow structures 11, 12 formed in the rising portion 14*a* of the connected bottom structure 1*a* is made smaller in proportion to the scale of rising, there is no great difference in withstanding strength against a planar force received by each portion of the connected bottom structure 1*a*.

Other respects of the constitution, functions and effects of the connected hollow structure 1 in the seventeenth embodiment are substantially similar to those of the connected hollow structure in the fifth embodiment, and hence, the description thereof will be omitted.

(Eighteenth embodiment)

Figure 30:
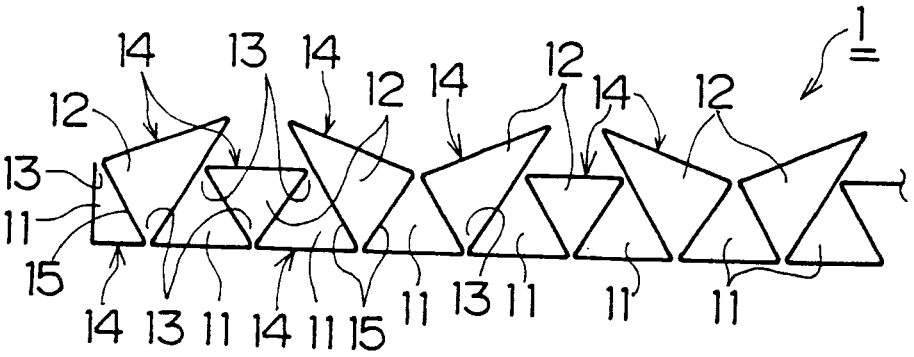
FIG. 30 is a fragmentary end view of a connected hollow structure in an eighteenth embodiment according present invention.

FIG. 30 shows a connected hollow structure in an eighteenth embodiment according to the present invention wherein the connected hollow structure 1 is formed such that first hollow structures 11 have a triangular section including a corner portion 13 directed upwards and a partial circumference 14 forming a base and facing the lower surface, and second hollow structures 12 of a triangular section including a corner portion 13 directed downwards and a partial circumference facing the upper surface are alternately arranged, and is comprised of a single sheet as a whole so as to take the shape resembling a unicursal figure in section.

The first hollow structures 11 have an isosceles triangular section and are of the same size, while the second hollow structures 11 include hollow structures of an isosceles triangular section and those of a right-angled triangular section in the ratio of 1:2. The second hollow structures 12 are formed in an alternate arrangement such that the second hollow structures 12, 12 of the right-angled triangular section are placed in a reverse position next to the second hollow structure of the isosceles triangular section.

The partial circumferences 14 on the upper side of the second hollow structures 12 of the right-angled triangular section adjacent to each other are inclined in the reverse direction substantially in the shape of a letter V, and the partial circumferences 14 of the second hollow structures 12 of the right-angled triangular section partially project so as to overhang the adjacent second hollow structure 12 of the isosceles triangular section.

The first hollow structures 11, 11 adjacent to each other are connected together by bonding in a portion of the corner portion 13 of each second hollow structure 12 positioned between the first hollow structures adjacent to each other, and the second hollow structures 12, 12 adjacent to each other are connected together by bonding in a portion of the corner portion 13 of each first hollow structure 11 positioned between the second hollow structures adjacent to each other.

The partial circumferences 14 of the first hollow structures 11 are connected together to form a smooth lower surface of the connected hollow structure, while the partial circumference 14 of the second hollow structure of the right-angled triangular section and that of the adjacent second hollow structure of the isosceles triangular section are not connected together.

The first hollow structure 11 and the adjacent second hollow structure 12 of the isosceles triangular section, and the first hollow structure 11 and the adjacent second hollow structures 12, 12 of the right-angled triangular section on both sides of the first hollow structure respectively have all the side walls 15 in common. On the other hand, the second hollow structure 12 of the right-angled triangular section and the adjacent first hollow structure 11 on one side of the second hollow structure merely partially have the side walls between both the hollow structures in common as viewed from the side of the second hollow structures 12.

The connected hollow structure 1 in this embodiment is formed as described above, and therefore, shows relatively low withstanding strength against a planar force, while it shows flexible elasticity on the whole, since, when the connected hollow structure 1 receives a planar force of not less than a certain extent, the second hollow structures 12 of the right-angled triangular section overhanging the second hollow structures 12 of the isosceles triangular section are partly bent.

Then, the second hollow structures 12 of the right-angled triangular section overhanging the second hollow structures 12 of the isosceles triangular section become partly unable to withstand a load, and as a result, are collapsed, and the collapsed portion is overlapped on the horizontal part 14 of the second hollow structures 12 of the isosceles triangular section. At this time, since the second hollow structures 12 of the right-angled triangular section are transformed into an isosceles triangular section of a size similar to that of the other second hollow structures 12, the connected hollow structure 1 after transformation shows high withstanding strength against a planar force, similarly to the connected hollow structure in the first embodiment, for instance.

Namely, at an initial stage of the application of a planar force to the connected hollow structure 1, the second hollow structures 12 of the right-angled triangular section are transformed and absorb such the planar force. At a stage of the application of a far higher planar force, the side walls of the hollow structures 11, 12 adjacent to each other are bent and absorb such a planar force. In this manner, the connected hollow structure 1 in this embodiment functions as a cushion in two stages.

Thus, the connected hollow structure 1 in this embodiment is suitable for use as a packaging member which needs the cushioning properties in two stages.

Other respects of the constitution, functions and effects of the connected hollow structure 1 in the eighteenth embodiment are substantially similar to those of the connected hollow structure in the first embodiment, and hence, the description thereof will be omitted.

(Nineteenth embodiment)

Figure 31:
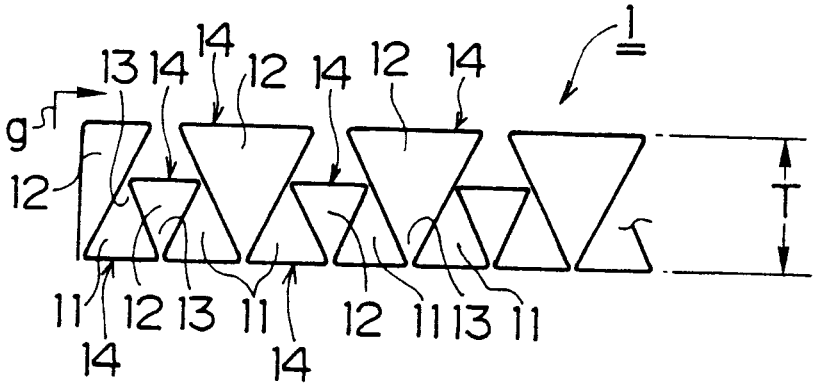
FIG. 31 is a fragmentary end view of a connected hollow structure in a nineteenth embodiment according to the present invention.

FIG. 31 shows a connected hollow structure 1 of a nineteenth embodiment which is formed such that first and second hollow structures 11, 12 of an isosceles triangular section and of the same size are densely and alternately arranged in alternately inverted positions, namely, such that the first, second and first hollow structures 11, 12, 11 are arranged in this order in alternately inverted positions, and another second hollow structure, which is equal in a sectional shape to and is larger in sectional size than the first hollow structures, is arranged next to a group of these small-sized hollow structures in an inverse position.

The first hollow structures 11 adjacent to each other are connected together by bonding at a portion of the corner portion 13 of each second hollow structure 12 positioned between the first hollow structures 11 adjacent to each other, and the second hollow structures 12 adjacent to each other are connected together by bonding in a portion of the corner portion 13 of each first hollow structure 11 positioned between the second hollow structures 12 adjacent to each other.

The partial circumferences 14 of the first hollow structures 11 are connected together to form a smooth plane, while the partial circumferences 14 of the second hollow structures 12 are not connected together.

The second hollow structures 12 positioned at opposing ends of the connected hollow structure 1 have the sectional shape of a right-angled triangle equivalent to the half of the sectional shape of the large-sized hollow structure 12.

The first hollow structures 11 and the small-sized second hollow structures 12 share in common all the side walls between the first and second hollow structures adjacent to each other, while the first hollow structures 11 and the large-sized second hollow structures 12 partly share in common the side walls between the first and second hollow structures adjacent to each other.

The connected hollow structure 1 in the nineteenth embodiment is fabricated as follows. Firstly, predetermined convex folds and concave folds are formed on a sheet (not shown) of a predetermined width so as to extend in the transverse direction of the sheet, and the folding of the sheet starts from the leading end of the sheet according to the direction as shown by an arrow g in FIG. 31 to form the hollow structures.

Namely, the hollow structures 12 and 11 are formed in alternately inverted positions by folding the sheet according to the direction as shown by the arrow g in FIG. 31.

At this time, the first hollow structures 11 are bonded together in a portion of the corner portion of each second hollow structure 12 positioned between the first hollow structures adjacent to each other, and the large-sized second hollow structures 12 and the small-sized second hollow structures 12 are bonded together such that one side of the partial circumference 14 of each small-sized hollow structure is bonded to a portion of the side wall 15 of each large-sized second hollow structure.

The connected hollow structure 1 formed as described above takes the shape resembling a unicursal figure in section, and has no sheet overlap portion other than the bonded portions, and therefore, its apparent specific gravity is extremely small.

Although the connected hollow structure 1 in this embodiment has a panel-like shape of substantially uniform apparent thickness T, it shows more flexible elasticity against a planar force than that of the connected hollow structure in the first embodiment, since the partial circumferences 14 of the large-sized second hollow structures 12 project upwards from the partial circumferences 14 of the small-sized second hollow structures 12.

Other respects of the functions and effects of the connected hollow structure 1 in the nineteenth embodiment are substantially similar to those of the connected hollow structure in the first embodiment, and hence, the description thereof will be omitted.

(Twentieth embodiment)

Figure 32:
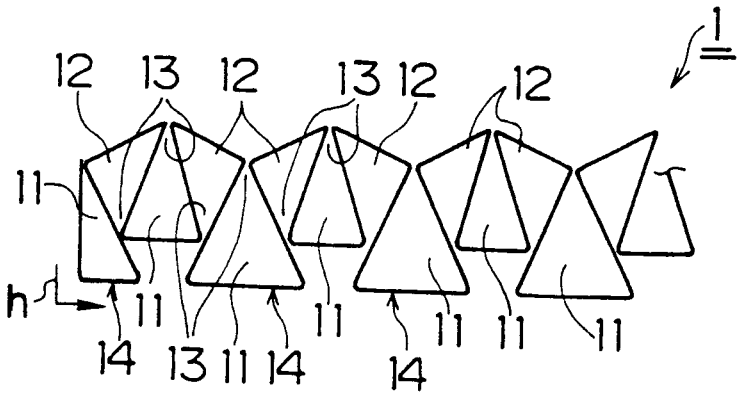
FIG. 32 is a fragmentary end view of a connected hollow structure in a twentieth embodiment according to the present invention.

FIG. 32 shows a connected hollow structure in a twentieth embodiment according to the present invention wherein the connected hollow structure is formed such that first hollow structures 11 of an isosceles triangular section, second hollow structures 12 of an isosceles triangular section including a base surface in common with the inclined surfaces of the first hollow structures 11, large-sized first hollow structures 11 of an isosceles triangular section substantially equal in sectional height to and larger in base width than the first hollow structures, and other second hollow structures 12 equal in sectional shape and size to the aforementioned second hollow structures 12 and reversed to each other are alternately arranged in this order in an alternately inverted positions.

The first hollow structure 11 positioned at each end of the connected hollow structure 1 has a right-angled triangular section.

Both sides of the partial circumference 14 of each first hollow structure 11 having a narrow base (i.e., partial circumference 14) are bonded to portions of the inclined sides of the first hollow structures 11 having a wide base, and the partial circumferences of the first hollow structures having the wide base project downward from the bottom of the first hollow structures having the narrow base.

The connected hollow structure 1 has a corrugated upper surface, although the upper surface of the connected hollow structure 1 is formed by connecting the partial circumferences 14 of the second hollow structures 12 together.

The connected hollow structure 1 in the twentieth embodiment is fabricated as follows. Firstly, predetermined convex folds and concave folds are formed on a sheet (not shown) of a predetermined width so as to extend in the transverse direction of the sheet, and the folding of the sheet starts from the leading end of the sheet according to the direction as shown by an arrow h in FIG. 32 to form the hollow structures.

Namely, the connected hollow structure 1 is fabricated by sequentially bonding the edges of the first hollow structures 11 and those of the second hollow structures 12, together while folding the sheet so as to form the first and second hollow structures 11, 12 in an alternate arrangement according to the direction as shown by the arrow h in FIG. 32.

The connected hollow structure 1 formed as described above takes the shape resembling a unicursal figure in section. In addition, the surfaces of the hollow structures 11, 12 have no sheet overlap portion other than the bonded portions, and the whole apparent specific gravity of the connected hollow structure 1 is extremely small.

In comparison with the connected hollow structure of the first embodiment, the connected hollow structure 1 in the twentieth embodiment shows lower withstanding strength against a planar force, while it shows more flexible elasticity.

Other respects of the constitution, functions and effects of the connected hollow structure 1 in the twentieth embodiment are substantially similar to those of the connected hollow structure in the nineteenth embodiment, and hence, the description thereof will be omitted.

(Twenty-first embodiment)

Figure 33:
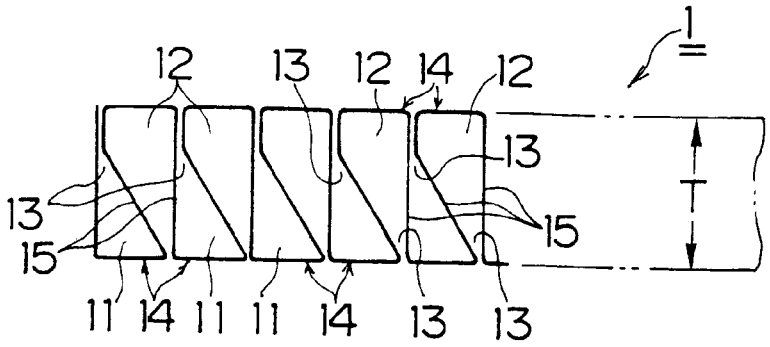
FIG. 33 is a fragmentary end view of a connected hollow structure in a twenty-first embodiment according to the present invention.

FIG. 33 partially shows a connected hollow structure 1 of a twenty-first embodiment which is formed such that first hollow structures of a right-angled triangular section and of the same size, and second hollow structures 12 of a quadrangular section and of the same size are arranged alternately and densely. Each second hollow structure 12 has a sectional shape including two right-angled portions and an inclined side wall, and its section takes the special shape.

Each first hollow structure 11 is formed such that an acute-angled corner portion 13 is directed toward the upper surface, and a partial circumference 14 forming a base faces the lower surface. Each second hollow structure 12 is formed such that an acute-angled corner portion 13 is directed toward the lower surface, and a partial circumference 14 between the right-angled corner portions on both sides faces the upper surface.

The partial circumferences 14 of the first hollow structures 11 adjacent to each other are bonded together in a portion of the corner portion 13 of each second hollow structure 12 positioned between the adjacent first hollow structures adjacent to each other, and the partial circumferences 14 of the second hollow structures 12 adjacent to each other are bonded together.

The vertical side walls of the second hollow structures 12 adjacent to each other are overlapped with each other in upper end portions of the second hollow structures so as to extend from the corner portions 13 of the first hollow structures 11 toward the upper ends of the second hollow structures. The sheet forming the connected hollow structure is bonded in an overlap state in the upper end portions of the second hollow structures.

The connected hollow structure 1 in the twenty-first embodiment is fabricated as follows. Firstly, while a sheet (not shown) is being delivered, convex folds and concave folds are formed on the sheet so as to extend in the transverse direction of the sheet according to the sectional shape of the hollow structures 11, 12, and the required surface of the sheet 1 is sequentially coated with glue along the folds.

Subsequently, while the sheet is being folded along the folds, the required portions of the sheet are bonded together to sequentially form the first and second hollow structures 11, 12 in an alternating arrangement. After the connected hollow structure 1 of the size meeting the design has been fabricated, the sheet is cut. Incidentally, the sheet may be cut in advance depending on the design.

The connected hollow structure 1 formed as described above is comprised of a single sheet and takes the shape resembling a unicursal figure in section.

In comparison with the connected hollow structure 1 in the first embodiment, the apparent specific gravity of the connected hollow structure 1 in the twenty-first embodiment becomes slightly smaller, whereas the hollow structures 11, 12 of the connected hollow structure in this embodiment are connected together more firmly, since the connected hollow structure in this embodiment has sheet overlap portions, scanty as they are.

When the connected hollow structure 1 receives a planar force of not less than a predetermined value, the vertical side walls 15 and inclined side walls 15 common to the hollow structures 11, 12 are bent, and therefore show elasticity in some degree to make it possible to absorb such a force.

Other respects of the constitution, purposes, functions and effects of the connected~hollow structure 1 in the twenty-first embodiment are substantially similar to those of the connected hollow structure in the first embodiment, and hence, the description thereof will be omitted.

(Twenty-second embodiment)

Figure 34:
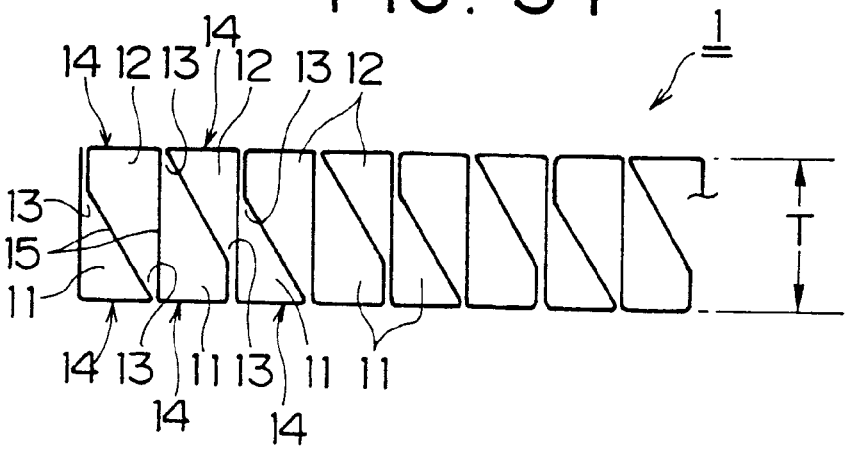
FIG. 34 is a fragmentary end view of a connected hollow structure in a twenty-second embodiment according to the present invention.

FIG. 34 shows a connected hollow structure 1 in a twenty-second embodiment which is formed such that first hollow structures 11 of a right-angled triangular section, second hollow structures 12 of a quadrangular (special) section, other first hollow structures 11 of a quadrangular section, and other second hollow structures 12 of a right-angled triangular section are alternately arranged in this order.

Each first hollow structure 11 is formed such that an acute-angled corner portion 13 is directed toward the upper surface, and a horizontal partial circumference 14 faces the lower surface. Each second hollow structure 12 is formed such that an acute-angled corner portion 13 is directed toward the lower surface, and a horizontal partial circumference 14 faces the upper surface.

The sides of the partial circumferences 14 of the first hollow structures 11 adjacent to each other are connected together by bonding, and the sides of the partial circumferences 14 of the second hollow structures 12 adjacent to each other are connected together by bonding. The connected hollow structure I has a panel-like shape to give upper and lower smooth surfaces and to be substantially uniform in apparent thickness T, and takes a shape resembling a unicursal figure in section.

A lower portion of each first hollow structure 11 of the quadrangular section is bonded to a lower portion of each adjacent first hollow structure 11 of the right-angled triangular section in a partially-overlapped state, and an upper portion of each second hollow structure 12 of the quadrangular section is bonded to an upper portion of each adjacent first hollow structure 11 of the right-angled triangular section in a partially overlapped state.

The fabricating method, and other respects of the constitution, functions and effects of the connected hollow structure in the twenty-second embodiment are substantially similar to those of the connected hollow structure in the twenty-first embodiment, and hence, the description thereof will be omitted.

(Twenty-third embodiment)

Figure 35:
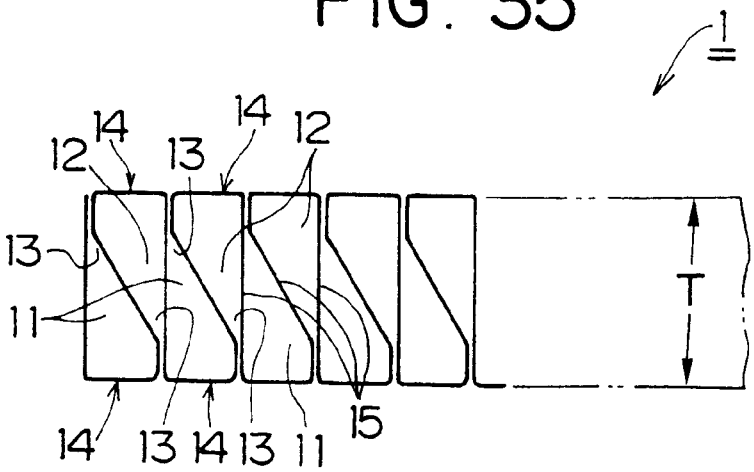
FIG. 35 is a fragmentary end view of a connected hollow structure in a twenty-third embodiment according to the present invention.

FIG. 35 shows aa connected hollow structure 1 in a twenty-third embodiment which is formed such that first hollow structures 11 of a quadrangular (special) section and of the same size and second follow structures equal in shape and size to the first hollow structures 11 are arranged alternately.

Each first hollow structure 11 is formed such that an acute-angled corner portion 13 is directed toward the upper surface, and a horizontal partial circumference 14 faces the lower surface. Each second hollow structure 12 is formed such that an acute-angled corner portion 13 is directed toward the lower surface and a horizontal partial circumference 14 faces the upper surface.

The sides of the partial circumferences 14 of the first hollow structures 11 adjacent to each other are connected together by bonding, and the sides of the partial circumferences 14 of the second hollow structures 12 adjacent to each other are connected together by bonding. Then, the connected hollow structure 1 has a panel-like shape with upper and lower smooth surfaces, is substantially uniform in apparent thickness T, and takes a shape resembling a unicursal figure in section.

The first hollow structures 11 adjacent to each other and the second hollow structures 12 adjacent to each other are respectively bonded together in a partially-overlapped state in portions of the vertical side walls 15.

The fabricating method and other respects of the constitution, functions and effects of the connected hollow structure in the twenty-third embodiment are substantially similar to those of the connected hollow structure in the twenty-first embodiment, and hence, the description thereof will be omitted.

(Twenty-fourth embodiment)

Figure 36:
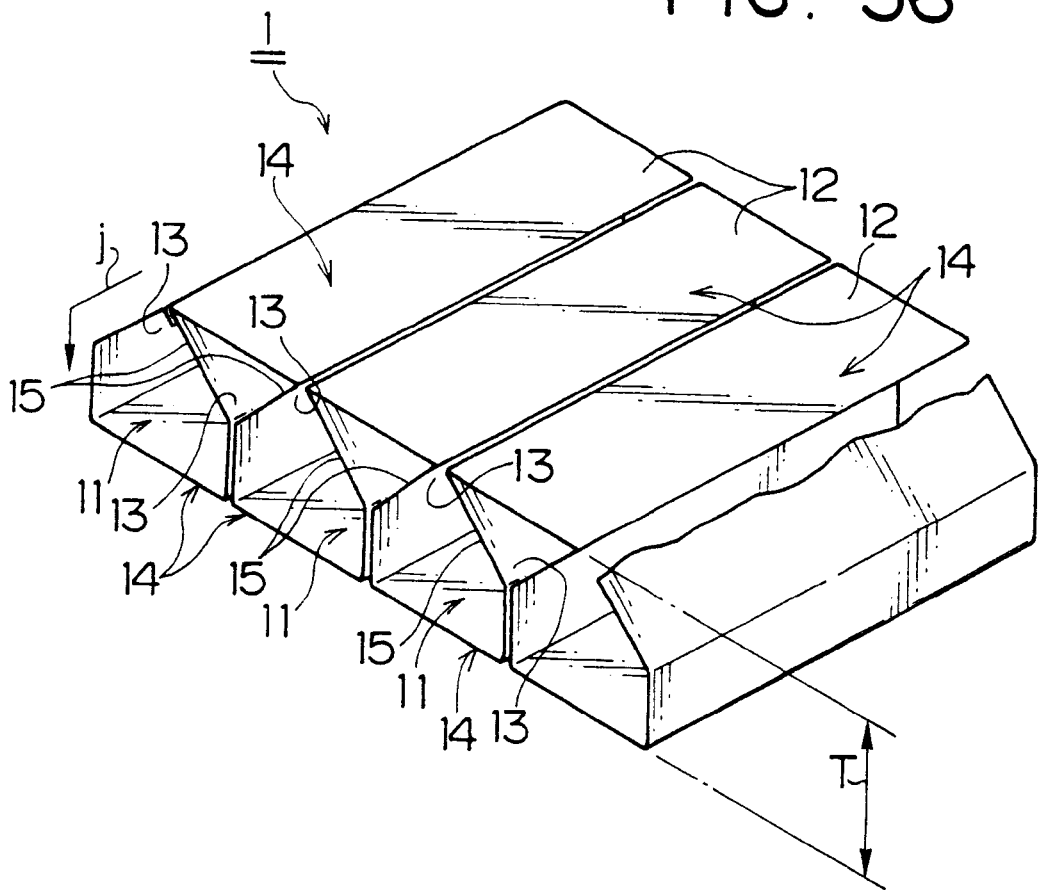
FIG. 36 is a fragmentary perspective view of a connected hollow structure in a twenty-fourth embodiment according to the present invention.

FIG. 36 partially shows a connected hollow structure 1 in a twenty-fourth embodiment is composed of a large number of laterally arranged first hollow structures 11 of a pentagonal section and of the same size, and a large number of second hollow structures 12 of an isosceles triangular section and of the same size.

Each first hollow structure 11 is formed such that an upper corner portion 13 is directed toward the upper surface, and a partial circumference 14 forming the lower surface faces the lower surface, and each second hollow structure 12 is formed such that a corner portion 13 is directed toward the lower surface and a partial circumference 14 faces the upper surface.

The sides of the partial circumferences 14 forming the bottom of the first hollow structures 11, 11 adjacent to each other are connected together by bonding, and the sides of the partial circumferences 14 of the second hollow structures 12, 12 adjacent to each other are connected together by bonding. Since the partial circumferences 14 of the first hollow structures 11 and those of the second hollow structures 12 respectively form horizontal planes, the upper and lower surfaces of the connected hollow structure 1 are formed horizontally, and the connected hollow structure 1 has a panel-like shape which is uniform in apparent thickness.

The first and second hollow structures 11, 12 adjacent to each other have share in common the inclined side walls 15, which form each corner portion 13.

The connected hollow structure 1 in the twenty-fourth embodiment is fabricated as follows. Firstly, while a sheet (not shown) of a predetermined width is being delivered, convex folds and concave folds are sequentially formed on the sheet at intervals according to the size of the hollow structures 11, 12 in a required order, and the required surface of the sheet is coated with glue along the folds.

Subsequently, while the sheet is being folded along the folds so as to start the folding of the sheet according to the direction as shown by an arrow j in FIG. 36, the required edges of the hollow structures are bonded together, and the sheet is cut.

According to the above procedure, it is possible to form the connected hollow structure 1, in which the hollow structures 11, 12 have common side walls 15 forming the border between the adjacent hollow structures, and are comprised of a single sheet so as to take a shape resembling a unicursal figure in section, and the sheet material of the connected hollow structure is overlapped on the vertical sides of the hollow structures 11.

In comparison with the connected hollow structure in the first embodiment, the connected hollow structure 1 in the twenty-fourth embodiment shows lower withstanding strength against a planar force, while it shows more flexible elasticity, since, when the connected hollow structure 1 is exposed to a planar force of not less than a predetermined value, the common side walls forming the corner portions 13 of the hollow structures 11, 12 are bent.

Thus, the connected hollow structure in the twenty-fourth embodiment is suitable for use as a cushioning material for packaging, and is suitably used for keeping or packaging linear fluorescent lamps or like articles by inserting such articles into the hollow portions of the hollow structures 11.

Other respects of the functions and effects of the connected hollow structure in the twenty-fourth embodiment are substantially similar to those of the connected hollow structure in the first embodiment, and hence, the description thereof will be omitted.

(Twenty-fifth embodiment)

Figure 37:
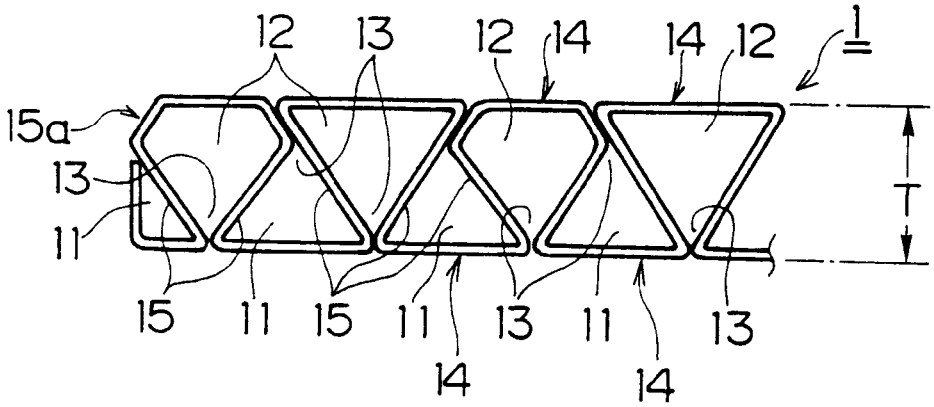
FIG. 37 is a fragmentary end view of a connected hollow structure in a twenty-fifth embodiment according to the present invention.

FIG. 37 shows a connected hollow structure 1 in a twenty-fifth embodiment which is formed such that first hollow structures 11 each have a corner portion 13 directed toward the upper surface and a partial circumference 14 facing the lower surface, and second hollow structures 12 each have a corner portion 13 directed toward the lower surface and a partial circumference 14 facing the upper surface, which corner portions are alternately arranged.

The sides of the partial circumferences 14 of the first hollow structures 11, 11 adjacent to each other are substantially horizontally connected together by bonding, and the sides of the partial circumferences 14 of the second hollow structures 12, 12 adjacent to each other are substantially horizontally connected together by bonding. Thus, the connected hollow structure 1 has a panel-like shape substantially uniform inapparent thickness T, and takes a shape resembling a unicursal figure in section.

While the first hollow structure 11 at each end of the connected hollow structure 1 has a right-angled triangular section of a small size, other first hollow structures 11 have an isosceles triangular section of the same size.

The second hollow structures 12 uniformly include hollow structures of a pentagonal section of a slightly special shape, and those of an isosceles triangular section. The side walls of the second hollow structures 12 of the pentagonal section and those of the second hollow structures 12 of the isosceles triangular section are partially overlapped with each other.

Since the corner portions 13 of the hollow structures 11, 12 are formed at the same angle, the connected hollow structure 1 in this embodiment is substantially equal in withstanding strength against a planar force to the connected hollow structure in the first embodiment. Thus, when the connected hollow structure 1 is exposed to a planar force of not less than a predetermined value, the common side walls of the hollow structures 11, 12 are bent, and as a result, show elasticity to absorb such a force.

The connected hollow structure 1 has both ends respectively formed into a chamfered inclined side surface 15*a* so as to round off the corner at both ends.

Other respects of the functions and effects of the connected hollow structure in the twenty-fifth embodiment are substantially similar to those of the connected hollow structure in the first embodiment, and hence, the description thereof will be omitted.

(Twenty-sixth embodiment)

Figure 38:
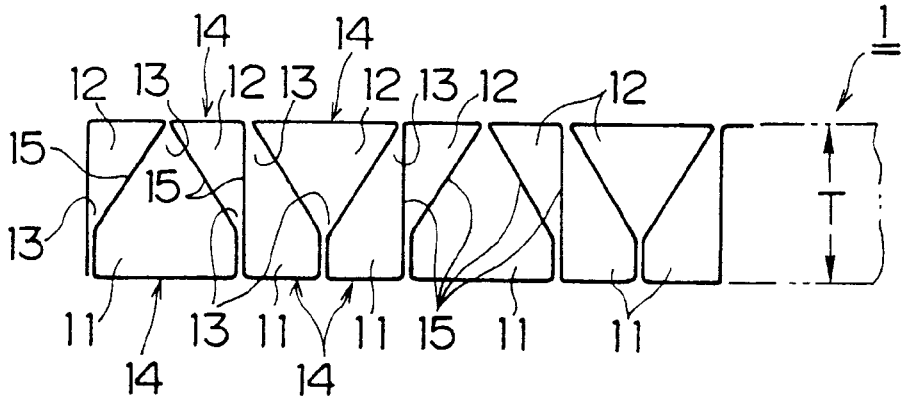
FIG. 38 is a fragmentary end view of a connected hollow structure in a twenty-sixth embodiment according to the present invention.

FIG. 38 partially shows a connected hollow structure 1 in a twenty-sixth embodiment as being composed of first hollow structures 11 and second hollow structures 12. The first hollow structures 11 include hollow structures of a pentagonal (special) section and of the same size, and those of a quadrangular (special) section and of the same size in the ratio of 1:2. Further, the second hollow structures 12 include hollow structures of a right-angled triangular section and of the same size and those of an isosceles triangular section and of the same size in the ratio of 2:1.

A large number of first and second hollow structures 11, 12 as described above are formed in an alternate arrangement according to a certain repetitive pattern as shown in FIG. 38.

The sides of the partial circumferences 14 of the first hollow structures 11, 11 adjacent to each other are connected together by bonding so as to form a substantially horizontal plane, and the sides of the partial circumferences 14 of the second hollow structures 12, 12 adjacent to each other are connected together by bonding so as to form a substantially horizontal plane. Thus, the connected hollow structure 1 has a panel-like shape which is substantially uniform in apparent thickness, and takes a shape resembling a unicursal figure in section.

There is no great difference in withstanding strength against a planar force applied to each portion of the connected hollow structure 1 in this embodiment, since the first and second hollow structures 11, 12 of the sectional shape as described above are formed in an alternately well-balanced arrangement according to a certain repetitive pattern. The connected hollow structure 1 withstands a planar force mainly with the side walls common to the adjacent first and second hollow structures 11, 12.

The fabricating method, and other respects of the constitution, functions and effects of the connected hollow structure 1 in the twenty-sixth embodiment are substantially similar to those of the connected hollow structure in the first embodiment, and hence, the description thereof will be omitted.

(Twenty-seventh embodiment)

Figure 39:
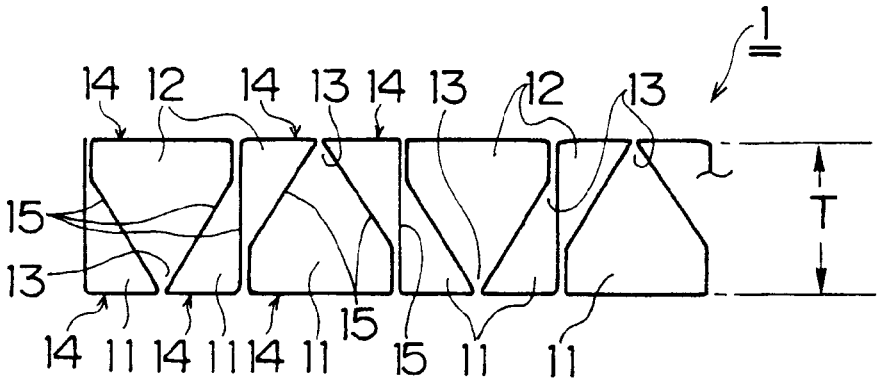
FIG. 39 is a fragmentary end view of a connected hollow structure in a twenty-seventh embodiment according to the present invention.

FIG. 39 partially shows a twenty-seventh embodiment as composed of first hollow structures 11 and second hollow structures 12 respectively including hollow structures of a right-angled triangular section and of the same size and those of a pentagonal (special) section and of the same size in the ratio of 2:1. Each of the hollow structures 11, 12 of the pentagonal section corresponds to two hollow structures 12 or 11 of the right-angled triangular section.

A large number of first and second hollow structures 11, 12 as described above are formed in an alternate arrangement according to a certain repetitive pattern as shown in FIG. 39.

The sides of the partial circumferences 14 of the first hollow structures 11, 11 adjacent to each other are connected together by bonding so as to form a substantially horizontal plane, and the sides of the partial circumferences 14 of the second hollow structures 12, 12 adjacent to each other are connected together by bonding so as to form a substantially horizontal plane. Thus, the connected hollow structure 1 has a panel-like shape which is substantially uniform inapparent thickness, and takes a shape resembling a unicursal figure in section.

Other respects of the constitution, functions and effects of the connected hollow structure 1 in the twenty-seventh embodiment are substantially similar to those of the connected hollow structure in the twenty-sixth embodiment, and hence, the description thereof will be omitted.

(Twenty-eighth embodiment)

Figure 40:
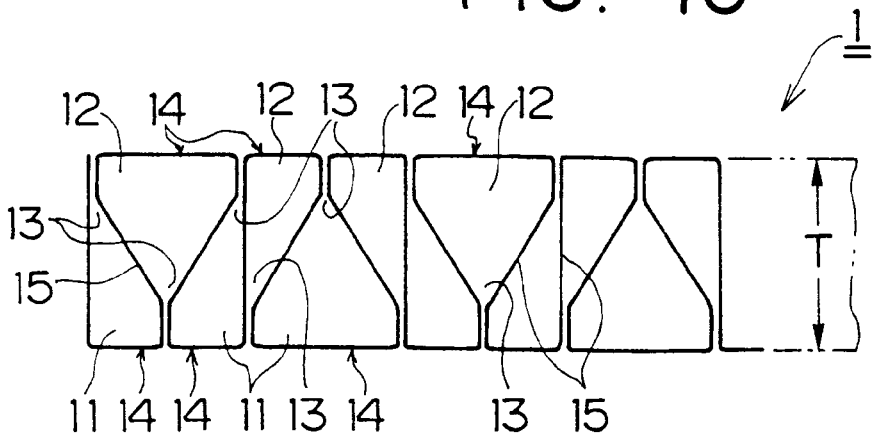
FIG. 40 is a fragmentary end view of a connected hollow structure in a twenty-eighth embodiment according to the present invention.

FIG. 40 partially shows a connected hollow structure 1 in a twenty-eighth embodiment as being composed of first and second hollow structures 1112 respectively including hollow structures of a quadrangular section and of the same size, and those of a pentagonal section and of the same size in the ratio of 2:1. Each of the hollow structures 11,12 of the pentagonal section corresponds to two hollow structures 12 or 11 of the quadrangular section.

A large number of first and second hollow structures 11, 12 as described above are formed in an alternate arrangement according to a certain repetitive pattern.

The sides of the partial circumferences 14 of the first hollow structures 11, 11 adjacent to each other are connected together by bonding so as to form a substantially horizontal plane, and the sides of the partial circumferences 14 of the second hollow structures 12, 12 adjacent to each other are connected together by bonding so as to form a substantially horizontal plane. Thus, the connected hollow structure 1 has a panel-like shape which is substantially uniform in apparent thickness, and takes a shape resembling a unicursal figure in section.

Other respects of the constitution, functions, and effects of the connected hollow structure 1 in the twenty-eighth embodiment are substantially similar to those of the connected hollow structure in the twenty-sixth embodiment, and hence, the description thereof will be omitted.

(Twenty-ninth embodiment)

Figure 41:
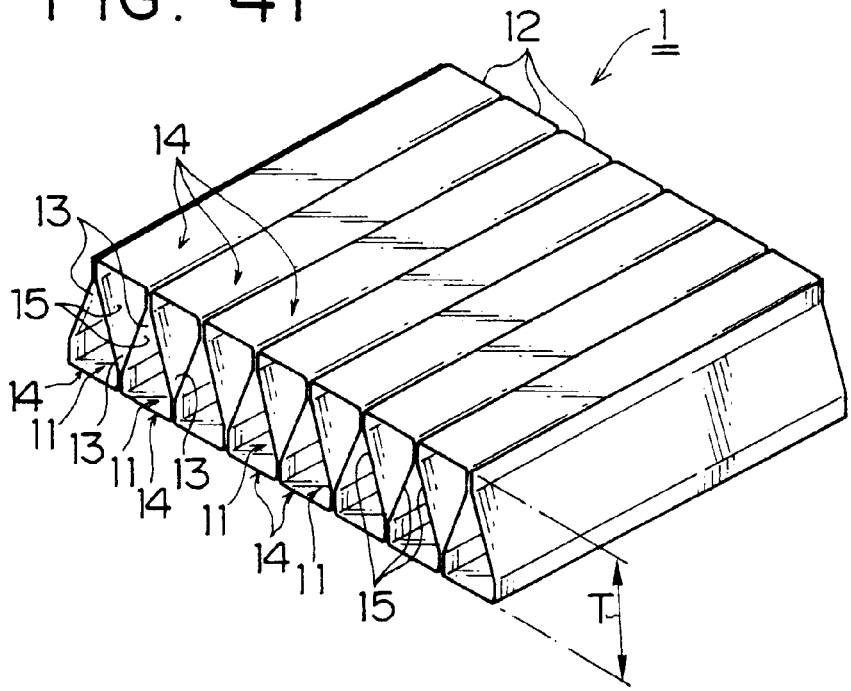
FIG. 41 is a fragmentary perspective view of a connected hollow structure in a twenty-ninth embodiment according to the present invention.

FIG. 41 partially shows a connected hollow structure 1 in a twenty-ninth embodiment as being composed of first and second hollow structures 11, 12 which respectively have a pentagonal section close to an isosceles triangular shape and are of the same size. The first and second hollow structures 11, 12 are formed in a dense and alternate arrangement and in alternately inverted positions.

The partial circumferences 14 of the first hollow structures 11, 11 adjacent to each other are connected together by bonding so as to form a substantially horizontal plane, and the partial circumferences 14 of the second hollow structures 12, 12 adjacent to each other are connected together by bonding so as to form a substantially horizontal plane. Thus, the connected hollow structure 1 has a panel-like shape which is substantially uniform in apparent thickness, and takes a shape resembling a unicursal figure in section.

The connected hollow structure 1 in this embodiment shows high withstanding strength against a planar force, even though its apparent specific gravity is small, since each of the hollow structures 11, 12 has a pentagonal section close to an isosceles triangular shape. Further, more uniform withstanding strength is shown in each part, since the hollow structures 11, 12 are of the same size.

Other respects of the constitution, functions and effects of the connected hollow structure 1 in the twenty-ninth embodiment are substantially similar to those of the connected hollow structure in the first embodiment, and hence, the description thereof will be omitted.

(Thirtieth embodiment)

Figure 42:
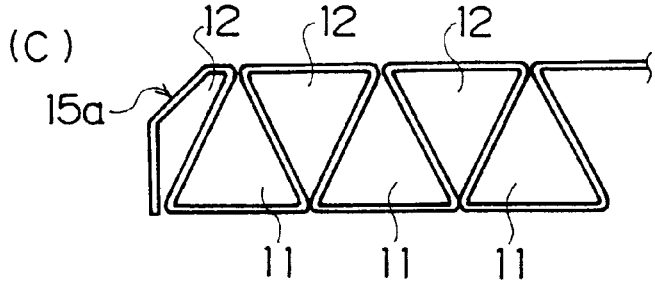
FIG. 42(C) is a fragmentary end view of a connected hollow structure in a thirtieth embodiment according to the present invention.
FIG. 42(D) is a fragmentary end view of a connected hollow structure in a thirty-first embodiment according to the present invention.
Figure 42:
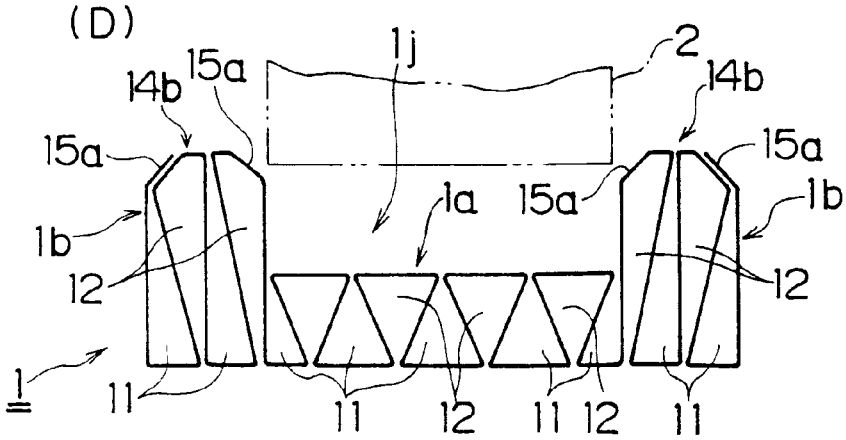

FIG. 42(C) partially shows a connected hollow structure 1 in a thirtieth embodiment formed such that a right-angled corner portion of each second hollow structure 12 of the right-angled triangular section at each end of the connected hollow structure 1 in the first embodiment is modified into a chamfered inclined side surface 15*a*.

It is possible to form a connected hollow structure having a rounded-off end, and to prevent the corner of each hollow structure 12 at both ends of the connected hollow structure 1 from being transformed or collapsed by forming the chamfered inclined side surface 15*a* at the ends described above.

A means for forming the chamfered inclined side surface 15*a* at both ends of the connected hollow structure 1 in this manner may be applied to a connected hollow structure in other embodiments having an overall panel-like shape which is substantially uniform in apparent thickness, or a connected hollow structure having a gradually-rising portion formed on one surface, like the connected hollow structure in the fifteenth embodiment (See FIG. 27) or sixteenth embodiment (See FIG. 28).

(Thirty-first embodiment)

FIG. 42(D) shows a connected hollow structure 1 in a thirty-first embodiment formed such that the hollow structure 12 at each end of each projection 14*b* of the connected side structures 1*b*, 1*b* of the connected hollow structure 1 in the ninth, tenth or eleventh embodiment (See FIGS. 20 and 21) is modified to have a chamfered inclined side surface 15*a* extending in the lengthwise direction of the hollow structure 12.

It is possible to form a connected hollow structure having a rounded-off end, and to prevent the corner of each hollow structure 12 at both ends of each projection 14*b* of the connected hollow structure 1 from being transformed or collapsed by forming the chamfered inclined side surfaces a on each hollow structure positioned at the ends described above.

Further, when articles 2 to be packaged are inserted into a channel-like portion 1*j* of the connected hollow structure 1, the inner inclined side surfaces a of both the projections 14*b* function as a guide for the articles 2 when inserted, and enable the smooth insertion of the articles.

(Thirty-second embodiment)

Figure 43:
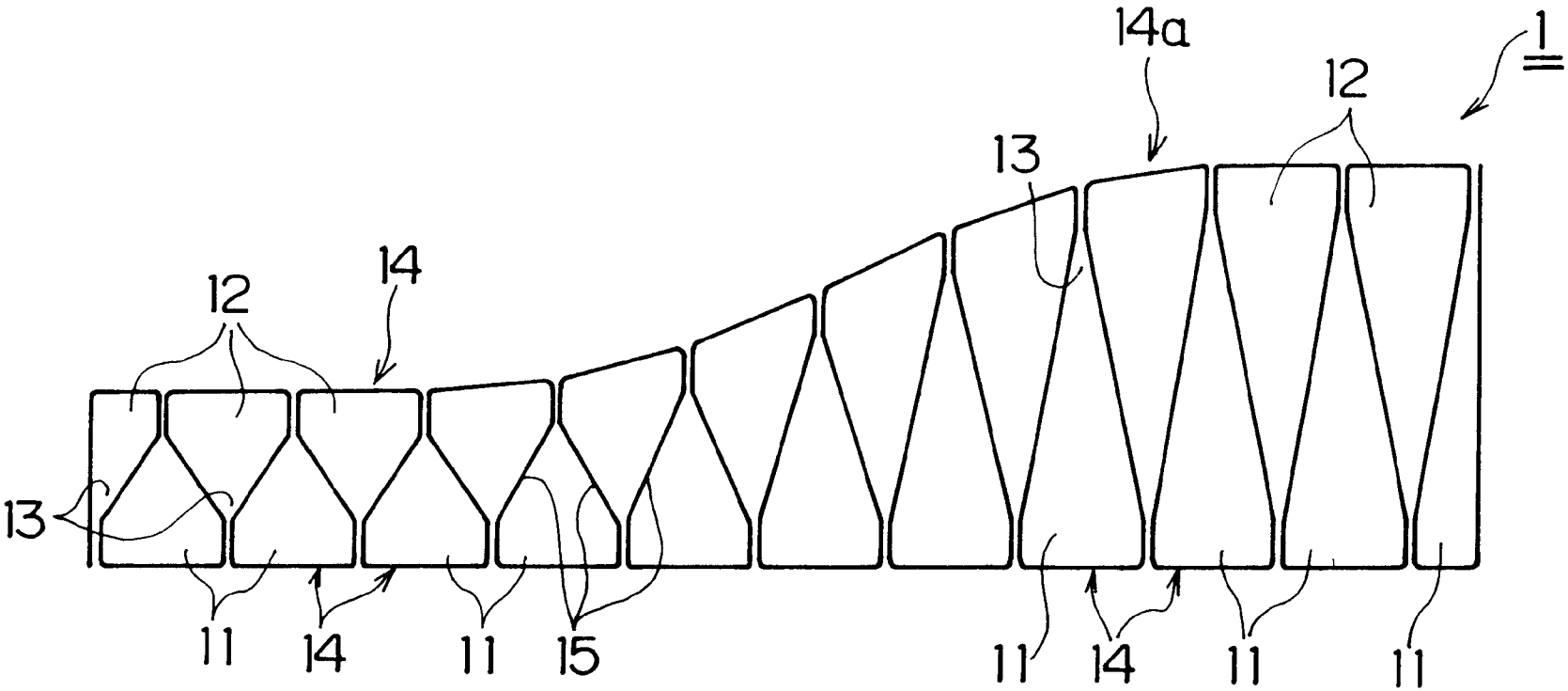
FIG. 43 is an end view of a connected hollow structure in a thirty-second embodiment according to the present invention.

FIG. 43 shows a connected hollow structure 1 in a thirty-second embodiment formed such that first and second hollow structures 11, 12 included in a connected hollow structure having a gradually-rising portion 14*a* formed on one surface, like the connected hollow structure in the fifteenth embodiment (See FIG. 27), have a pentagonal section, similarly to the connected hollow structure shown in FIG. 41.

(Thirty-third embodiment)

Figure 44:
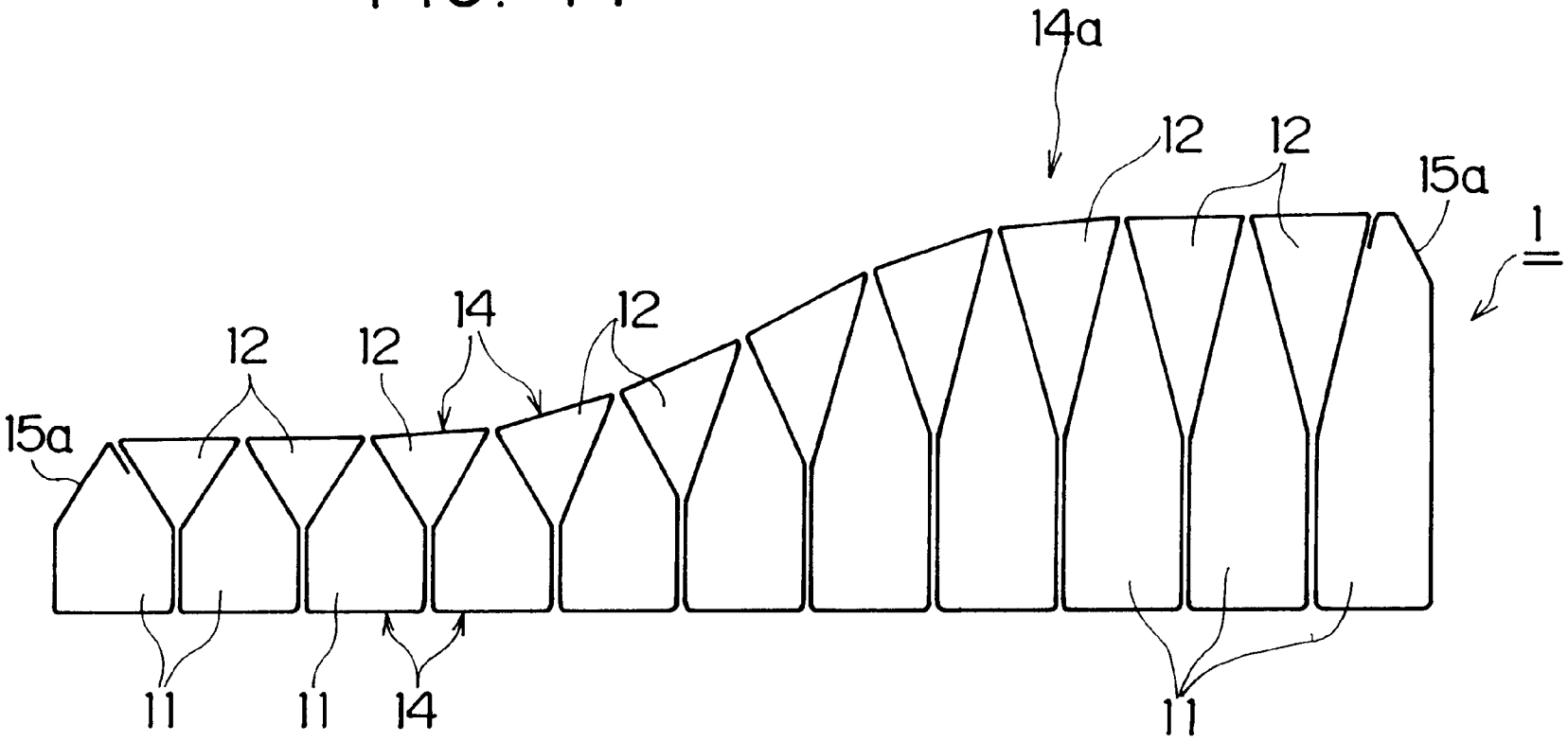
FIG. 44 is an end view of a connected hollow structure in a thirty-third embodiment according to the present invention.

FIG. 44 shows a connected hollow structure 1 in a thirty-third embodiment formed such that a connected hollow structure having a gradually-rising portion 14*a* formed on one surface, like the connected hollow structure in the thirty-second embodiment, is composed of first hollow structures of a pentagonal section, and second hollow structures of a triangular section.

Further, the upper corner portions of the first hollow structures 11 at both ends of the connected hollow structure 1 in this embodiment are modified into chamfered inclined side surfaces 15*a*, 15*a*.

When the connected hollow structure 1 having the rising portion 14*a* formed on one surface like this embodiment is formed, the first and second hollow structures 11, 12 included in the connected hollow structure 1 may take various shapes as shown in FIGS. 33 to 35 or 37, instead of the shapes described in the fifteenth, thirty-second and thirty-third embodiments.

(Thirty-fourth embodiment)

Figure 45:
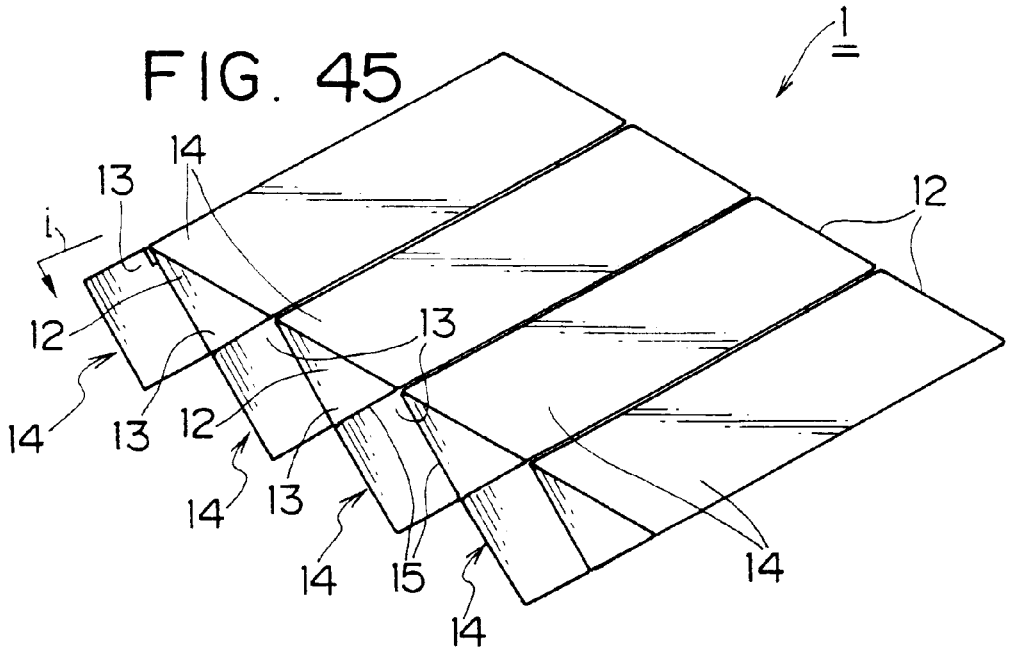
FIG. 45 is a fragmentary perspective view of a connected hollow structure in a thirty-fourth embodiment according to the present invention.

FIG. 45 shows a connected hollow structure in a thirty-fourth embodiment according to the present invention.

A connected hollow structure 1 in the thirty-fourth embodiment is formed such that laterally-arranged first hollow structures 11 of a quadrangular (or parallelogram) section and of the same size, and second hollow structures 12 of a triangular section and of the same size on the upper side of the first hollow structures are connected together in an alternate arrangement.

Each first hollow structure 11 is formed such that a corner portion 13 is directed toward the upper surface, and a partial circumference 14 composed of two side surfaces faces the lower surface. Each second hollow structure 12 is formed such that a corner portion 13 is directed toward the lower surface, and a partial circumference 14 composed of one side surface faces the upper surface.

The partial circumferences 14 of the first hollow structures 11 adjacent to each other are connected together in a substantially-horizontal state by bonding, and the partial circumferences 14 of the second hollow structures 12 adjacent to each other are similarly connected together by bonding. The first and second hollow structures 11, 12 adjacent to each other have common side walls 15, which form each corner portion 13 of the adjacent first and second hollow structures. Thus, the connected hollow structure 1 has a substantially-horizontal upper surface and a corrugated lower surface on the whole, and takes a shape resembling a unicursal figure in section.

The connected hollow structure 1 in this embodiment is fabricated as follows. Firstly, while a sheet (not shown) of a predetermined width is being delivered, convex folds and concave folds are sequentially formed on the sheet at intervals according to the size of the hollow structures 11, 12 in a required order, and the required surface of the sheet is coated with glue along the folds.

Subsequently, while the sheet is being folded along the folds so as to start the folding of the sheet according to the direction as shown by an arrow i in FIG. 45, the required edges of the hollow structures are bonded together, and the sheet is cut.

In comparison with the connected hollow structure in the first embodiment, the connected hollow structure 1 in the thirty-fourth embodiment shows lower withstanding strength against a planar force, while it shows far more flexible elasticity, since, when the connected hollow structure is exposed to a planar force of not less than a predetermined value, the hollow structures 11, 12 are largely transformed and absorb such a planar force.

In particular, since the partial circumference 14 on the lower side of each first hollow structure 11 is composed of two uniformly-projecting side surfaces, the connected hollow structure in this embodiment shows highly cushioning properties due to transforming and restoring action of these side surface portions.

Thus, the connected hollow structure in this embodiment is suitable for use as a cushioning material for packaging, and as other packaging members for keeping or packaging linear fluorescent lamps or like articles by inserting such articles into the hollow portions of the hollow structures 11.

(Thirty-fifth embodiment)

Figure 46:
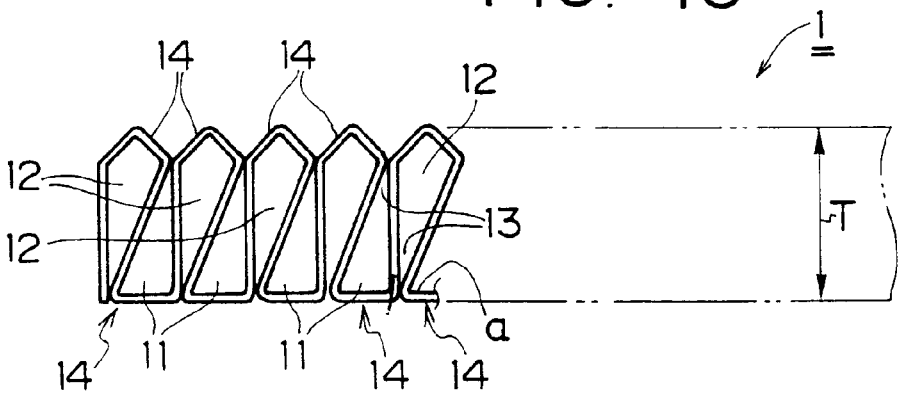
FIG. 46 is a fragmentary end view of a connected hollow structure in a thirty-fifth embodiment according to the present invention.

FIG. 46 shows a connected hollow structure 1 in a thirty-fifth embodiment as being formed such that while a single sheet a is being folded, first hollow structures 11 of a right-angled triangular section and of the same size, and second hollow structures 12 of a pentagonal section including a corner portion 13 formed at the same angle as a corner portion 13 of each first hollow structure 11 are alternately arranged in an alternately inverse position as shown in FIG. 46, and the partial circumferences 14 of the hollow structures 11 and those of the hollow structures 12 are respectively connected together by bonding.

The connected hollow structure 1 has a substantially-horizontal lower surface formed by connecting the partial circumferences 14 of the first hollow structures 11 together, and a corrugated upper surface formed by connecting the partial circumferences of the second hollow structures 12 together.

The connected hollow structure 1 in this embodiment shows flexible elasticity, since the partial circumference 14 on the upper side of each second hollow structure 12 is composed of two side surfaces forming an angular projection, and these side surface portions are smoothly transformed or restored.

Other respects of the constitution, functions and effects of the connected hollow structure 1 in the thirty-fifth embodiment are substantially similar to those of the connected hollow structure in the first embodiment, and hence, the description thereof will be omitted.

(Thirty-sixth embodiment)

Figure 47:
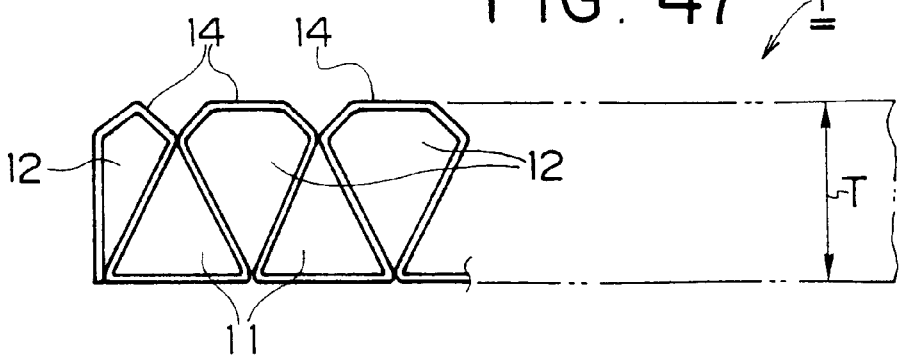
FIG. 47 is a fragmentary end view of a connected hollow structure in a thirty-sixth embodiment according to the present invention.

FIG. 47 shows a connected hollow structure 1 in a thirty-sixth embodiment as being formed such that while a single sheet a is being folded, first hollow structures 11 of an isosceles triangular section and of the same size, and second hollow structures 12 of a pentagonal section including a corner portion 13 formed at the same angle as a corner portion 13 of each first hollow structure 11 are alternately arranged in alternately inverted positions as shown in FIG. 47, and the partial circumferences 14 of the first hollow structures 11 and those of the second hollow structures 12 are respectively connected together by bonding.

The connected hollow structure 1 has a substantially-horizontal lower surface formed by connecting the partial circumferences 14 of the first hollow structures 11 together, and a corrugated upper surface formed by connecting the partial circumferences 14 of the second hollow structures 12 together.

In this embodiment, the connected hollow structure is formed such that each second hollow structure 12 has a pentagonal section, and the partial circumference 14 of each second hollow structure has a trapezoidal shape composed of three side surfaces and projects upwards, differently from the connected hollow structure 1 in the first embodiment.

The connected hollow structure 1 in this embodiment shows flexible elasticity, since the partial circumference 14 on the upper side of each second hollow structure 12 is composed of two side surfaces forming an angular projection, and these side surface portions are smoothly transformed or restored when the connected hollow structure is exposed to a planar force.

Other respects of the constitution, functions and effects of the connected hollow structure 1 in the thirty-sixth embodiment are substantially similar to those of the connected hollow structure in the first embodiment, and hence, the description thereof will be omitted.

(Thirty-seventh embodiment)

Figure 48:
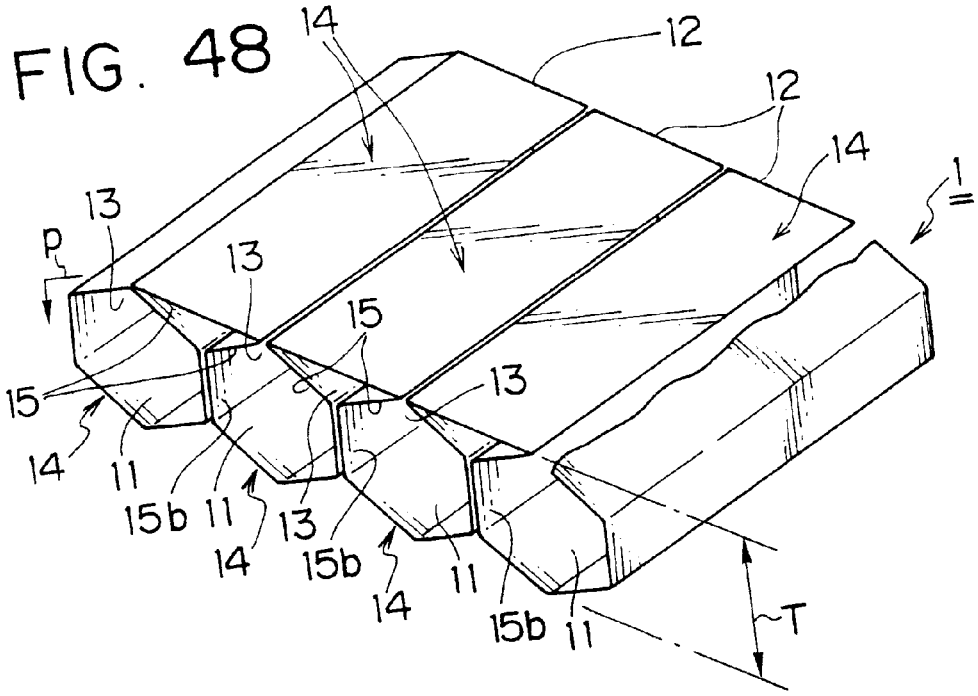
FIG. 48 is a fragmentary perspective view of a connected hollow structure in a thirty-seventh embodiment according to the present invention.

FIG. 48 partially shows a connected hollow structure 1 in a thirty-seventh embodiment as being formed such that a large number of first hollow structures 11 of a regular hexagonal section including a corner portion 13 directed toward the upper surface and a partial circumference 14 composed of two side surfaces opposite to the corner portion and facing the lower surface, and a large number of second hollow structures 12 of an isosceles triangular section including a corner portion 13 directed toward the lower surface and a partial circumference 14 composed of a side surface opposite to the corner portion and facing the upper surface are alternately arranged.

The side walls 15*b*, which are overlapped with each other in a vertical position, of the first hollow structures 11, 11 adjacent to each other are connected together by bonding, and the second hollow structures 12, 12 adjacent to each other are connected together by bonding in a portion of the corner portion 13 of each first hollow structure 11 adjacent to these hollow structures 12, 12. The first and second hollow structures 11, 12 adjacent to each other have common side walls, which form the corner portion 13 of each second hollow structure 13.

The connected hollow structure in this embodiment is fabricated as follows. Firstly, while a sheet (not shown) of a predetermined width is being delivered, convex folds and concave folds are sequentially formed on the sheet in a required order at intervals according to the size of the hollow structures 11, 12, and the required surface of the sheet is coated with glue along the folds.

Subsequently, while the sheet is being folded along the folds to repeatedly form the hollow structures 11 and the adjacent hollow structures 12 50 as to start the folding of the sheet according to the direction as shown in an arrow p in FIG. 48, the required portions of the hollow structures 11, 12 are bonded together, and the sheet is cut.

According to the above procedure, it is possible to form the connected hollow structure 1, which is comprised of a single sheet so as to take a shape resembling a unicursal figure in section, and is substantially uniform in apparent thickness T, as shown in FIG. 48.

In comparison with the connected hollow structure in the first embodiment, the connected hollow structure 1 in the thirty-seventh embodiment shows lower withstanding strength against a planar force, while it shows more flexible elasticity, since, when the connected hollow structure is exposed to a planar force of not less than a predetermined value, the partial circumference 14 composed of two side surfaces projecting substantially uniformly downwards in each hollow structure 11 is transformed and absorbs such a planar force.

Thus, the connected hollow structure 1 in this embodiment is suitable for use as a cushioning material for packaging, and may be suitably used for keeping or packaging linear fluorescent lamps or like articles by inserting such articles into the hollow structures 11, 12.

Further, the connected hollow structure 1 in this embodiment may be rounded into a cylindrical shape with the hollow structures 11 turned to the inside, since, when the connected hollow structure is exposed to an external force sideways, the hollow structures 11 of the hexagonal section are easily transformed in the folding direction.

Other respects of the constitution, functions and effects of the connected hollow structure in the thirty-seventh embodiment are substantially similar to those of the connected hollow structure in the first embodiment, and hence, the description thereof will be omitted.

(Thirty-eighth embodiment)

Figure 49:
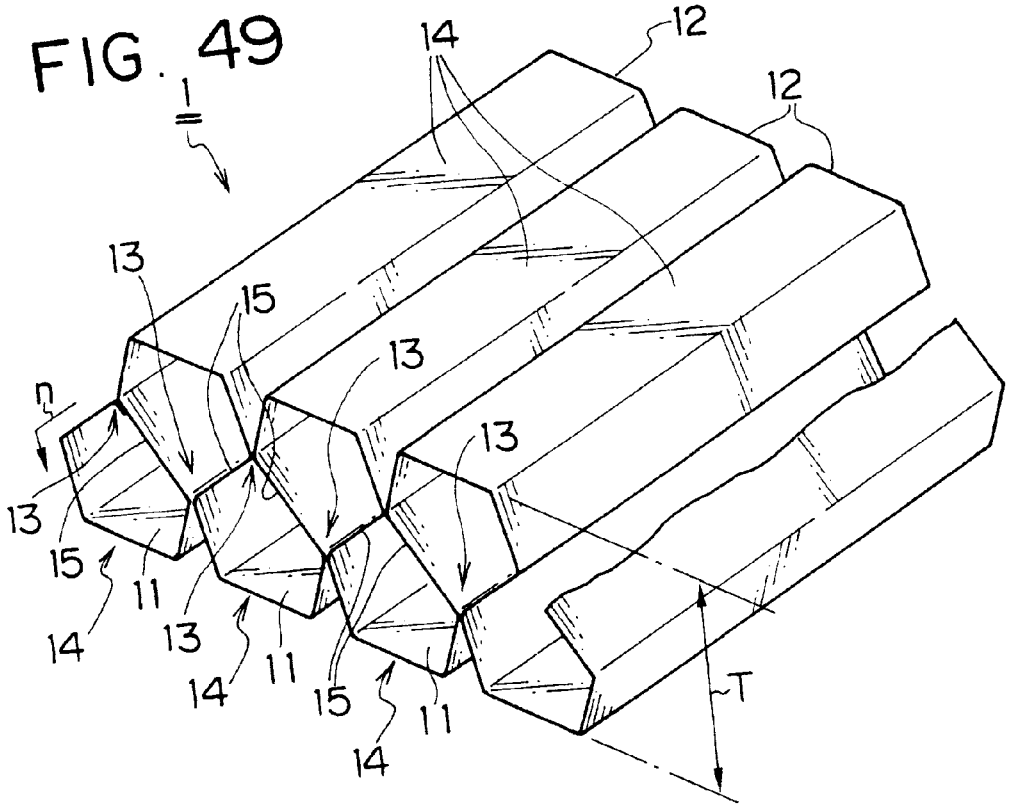
FIG. 49 is a fragmentary perspective view of a connected hollow structure in a thirty-eighth embodiment according to the present invention.

FIG. 49 partially shows a connected hollow structure 1 in a thirty-eighth embodiment as being formed such that first hollow structures 11 of the same size and of a regular pentagonal section, and second hollow structures 12 of the same size and of a section equal to that of the first hollow structures are alternately arranged in alternately inverted positions.

Each first hollow structure 11 is formed such that a corner portion 13 is directed toward the upper surface, and a partial circumference 14 composed of three side surfaces uniformly projecting downwards faces the lower surface. Each second hollow structure 12 is formed such that a corner portion 13 is directed toward the lower surface, and a partial circumference 14 composed of three side surfaces uniformly projecting upwards faces the upper surface.

The first hollow structures 11, 11 adjacent to each other are connected together by bonding in a portion of the corner portion 13 of each second hollow structure 12 positioned between the first hollow structures, and the second hollow structures 12, 12 adjacent to each other are connected together by bonding in a portion of the corner portion 13 of each first hollow structure 11 positioned between the second hollow structures.

The first and second hollow structures 11, 12 adjacent to each other have common side walls 15, which form the corner portion 13 of each of the first and second hollow structures.

The connected hollow structure 1 in the thirty-eighth embodiment is fabricated as follows. Firstly, while a sheet (not shown) of a predetermined width is being delivered, convex folds and concave folds are sequentially formed on the sheet in a required order at intervals according to the size of the hollow structures 11, 12, and the required surface of the sheet is coated with glue along the folds.

Subsequently, while the sheet is being folded along the folds to repeatedly form the first hollow structures 11 and the adjacent second hollow structures 12 so as to start the folding of the sheet according to the direction of an arrow n in FIG. 49, the required portions of the hollow structures 11, 12 are bonded together, and the sheet is cut.

According to the above procedure, it is possible to form the connected hollow structure 1, which is comprised of a single sheet so as to take a shape resembling a unicursal figure in section, with a substantially uniform apparent thickness T, and with no overlap of the sheet material of the connected hollow structure, on any surfaces of the hollow structures 11, 12.

In comparison with the connected hollow structure in the first embodiment, the connected hollow structure 1 in the thirty-eighth embodiment shows lower withstanding strength against a planar force, while it shows more flexible elasticity, since, when the connected hollow structure receives a planar force of not less than a predetermined value, the hollow structures 11, 12 are easily transformed and absorb such a force.

Thus, the connected hollow structure in this embodiment is suitable for use as a cushioning material for packaging, and may be suitably used for keeping or packaging linear fluorescent lamps or like articles by inserting such articles into the hollow structures 11, 12.

Other respects of the constitution, functions and effects of the connected hollow structure in the thirty-eighth embodiment are substantially similar to those of the connected hollow structure in the first embodiment, and hence, the description thereof will be omitted.

(Thirty-ninth embodiment)

Figure 50:
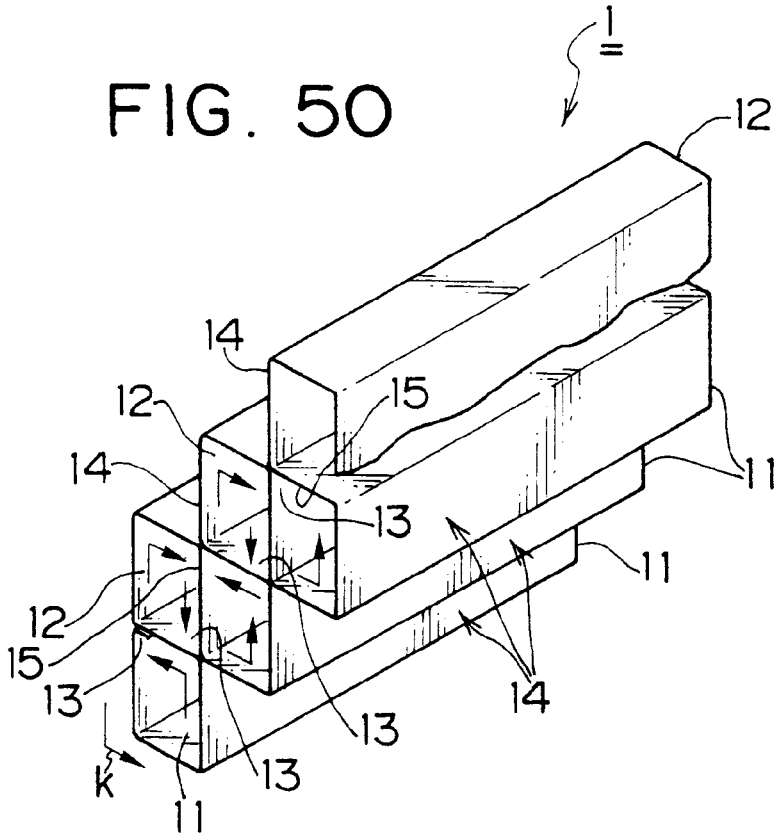
FIG. 50 is a fragmentary perspective view of a connected hollow structure in a thirty-ninth embodiment according to the present invention.

FIG. 50 partially shows a connected hollow structure 1 in a thirty-ninth embodiment as being formed such that a large number of first hollow structures 11 of a quadrangular (or parallelogram) section and of the same size, and a large number of second hollow structures 12 of the same size and equal in sectional shape to the first hollow structures are alternately arranged in alternately inverted positions.

Each first hollow structure 11 is formed such that a corner portion 13 is directed toward the upper surface, and a partial circumference 14, composed of two side surfaces uniformly projecting downwards, faces the lower surface. On the other hand, each second hollow structure 12 is formed such that a corner portion 13 is directed toward the lower surface, and a partial circumference 14 composed of two side surfaces uniformly projecting upwards faces the upper surface.

The first hollow structures 11, 11 adjacent to each other are connected together by bonding in a portion of the corner portion 13 of each second hollow structure 12 positioned between the first hollow structures, and the second hollow structures 12, 12 adjacent to each other are connected together by bonding in a portion of the corner portion of each first hollow structure 11 positioned between the second hollow structures.

The connected hollow structure 1 in the thirty ninth embodiment is fabricated as follows. Firstly, while a sheet (not shown) of a predetermined width is being delivered, convex folds and concave folds are sequentially formed on the sheet in a required order at intervals according to the size of the hollow structures 11, 12, and the required surface of the sheet is coated with glue along the folds.

Subsequently, while the sheet is being folded along the folds so as to start the folding of the sheet according to the direction shown by an arrow K in FIG. 50, the required portions of the hollow structures 11, 11 and those of the second hollow structures 12, 12 are bonded together, and the sheet is cut.

According to the above procedure, it is possible to form the connected hollow structure 1, which is comprised of a single sheet so as to take a shape resembling a unicursal figure in section, and has no overlap portion of the sheet material of the connected hollow structure on any surfaces of the hollow structures 11, 12.

In comparison with the connected hollow structure 1 in the first embodiment, the connected hollow structure 1 in the thirty-ninth embodiment shows far lower withstanding strength against a planar force, while it shows extremely flexible elasticity, since, when the connected hollow structure receives a planar force of not less than a predetermined value, the hollow structures 11, 12 are easily transformed in the folding direction and absorb such a force.

Thus, the connected hollow structure in this embodiment is suitable for use as a cushioning material for packaging, and may be suitably used for keeping or packaging linear fluorescent lamps or like articles by inserting such articles into the hollow structures 11, 12.

The connected hollow structure 1 in this embodiment may be handled in a flatly-folded state on the whole for storage or transportation, since the hollow structures 11, 12 have a quadrangular or parallelogram section, and are connected together in the portions of their corner portions 13.

Further, the connected hollow structure I in this embodiment may be easily rounded into a cylindrical shape with the hollow structures 11 or 12 turned to the inside, since the hollow structures 11, 12 of this connected hollow structure 1 are easily transformed as described above.

Other respects of the constitution, functions, and effects of the connected hollow structure in the thirty-ninth embodiment are substantially similar to those of the connected hollow structure in the first embodiment, and hence, the description thereof will be omitted.

(Fortieth embodiment)

Figure 51:
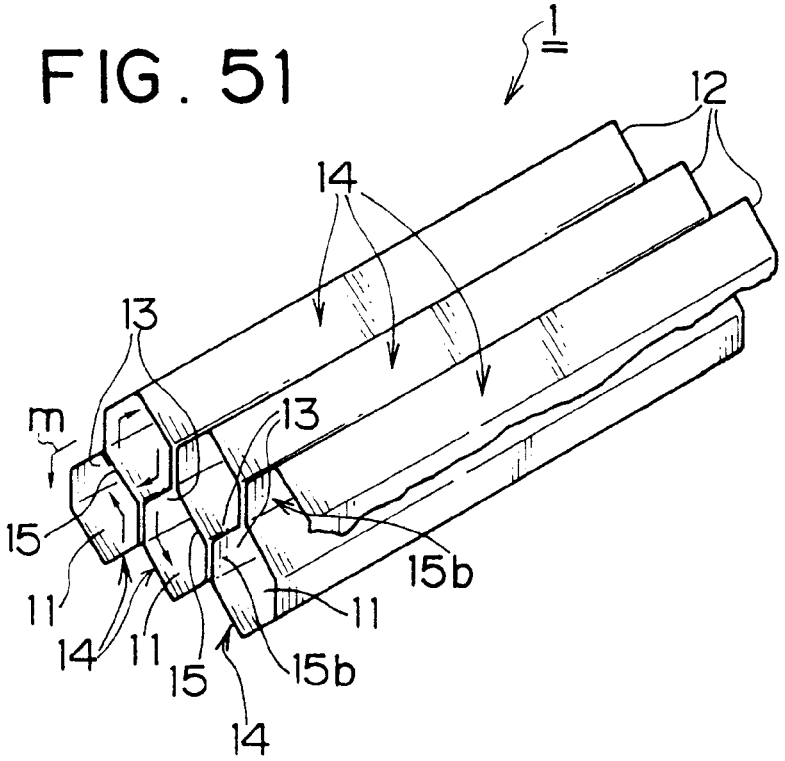
FIG. 51 is a fragmentary perspective view of a connected hollow structure in a fortieth embodiment according to the present invention.

FIG. 51 partially shows a connected hollow structure 1 in a fortieth embodiment as being formed such that a large number of first hollow structures 11 of a regular hexagonal section including a corner portion 13 directed toward the upper surface and a partial circumference 14 composed of two side surfaces on the opposite side to the corner portion and facing the lower surface, and a large number of second hollow structures 12 equal in shape and size to the first hollow structures 11 and including a corner portion 13 directed toward the lower surface and a partial circumference 14 composed of two side surfaces on the opposite side to the corner portion and facing the upper surface are alternately arranged.

The side walls 15*b*, which are overlapped with each other in a vertical position, of the first hollow structures 11, 11 adjacent to each other and those of the second hollow structures 12, 12 adjacent to each other are respectively connected together by bonding. The first and second hollow structures 11, 12 adjacent to each other have common side walls 15, which form the corner portion 13 of each of the first and second hollow structures.

The connected hollow structure 1 in the fortieth embodiment is fabricated as follows. Firstly, while a sheet (not shown) of a predetermined width is being delivered, convex folds and concave folds are sequentially formed on the sheet in a required order at intervals according to the size of the hollow structures 11, 12, and the required surface of the sheet is coated with glue along the folds.

Subsequently, while the sheet is being folded along the folds to repeatedly form the first hollow structures 11 and the adjacent second hollow structures 12 in an alternate arrangement so as to start the folding of the sheet according to the direction as shown by an arrow m in FIG. 51, the required portions of the hollow structures 11, 12 are bonded together, and the sheet is cut.

According to the above procedure, it is possible to form the connected hollow structure 1 which is comprised of a single sheet so as to take a shape resembling a unicursal figure in section, as shown in FIG. 51.

In comparison with the connected hollow structure in the first embodiment, the connected hollow structure 1 in the fortieth embodiment shows far lower withstanding strength against a planar force, while it shows more flexible elasticity, since, when the connected hollow structure receives a planar force of not less than a predetermined value, the partial circumference 14 composed of two substantially-uniformly projecting side surfaces in each of the hollow structures 11, 12 is easily transformed and absorbs such a force.

Thus, the connected hollow structure in this embodiment is suitable for use as a cushioning material for packaging, and may be suitably used for keeping or packaging linear fluorescent lamps or like articles by inserting such articles into the hollow structures 11, 12.

The connected hollow structure 1 in this embodiment is handled in a flatly-folded state for storage or transportation, since the hollow structures 11, 12 have a regular hexagonal section and are flatly folded, when the connected hollow structure is exposed to an external force sideways.

Further, the connected hollow structure 1 in this embodiment may be rounded into a cylindrical shape with the hollow structures 11 or 12 turned to the inside, since the hollow structures 11, 12 are easily transformed in the folding direction when the connected hollow structure is exposed to the external force sideways, as described above.

Other respects of the constitution, functions and effects of the connected hollow structure 1 in the fortieth embodiment are substantially similar to those of the connected hollow structure in the first embodiment, and hence, the description thereof will be omitted.

(Forty-first embodiment)

Figure 52:
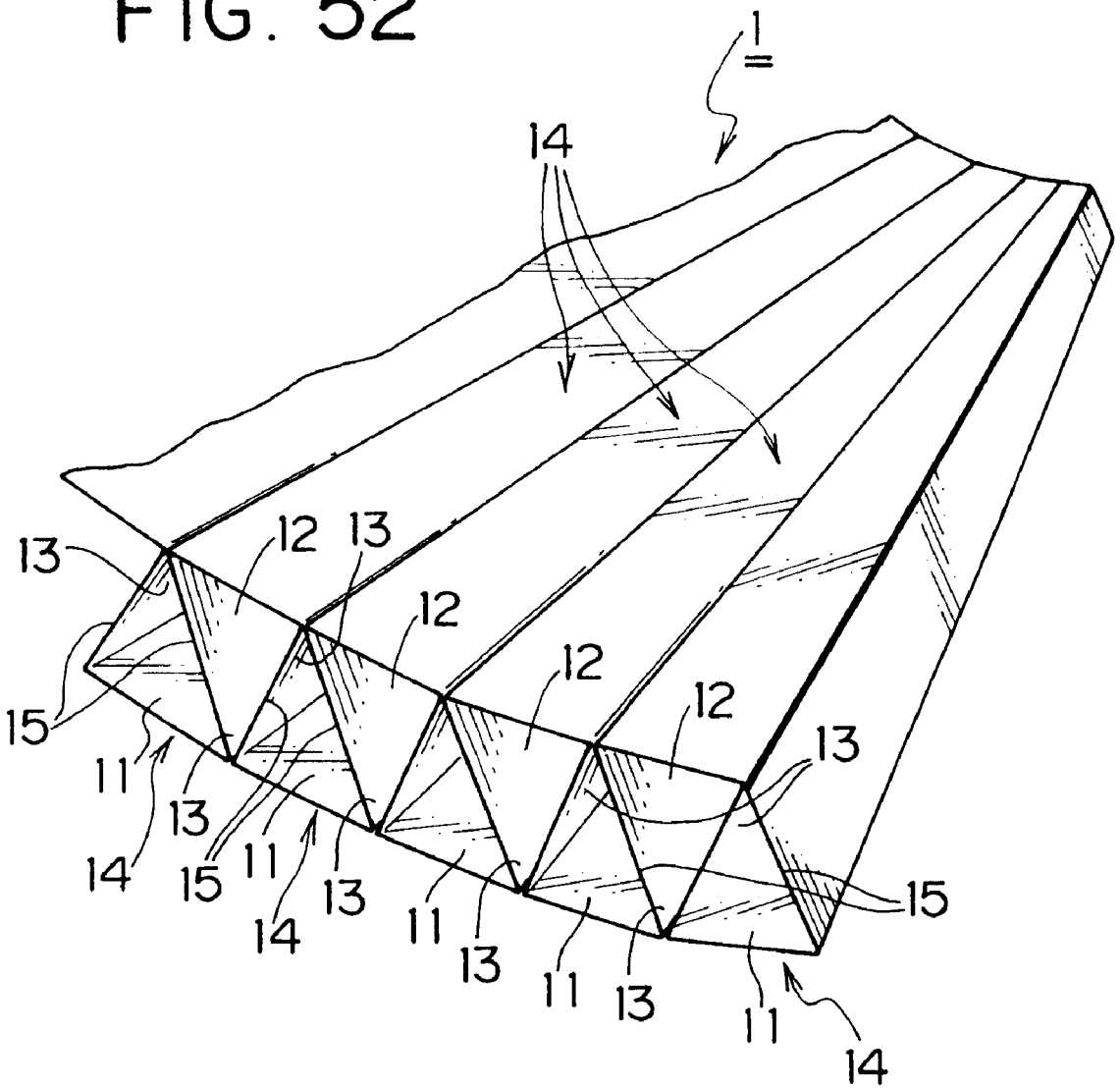
FIG. 52 is a fragmentary perspective view of a connected hollow structure in a forty-first embodiment according to the present invention.

FIG. 52 partially shows a connected hollow structure 1 in a forty-first embodiment as being formed such that a large number of first hollow structures 11 of an isosceles triangular section and of the same size and a large number of second hollow structures equal in sectional shape and size to the first hollow structures are connected together in an alternate arrangement. The connected hollow structure in this embodiment is substantially similar in end face structure of the hollow portion to the connected hollow structure in the first embodiment.

The connected hollow structure 1 has a doughnut-like or sectorial plane on the whole, since the hollow structures 11,12 as the components of the connected hollow structure 1 are formed such that their sectional size is gradually reduced from one end to the other. The connected hollow structure in this embodiment is different from the connected hollow structure 1 in the first embodiment in this respect.

(Forty-second embodiment)

Figure 53:
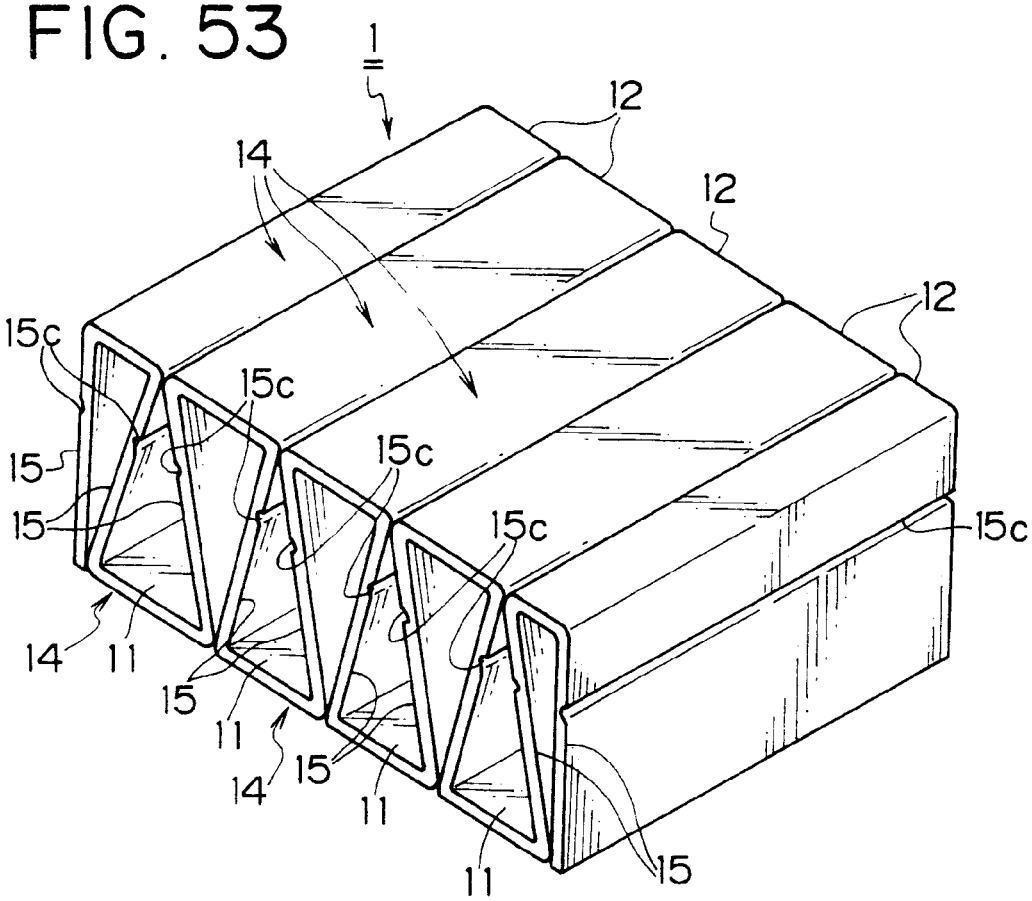
FIG. 53 is a perspective view of a connected hollow structure in a forty-second embodiment according to the present invention.

FIG. 53 partially shows a connected hollow structure 1 in a forty-second embodiment as being formed such that first hollow structures 11 of an isosceles triangular section and of the same size, other than those positioned on both ends of the connected hollow structure, and second hollow structures 12 equal in sectional shape and size to the first hollow structures are alternately arranged in alternately inverted positions. The second hollow structure 12 at each end of the connected hollow structure 1 has a right-angled triangular section so as to share in common an inclined side wall 15 of the adjacent first hollow structure 11.

A stripe of bending node 15*c* consisting of a small groove is formed at the same level position on one surface of each side wall 15 common to the hollow structures 11, 12 so as to extend in the lengthwise direction of the hollow structures 11, 12.

Figure 54:
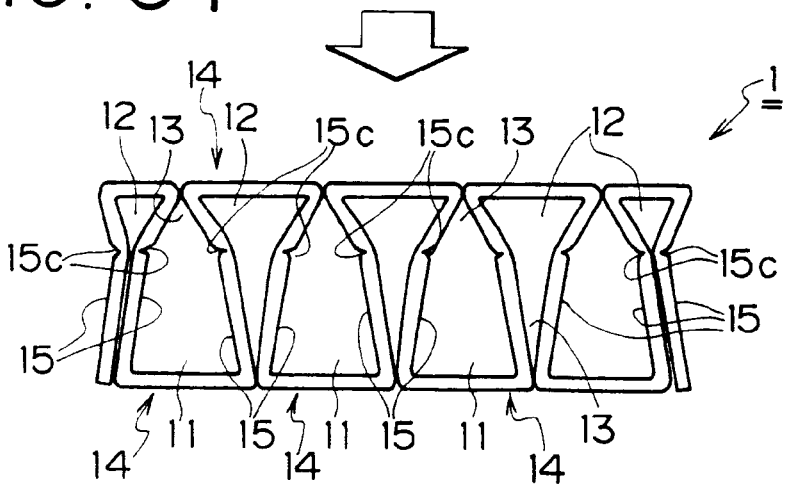
FIG. 54 is an end view of the connected hollow structure of FIG. 53, which is transformed under the action of a vertical load.

When the connected hollow structure 1 in this embodiment receives a planar force of not less than a predetermined value, the side walls 15 of the hollow structures 11, 12 are bent along the nodes 15*c* as shown in FIG. 54, and absorb such a force. Thus, in case of using the connected hollow structure 1 as a packaging member, when the packaging member is temporarily exposed to an impact in the direction indicated by a bold arrow in FIG. 54, the side walls are bent and absorb such an impact, so that the packaging member is prevented from collapsing at a stroke, and an article to be packaged is also prevented from being damaged.

When the connected hollow structure having the bending nodes 15*c* formed as the grooves on the side walls 15 as described above is exposed to a predetermined load, the side walls are bent with the grooves turned toward the inside as shown in FIG. 54, and therefore, it is possible to control the direction of bending. In the illustrated embodiment, when the side walls 15 are bent up to the maximum, portions lower than the bending nodes 15*c* of both side walls 15, 15 of the second hollow structures 12 at both ends of the connected hollow structure are overlapped with each other in a vertical position, and the vertical overlap portions bear the action of supports. Thus, the connected hollow structure, in which the side walls have been bent up to the maximum, shows extremely high withstanding strength against a planar force.

According to this embodiment, the bending nodes 15*c* are formed by forming the grooves on either surface of the side walls 15 by means of press. Otherwise, since the bending nodes attain the most part of their purpose as long as the bending nodes function as bending guides when the side walls 15 are exposed to a load of not less than a predetermined value, the bending nodes are not always formed as grooves. For instance, the side walls 15 may be bent by the bending nodes 15*c* formed by pressing the side walls 15 from both sides thereof.

Other respects of the constitution, functions and effects of the connected hollow structure in the forty-second embodiment are substantially similar to those of the connected hollow structure in the first embodiment, and hence, the description thereof will be omitted.

(Forty-third embodiment)

Figure 55:
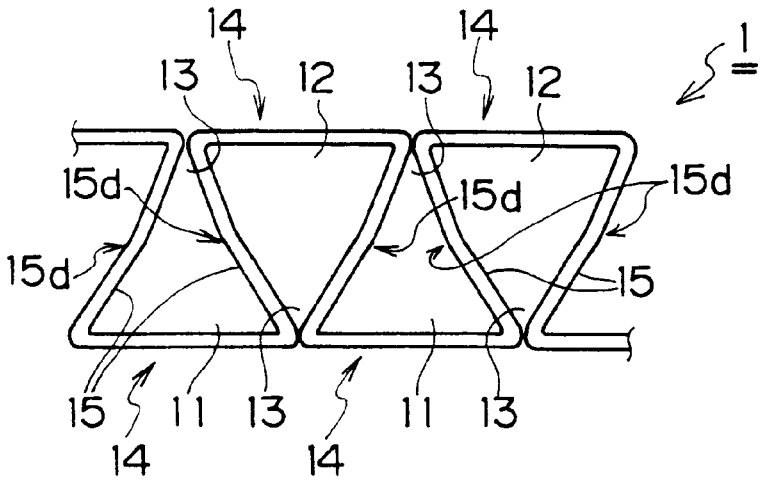
FIG. 55 is a fragmentary end view of a connected hollow structure in a forty-third embodiment according to the present invention.

FIG. 55 partially shows a connected hollow structure of a forty-third embodiment as being substantially similar in basic constitution to the connected hollow structure in the first embodiment, except that each side wall 15 common to the hollow structures 11, 12 in the forty-third embodiment has a concave portion 15*c* slightly bent toward the inner portion of the first or second hollow structure and formed at a certain level position of each side wall so as to extend in the lengthwise direction of the side wall 15.

When the connected hollow structure 1 in this embodiment is exposed to a planar force of not less than a predetermined value, the concave portions 15*c* function as a guide for bending, and the side walls 15 are bent so as to enlarge a concave angle of each concave portion 15*c* and absorb a shock caused by the planar force.

When the connected hollow structure receives a high planar force, the side walls 15 are further bent, and the portions upper than the concave portions 15*c* of the side walls 15 are overlapped with each other in a vertical position, so that the vertical overlap portions bear the action of supports. Thus, the connected hollow structure 1, in which the side walls 15 have been bent up to the maximum, shows extremely high withstanding strength against a planar force.

(Forty-fourth embodiment)

Figure 56:
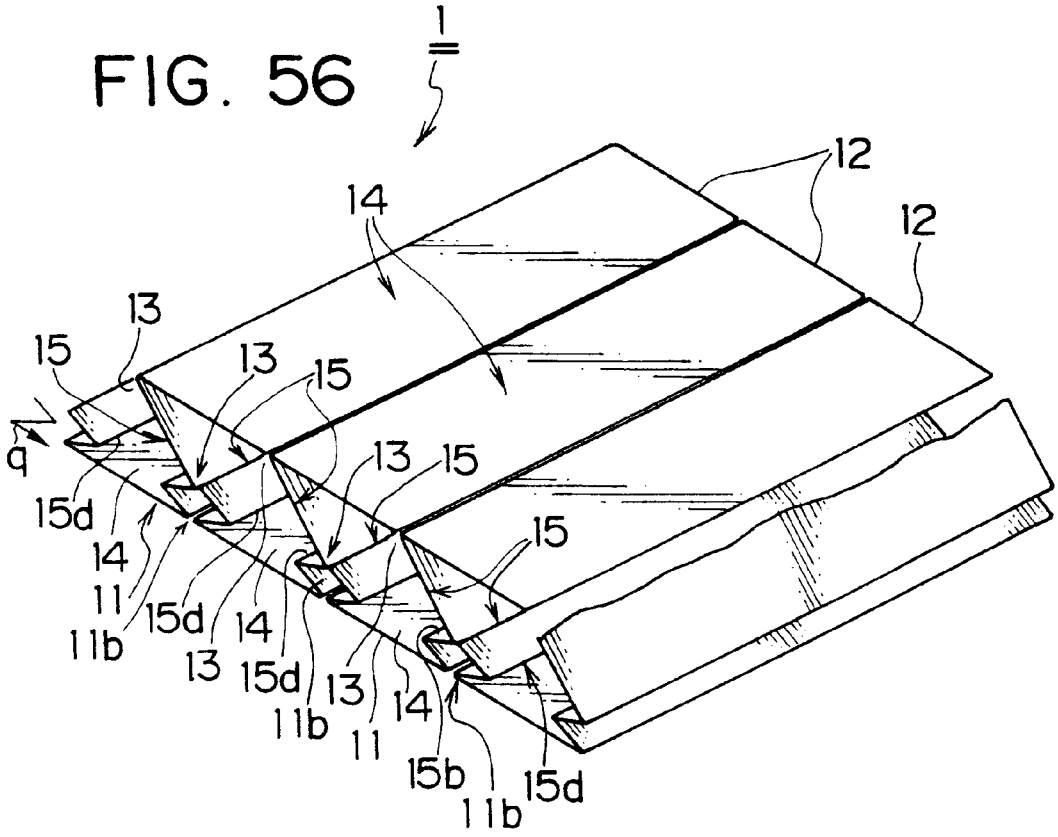
FIG. 56 is a fragmentary perspective view of a connected hollow structure in a forty-fourth embodiment according to the present invention.

FIG. 56 partially shows a connected hollow structure 1 in a forty-fourth embodiment as being composed of a large number of first hollow structures 11 of a transformed hexagonal section and of the same size a large number of second hollow structures 12 of an isosceles triangular section and placed above portions between the first hollow structures 11, 11 adjacent to each other in an inverse arrangement, and auxiliary hollow structures 11*b* of a parallelogram section and placed below the second hollow structures 12 and between the first hollow structures 11, 11 adjacent to each other.

The first hollow structures 11, 11 adjacent to each other are connected together by bonding in a portion of the corner portion 13 of each second hollow structure 12 adjacent to the upper side surfaces of the first hollow structures, and the lower-side partial circumferences 14 forming the bottom of the first hollow structures are connected together by bonding.

The upper-side partial circumferences 14 of the second hollow structures 12, 12 adjacent to each other are connected together by bonding.

The first and second hollow structures 11, 12 adjacent to each other have common side walls 15, which form each corner portion 13 of the first and second hollow structures, and the auxiliary and first hollow structures 11*b*, 11 adjacent to each other share in common all the side walls, which form each auxiliary hollow structure 11*b*.

With the constitution described above, the connected hollow structure 1 has concave portions 15*d* formed on both sides of the auxiliary hollow structures 11*b*.

The connected hollow structure 1 in the forty-fourth embodiment is fabricated as follows. Firstly, while a sheet (not shown) of a predetermined width is being delivered, convex folds and concave folds are sequentially formed on the sheet in a required order at intervals according to the size of the hollow structures 11, 11*b*, 12, and the required surface of the sheet 1 is coated with glue along the folds.

Subsequently, while the sheet is being folded along the folds to repeatedly form the hollow structures 11, the adjacent hollow structures 12 and the hollow structures 11*b* below the hollow structures 12 so as to start the folding of the sheet according to the direction as shown by an arrow q in FIG. 56, the required edges of the hollow structures 11, 12 are bonded together, and the sheet is cut.

According to the above procedure, it is possible to form the connected hollow structure 1, which is comprised of a single sheet so as to take a shape resembling a unicursal figure in section, and has no overlap portion of the sheet material of the connected hollow structure on any side surfaces of the hollow structures 11, 12, 11*b*.

The connected hollow structure 1 in this embodiment shows far lower withstanding strength against a planar force, while it shows extremely flexible elasticity, since, when the connected hollow structure 1 in this embodiment is exposed to a planar force of not less than a predetermined value, the auxiliary hollow structures 11*b* are transformed so as to be folded, namely, to enlarge the concave angle of each concave portion 15*d*, and absorb such a force.

Thus, the connected hollow structure 1 in this embodiment is suitable for use as a cushioning material for packaging, and may be suitably used for keeping or packaging linear fluorescent lamps or like articles by inserting such articles into the hollow structures 11.

Other respects of the constitution, functions and effects of the connected hollow structure 1 in the forty-fourth embodiment are substantially similar to those of the connected hollow structure in the first embodiment, and hence, the description thereof will be omitted.

(Forty-fifth embodiment)

Figure 57:
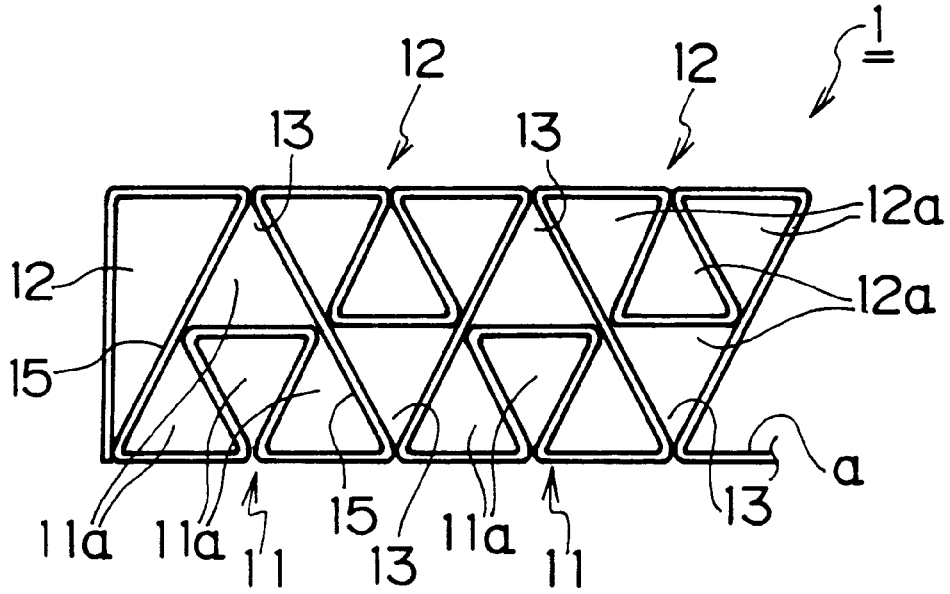
FIG. 57 is a fragmentary end view of a connected hollow structure in a forty-fifth embodiment according to the present invention.

FIG. 57 partially shows a connected hollow structure 1 in a forty-fifth embodiment as being comprised of a single sheet and is formed such that a large number of first hollow structures 11 of an isosceles triangular section and of the same size and a large number of second hollow structures 12 equal in shape an size to the first hollow structures 11 are alternately arranged in inverted positions. The second hollow structure 12 positioned at each end of the connected hollow structure has a right-angle triangular section.

The connected hollow structure 1 in this embodiment is substantially similar to the connected hollow structure in the first embodiment in the range of the above constitution.

The connected hollow structure 1 in this embodiment has four small hollow portions 11*a*, 12*a* of a rectangular equilateral triangular section respectively formed in the first and second hollow structures 12 by folding a sheet a, in a step of alternately forming the first and second hollow structures 11, 12, in alternately inverted positions, by folding the sheet a.

The connected hollow structure 1 in this embodiment is fabricated as follows. Firstly, while a sheet (not shown) of a predetermined width is being delivered, convex folds and concave folds are sequentially formed on the sheet in a required order at intervals according to the size of the first and second hollow structures 11, 12 and also the inner small hollow portions 11*a*, 12*a* of these hollow structures, and the required surface of the sheet is coated with glue along the folds.

Subsequently, while the sheet is being folded along the folds so as to repeatedly form the first hollow structures 11 including the small hollow portions 11*a*, and the second hollow structures 12 including the small hollow portions 12*a* in an alternate arrangement, the required edges of the hollow structures 11, 12 are bonded together, and the sheet is cut.

According to the above procedure, it is possible to form the connected hollow structure 1, which is comprised of a single sheet so as to take a shape resembling a unicursal figure in section, and has no overlap portion of the sheet material of the connected hollow structure on any side surfaces of the first hollow structures 11 including the small hollow portions 11*a*, and the second hollow structures 12 including the small hollow portions 12*a*.

In comparison with the connected hollow structure in the first embodiment, the connected hollow structure in the forty-fifth embodiment shows higher withstanding strength against a planar force, since the large number of hollow portions having the effect of reinforcing each other, are formed in two, i.e., upper and lower stages. Further, since the hollow portions are formed more densely, the connected hollow structure in this embodiment is suitable for use as a carrier for carrying adsorbents In addition, in case of cutting the connected hollow structure 1 in this embodiment in round slices at a predetermined pitch, a slice of the connected hollow structure is suitable for use as a core material of a heat-insulating panel or like hollow panel.

Other respects of the constitution, functions and effects of the connected hollow structure 1 in the forty-fifth embodiment are substantially similar to those of the connected hollow structure in the first embodiment, and hence, the description thereof will be omitted.

(Forty-sixth embodiment)

Figure 58:
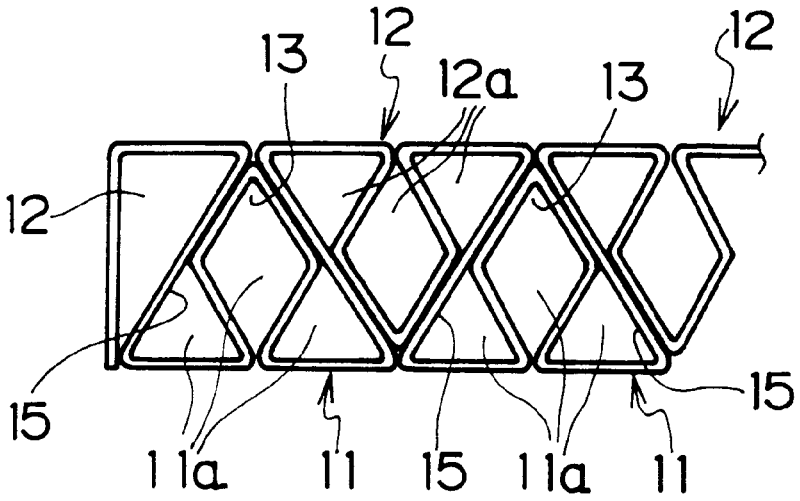
FIG. 58 is a fragmentary end view of a connected hollow structure in a forty-sixth embodiment according present invention.

FIG. 58 partially shows a connected hollow structure 1 in a forty-sixth embodiment as a modification of the connected hollow structure in the forty-fifth embodiment, and each of the first and second hollow structures 11, 12 respectively has two small hollow portions ha or 12*a* of a rectangular equilateral triangular section and a single small hollow portion ha or 12*a* of a parallelogram section.

Other respects of the constitution, functions, and effects of the connected hollow structure 1 in the forty-sixth embodiment are substantially similar to those of the connected hollow structure in the forty-fifth embodiment, and hence, the description thereof will be omitted.

(Forty-seventh embodiment)

Figure 59:
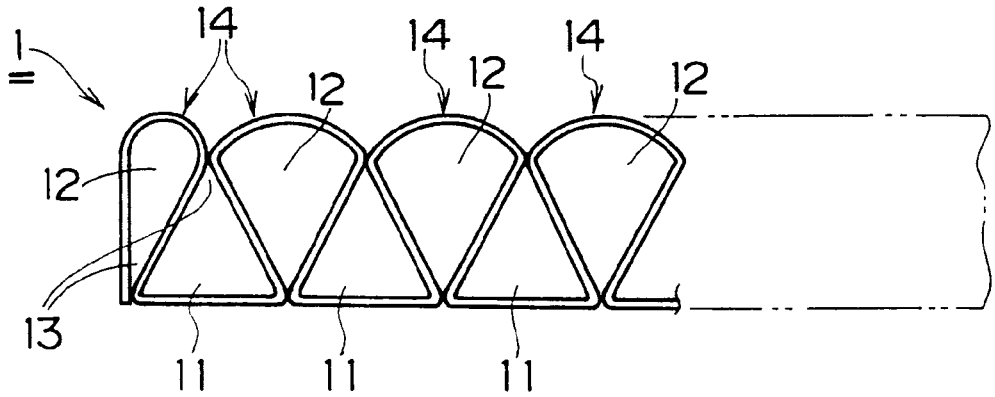
FIG. 59 is a fragmentary end view of a connected hollow structure in a forty-seventh embodiment according present invention.

FIG. 59 partially shows a connected hollow structure 1 in a forty-seventh embodiment as being formed such that the section of the partial circumference 14 of each second hollow structure 12 in the connected hollow structure in the first embodiment is modified into a partial circumference of a circular arc section so as to substantially uniformly project upwards.

According to the connected hollow structure in this embodiment formed as described above, when the connected hollow structure 1 with the left and right ends in FIG. 59 constrained is exposed to a planar force of not less than a predetermined value, the circular arc-shaped partial circumferences 14 forming the upper surface of the second hollow structures 12 are transformed and restored to absorb such a plain pressure. Thus, in comparison with a connected hollow structure in the first embodiment, the connected hollow structure in the forty-seventh embodiment better functions as a cushioning material.

Other respects of the constitution, functions and effects of the connected hollow structure 1 in the forty-seventh embodiment are substantially similar to those of the connected hollow structure in the first embodiment, and hence, the description thereof will be omitted.

(Forty-eighth embodiment)

Figure 60:
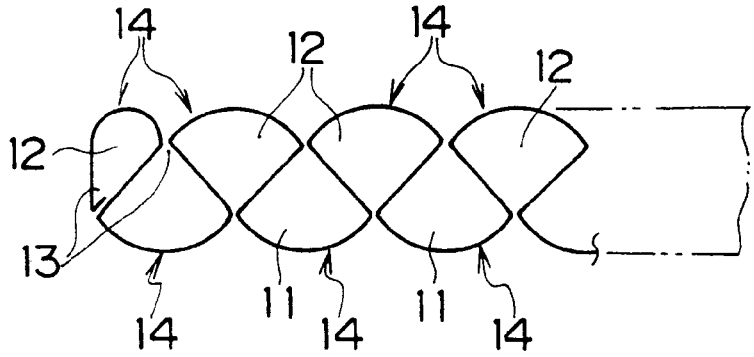
FIG. 60 is a fragmentary end view of a connected hollow structure in a forty-eighth embodiment according present invention.

FIG. 60 partially shows a connected hollow structure 1 in a forty-eighth embodiment as a modification of the connected hollow structure in the forty-seventh embodiment, and the partial circumference 14 on the lower side of each first hollow structure 11 and that of the partial circumference 14 on the upper side of each second hollow structure 12 are respectively modified into a partial circumference of a circular arc section so as to substantially uniformly project upwards and downwards, respectively.

The connected hollow structure 1 in this embodiment is superior in elasticity to the connected hollow structure in the forty-seventh embodiment, and therefore, is suitable for use as a cushioning material for an article to be packaged, since the partial circumferences 14 of the hollow structures 11, 12 project in a circular arc shape.

(Forty-ninth embodiment)

Figure 61:
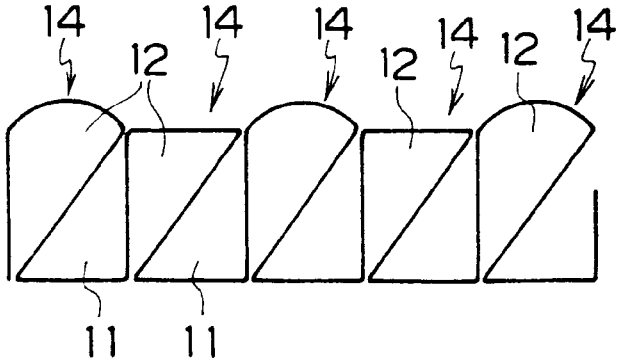
FIG. 61 is a fragmentary end view of a connected hollow structure in a forty-ninth embodiment according present invention.

FIG. 61 partially shows a connected hollow structure 1 in a forty-ninth embodiment as another modification of the connected hollow structure in the forty-seventh embodiment, and the partial circumference 14 on the upper surface of part of second hollow structures (every other second hollow structure) is modified into a partial circumference of a circular arc section 50 as to substantially uniformly project upwards.

Namely, it is possible to form the connected hollow structure 1 which shows elasticity according to the purpose as a packaging member by selecting the density of the hollow structures 11 or 12 having the partial circumferences 14 of the circular-arc section.

(Fiftieth embodiment)

Figure 62:
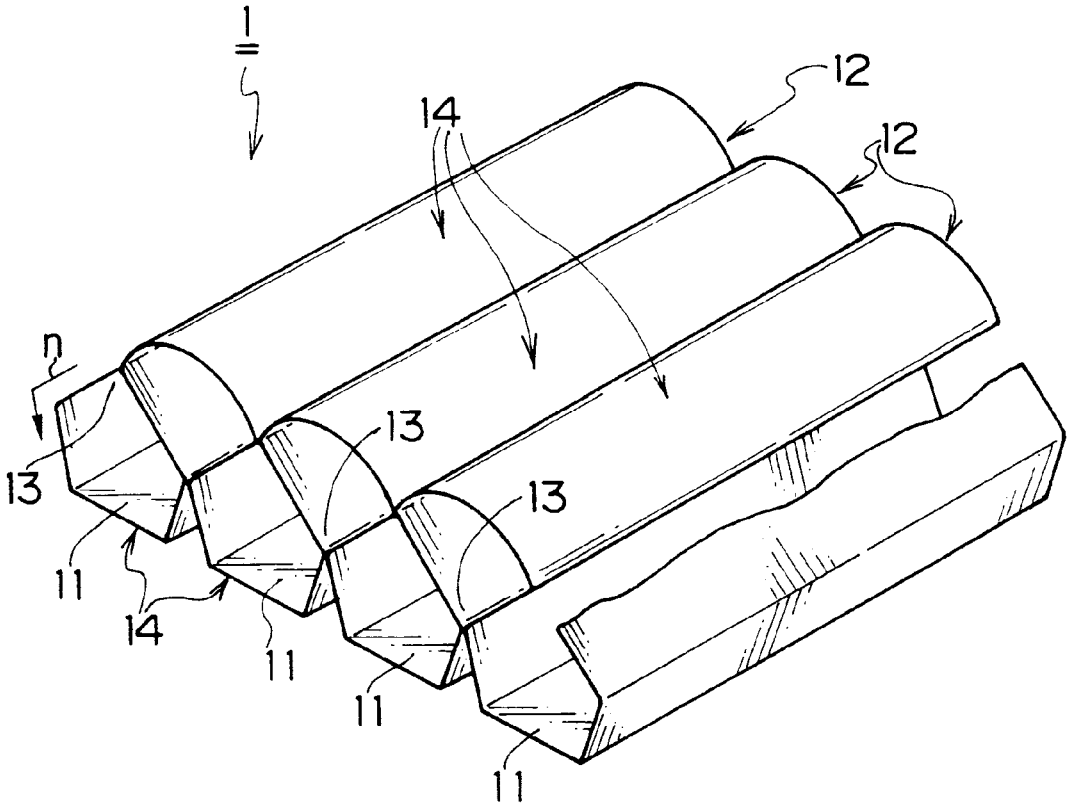
FIG. 62 is a fragmentary perspective view of a connected hollow structure in a fiftieth embodiment according to the present invention.

FIG. 62 partially shows a connected hollow structure 1 in a fiftieth embodiment as being formed such that each second hollow structure 12 in the connected hollow structure in the thirty-eighth embodiment (See FIG. 49) is modified into a hollow structure of a sectorial section as shown in FIG. 62, instead of the regular pentagonal section, and the partial circumference 14 on the upper side of each hollow structure 12 is modified into a partial circumference of a circular arc section 50 as to substantially uniformly project upwards.

The effects of the connected hollow structure 1 in this embodiment attained by forming the second hollow structures 12 having the partial circumference 14 of the circular arc section as shown in FIG. 62 are substantially similar to those of the connected hollow structure in the forty-seventh embodiment.

(Fifty-first embodiment)

Figure 63:
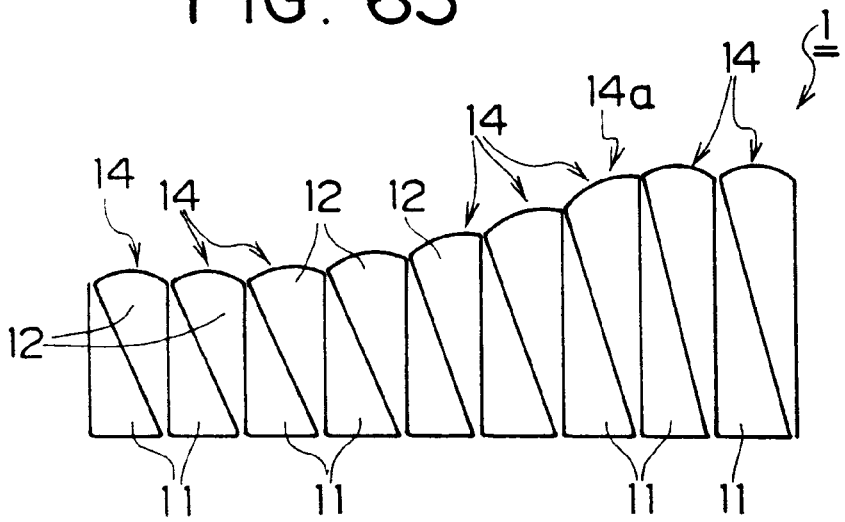
FIG. 63 is a fragmentary end view of a connected hollow structure in a fifty-first embodiment according present invention.

FIG. 63 partially shows a connected hollow structure 1 in a fifty-first embodiment as being formed such that the partial circumference 14 on the upper side of each second hollow structure 12 in the connected hollow structure in the fifteenth embodiment (See FIG. 27) is modified into a partial circumference of a circular arc section 50 as to substantially uniformly project upwards.

In comparison with the connected hollow structure in the fifteenth embodiment, the connected hollow structure 1 in the fifty-first embodiment formed as described above better functions as a cushioning material, since, when the connected hollow structure 1 with the left and right ends in FIG. 63 constrained is exposed to a planar force of not less than a predetermined value, the circular arc-shaped partial circumferences 14 forming the upper surface of the second hollow structures 12 are transformed and restored to absorb such a force.

Other respects of the constitution, functions and effects of the connected hollow structure 1 in the fifty-first embodiment are substantially similar to those of the connected hollow structure in the fifteenth embodiment, and hence, the description thereof will be omitted.

(Fifty-second embodiment)

Figure 64:
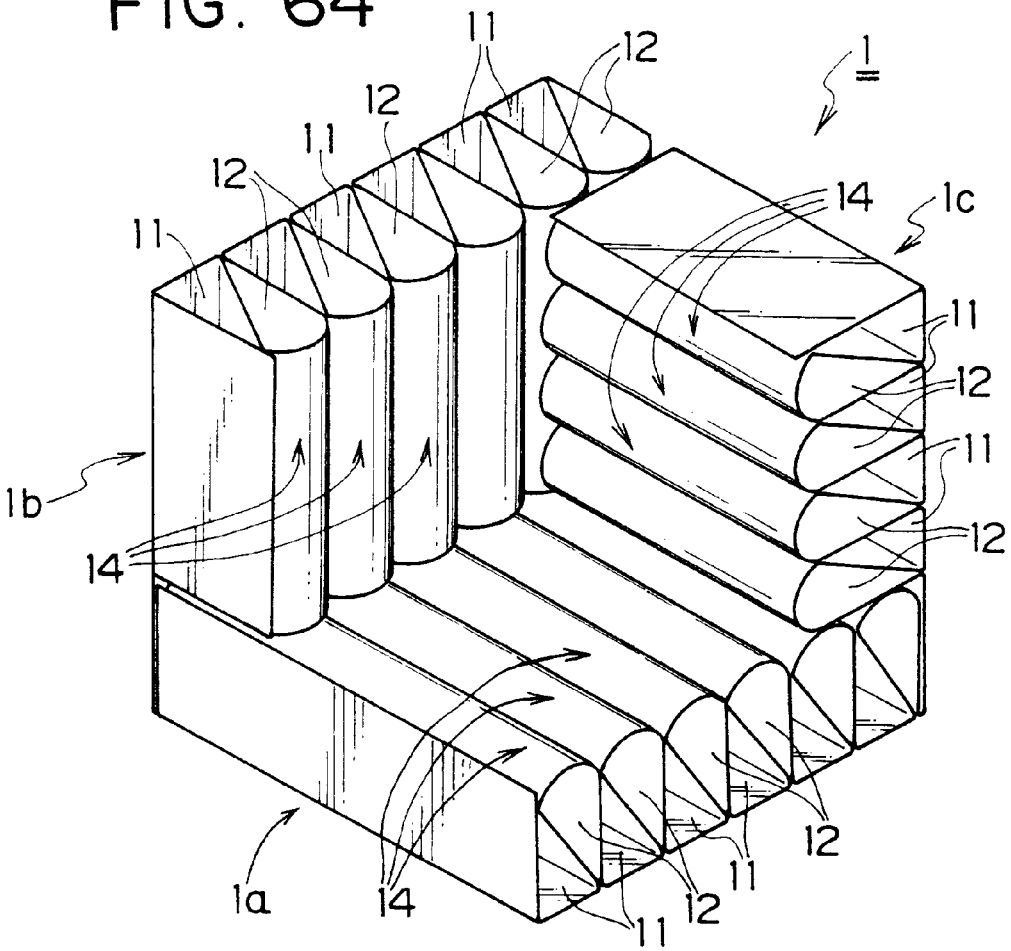
FIG. 64 is a perspective view of a connected hollow structure in a fifty-second embodiment according present invention.

FIG. 64 partially shows a connected hollow structure 1 in a fifty-second embodiment as being formed such that the partial circumference 14 of each section hollow structure 12 on the inner side of the connected hollow structure in the twelfth embodiment (See FIG. 24) is modified into a partial circumference of a circular arc section so as to substantially uniformly project toward the inside of the connected hollow structure.

In comparison with the connected hollow structure in the fifth embodiment, the connected hollow structure 1 in the fifty-second embodiment formed as described above better functions as a cushioning material, since, when the inner surface of the connected hollow structure 1 receives a force of not less than a predetermined value, the circular arc-shaped partial circumferences 14 forming the upper surface of the second hollow structures 12 are transformed and restored to absorb such a force.

(Fifty-third embodiment)

Figure 65:
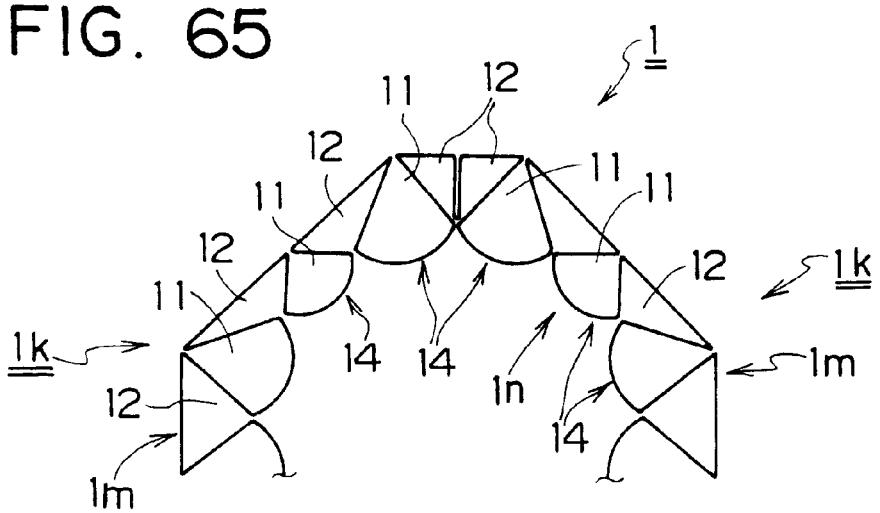
FIG. 65 is a fragmentary end view of a connected hollow structure in a fifty-third embodiment according present invention.

FIG. 65 partially shows a connected hollow structure 1 in a fifty-third embodiment as being formed such that the partial circumference 14 of each second hollow structure 12 on the inner side of the connected hollow structure 1 in the twelfth embodiment (See FIG. 24) is modified into a partial circumference of a circular arc section so as to substantially uniformly project toward the inner side of the connected hollow structure.

The connected hollow structure 1 in this embodiment formed as described above better functions as a cushioning material, since, when the connected hollow structure 1 is exposed to a load of not less than a predetermined value in the circumferential or inner peripheral direction, the circular arc-shaped partial circumferences 14 of the second hollow structures 12 are transformed and restored to absorb such a force.

(Fifty-fourth embodiment)

Figure 66:
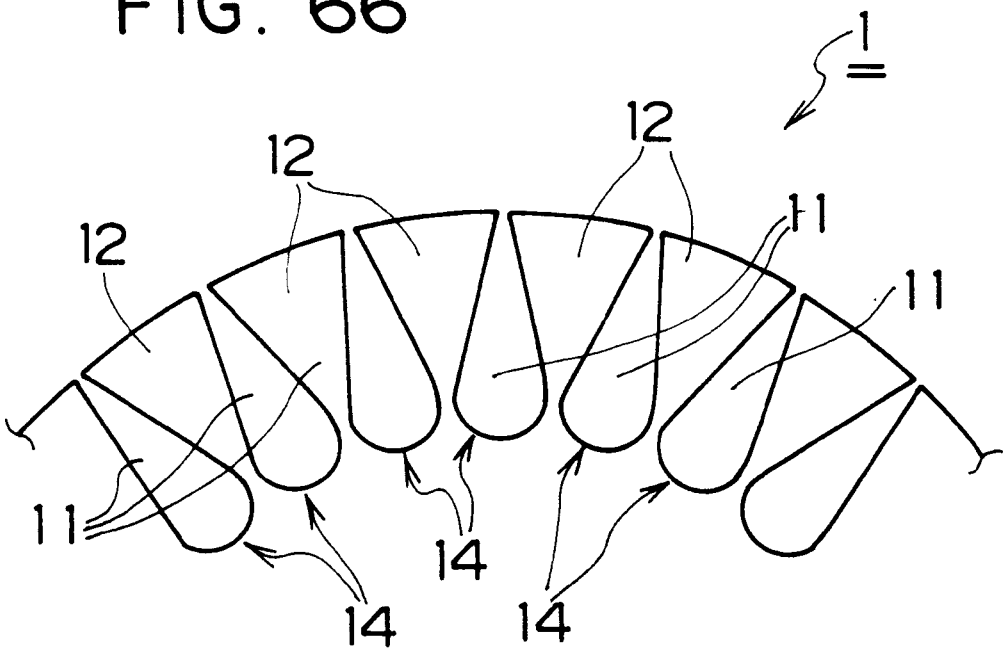
FIG. 66 is a fragmentary side view of a connected hollow structure in a fifty-fourth embodiment according present invention.

FIG. 66 partially shows a connected hollow structure 1 in a fifty-fourth embodiment as being formed such that the partial circumference 14 of each second hollow structure 12 on the inner side of the connected hollow structure in the thirteenth embodiment (See FIG. 25) is modified into a partial circumference of a circular arc section so as to substantially uniformly project toward the inner side of the connected hollow structure.

The effect of the connected hollow structure 1 in this embodiment attained by forming the second hollow structures 2 having the partial circumferences 14 of the circular arc section as shown in FIG. 66 is substantially similar to that of the connected hollow structure in the fifty-third embodiment.

(Fifty-fifth embodiment)

Figure 67:
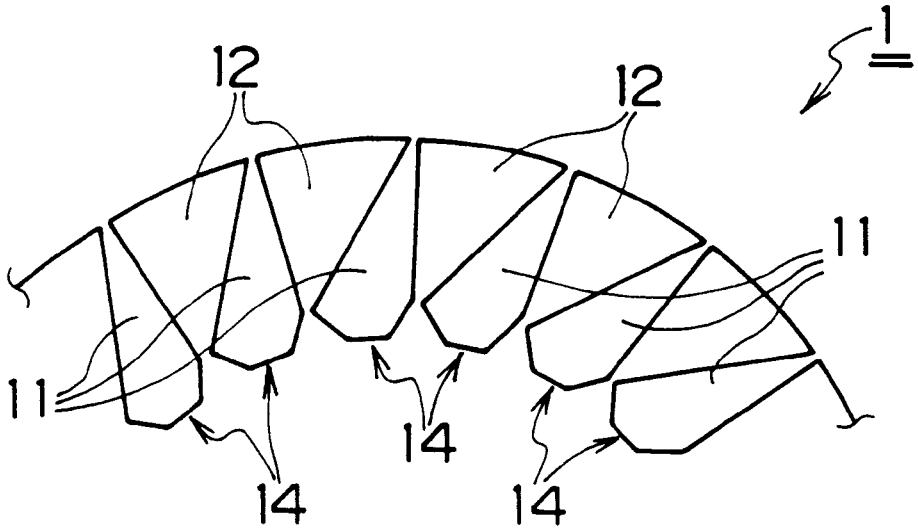
FIG. 67 is a fragmentary side view of a connected structure in a fifty-fifth embodiment according to the present invention.

FIG. 67 partially shows a connected hollow structure 1 in a fifty-fifth embodiment as being formed such that the partial circumference 14 of each second hollow structure 12 on the inner side of the connected hollow structure 1 in the fourteenth embodiment (See FIG. 26) is modified into a partial circumference of a circular arc section so as to substantially uniformly project toward the inner side of the connected hollow structure.

The effect of the connected hollow structure 1 in this embodiment attained by forming the second hollow structures 12 having the partial circumferences 14 of the circular arc section as shown in FIG. 67 is substantially similar to that of the connected hollow structure in the fifty-third embodiment.

(Fifty-sixth embodiment)

Figure 68:
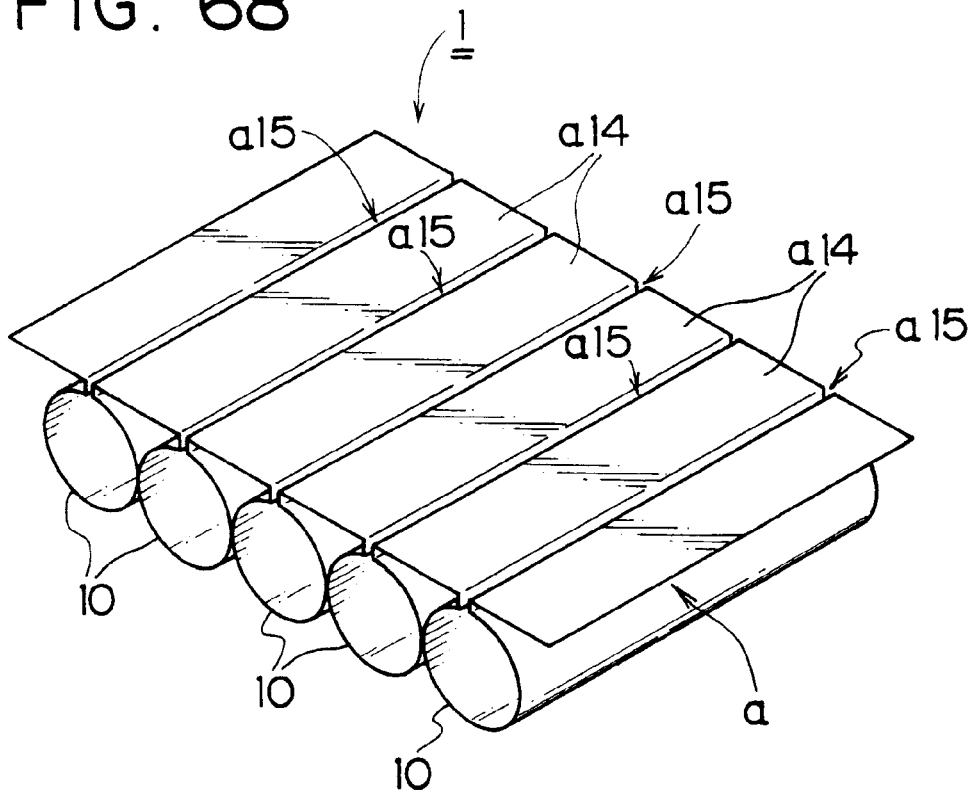
FIG. 68 is a fragmentary perspective view of a connected hollow structure in a fifty-sixth embodiment according to the present invention.

FIG. 68 shows a connected hollow structure 1 in a fifty-sixth embodiment as being composed of a large number of connecting sheet portions a14 bonded together so as to extend in parallel to each other, and a large number of cylindrical hollow structures connected together by respectively bonding circumferential portions together in the lengthwise direction in 14:7 joint portions a15 between the connecting adjacent sheet portions a14, a14.

The connected hollow structure 1 having the above-constitution is fabricated as follows. Firstly, while a sheet a (not shown) of a predetermined width is being delivered, convex (or concave) folds are sequentially formed on the sheet a so as to extend in the transverse direction of the sheet a according to the sectional peripheral length of each hollow structure and the width of each connecting sheet portion a14, and the fold portions of the sheet are coated with glue.

Subsequently, while the sheet a is being rounded into cylindrical portions from the leading end of the sheet along the folds, the folds corresponding to the joint portions a15 forming the joints of the cylindrical portions are bonded together. When the connected hollow structure 1 thus fabricated reaches a predetermined length, the sheet, which is being delivered, is cut.

According to the above procedure, it is possible to form the connected hollow structure 1, which is comprised of a single sheet so as to take a shape resembling a unicursal figure in section, and has no overlap portion of the sheet material of the connected hollow structure, other than the joint portions a15.

The connected hollow structure 1 in this embodiment shows far lower withstanding strength against a planar force, while it shows extremely flexible elasticity, since, when the connected hollow structure receives a planar force of not less than a predetermined value, the hollow structures are transformed so as to become flat, and absorb such a force.

Thus, the connected hollow structure in this embodiment is suitable for use as a cushioning material for packaging, and may be suitably used for keeping or packaging linear fluorescent lamps or like articles by inserting such articles into the hollow structures 10.

Since the cylindrical hollow structures 10 are transformed by a relatively small external force, the connected hollow structure 1 in the state shown in FIG. 68 may be rounded, for instance, in a cylindrical shape with the hollow structures 10 positioned along the inner surface. Thus, such a cylindrical connected hollow structure 1 is suitable for use as a frame structure for encasing bottles or like articles.

When a corrugated fiberboard is used for forming the connected hollow structure 1 in this embodiment, the folds are preferably formed in parallel to flutes of the corrugated fiberboard. Further, the hollow structures 10 preferably have a cylindrical or elliptical section.

(Fifty-seventh embodiment)

Figure 69:
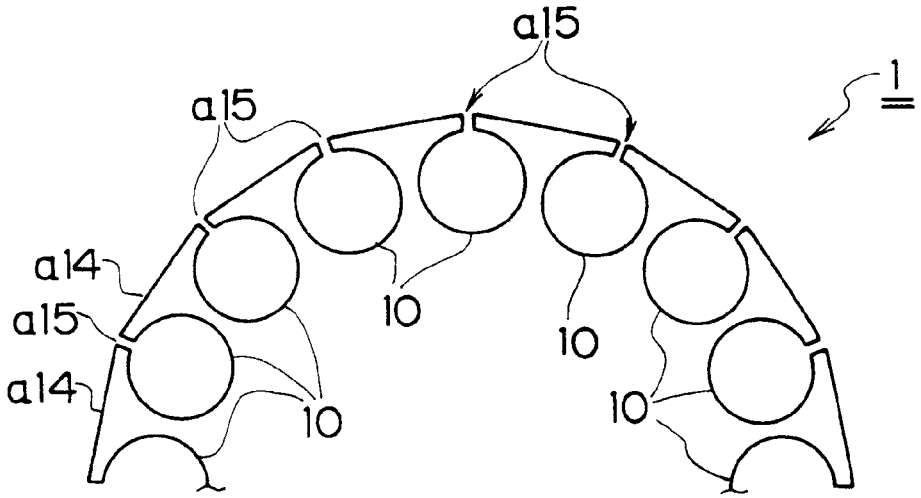
FIG. 69 is a fragmentary side view of a connected hollow structure in a fifty-seventh embodiment according to the present invention.

FIG. 69 partially shows a connected hollow structure 1 in a fifty-seventh embodiment as a modification of the connected hollow structure in the fifty-sixth embodiment, and is designed such that the hollow structures 10 are formed at slightly wider intervals (i.e., the connecting sheet portions a15 are formed to be slightly wider). Thus, the connected hollow structure 1 in this embodiment has a cylindrical shape overall with the hollow structures 10 lined up along the inner surface such that the hollow structures 10 are spaced slightly, after the connecting sheet portions a15 and the hollow structures 10 have been formed as one body.

The cylindrical or elliptical hollow structures 10 are easily transformed when receiving an external force, and therefore, show preferable effects from the viewpoint of cushioning properties, since, when the connected hollow structure 1 in this embodiment is used as a packaging frame structure for encasing bottles or like articles by inserting such bottles into the connected hollow structure 1 such that the hollow structures 10 are slightly compressed by the bottles in the circumferential direction, the bottles remain held at all times by the action of a predetermined elastic force.

When a corrugated fiberboard is used for forming the connected hollow structure 1 in this embodiment, the folds are preferably formed in parallel to flutes of the corrugated fiberboard.

(Fifty-eighth embodiment)

Figure 70:
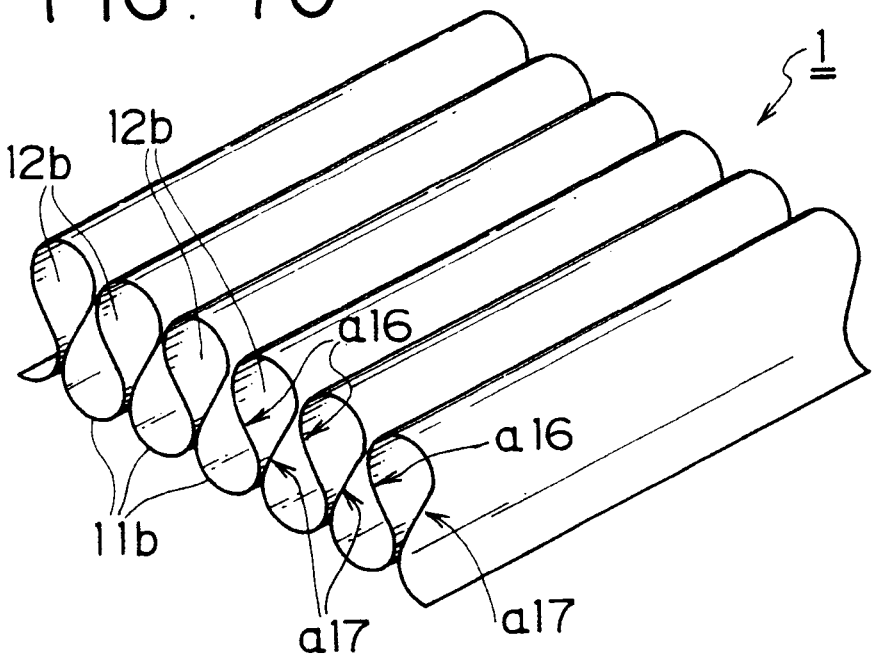
FIG. 70 is a fragmentary perspective view of a connected hollow structure in a fifty-eighth embodiment according to the present invention.

FIG. 70 partially shows a connected hollow structure in a fifty-eighth embodiment as being composed of a large number of mutually adjacent hollow structures 10 connected together, and the hollow structures 10 include first hollow structures 10 lib of a substantially drop-shaped section and second hollow structures 12*b* of a substantially inverse drop-shaped section.

The first and second hollow structures 11*b*, 12*b* are formed in an alternate arrangement by processing a sheet so as to sequentially form portions a16 of the sectional shape of a letter S and portions a17 of the sectional shape of an inverse letter S in an alternate arrangement, and then connecting together the side of each portion 16*a* of the sectional shape of the letter S with the side of the adjacent portion a17 of the sectional shape of the inverse letter S.

Since the connected hollow structure 1 in this embodiment is comprised of a single sheet so as to take the shape resembling a unicursal figure in section, and has no overlap of the sheet material in the connected hollow structure, other than the joint portions between each portion of the sectional shape of the letter S and the adjacent portion of the sectional shape of the inverse letter S, the apparent specific gravity of this connected hollow structure is extremely small.

The connected hollow structure 1 in this embodiment shows extremely low withstanding strength against a planar force, while it shows extremely flexible elasticity, since, when the hollow structures 11*b*, 12*b* receive an external force, the hollow structures 11*b*, 12*b* are transformed and absorb such a force.

Thus, the connected hollow structure 1 in this embodiment is suitable for use as a cushioning material for packaging, and may be suitably used for keeping or packaging linear fluorescent lamps or like articles by inserting such articles into the hollow structures 11*b*, 12*b*.

The connected hollow structure in this embodiment may be also used for packaging bottles or like articles having a cylindrical portion by rounding this connected hollow structure into a cylindrical shape with the hollow structures 11*b* or 12*b* turned toward the inner side, since the hollow structures 11*b*, 12*b* are easily transformed by receipt of an external force.

When a corrugated fiberboard is used for forming the connected hollow structure 1 in this embodiment, the folds are preferably formed in parallel with the flutes of the corrugated fiberboard.

Other functions and effects of the connected hollow structure 1 in the fifty-eighth embodiment are substantially similar to those of the connected hollow structure in the first embodiment, and hence, the description thereof will be omitted.

(Fifty-ninth embodiment)

Figure 71:
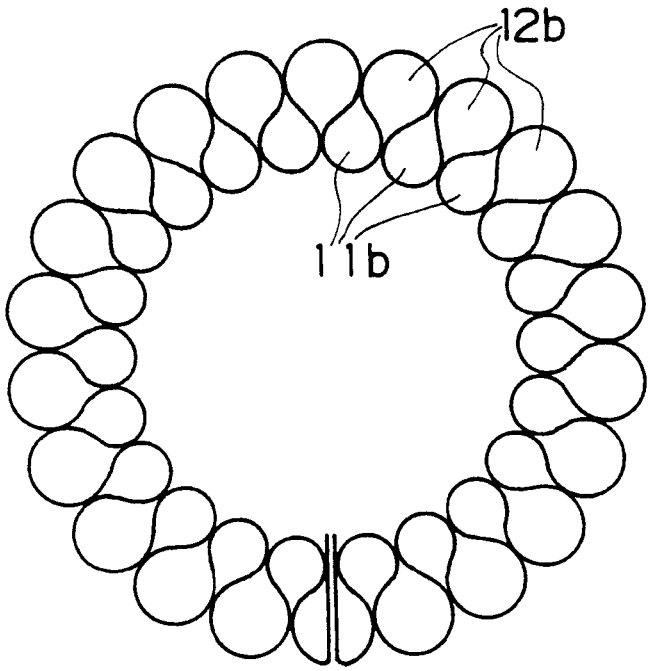
FIG. 71 is a side view of a connected hollow structure in a fifty-ninth embodiment according to the present invention.

FIG. 71 shows a connected hollow structure 1 in a fifty-ninth embodiment as basically similar to the connected hollow structure in the fifty-eighth embodiment, except that the connected hollow structure in the fifty-ninth embodiment has a cylindrical shape overall and the second hollow structures 12*b* of this connected hollow structure are smaller in peripheral length than the first hollow structures 11*b*.

The connected hollow structure 1 in this embodiment shows extremely flexible elasticity, since, when the connected hollow structure 1 receives an external force, the hollow structures 11*b*, 12*b* are transformed and absorb such a force.

The connected hollow structure 1 in this embodiment is suitably used for packaging bottles or like articles having a cylindrical portion by inserting such articles into the connected hollow structure, or keeping or packaging linear fluorescent lamps or like articles by inserting such articles into the connected hollow structure.

Other functions and effects of the connected hollow structure in the fifty-ninth embodiment are substantially similar to those of the connected hollow structure in the fifty-eighth embodiment, and hence, the description thereof will be omitted.

(Sixtieth embodiment)

Figure 72:
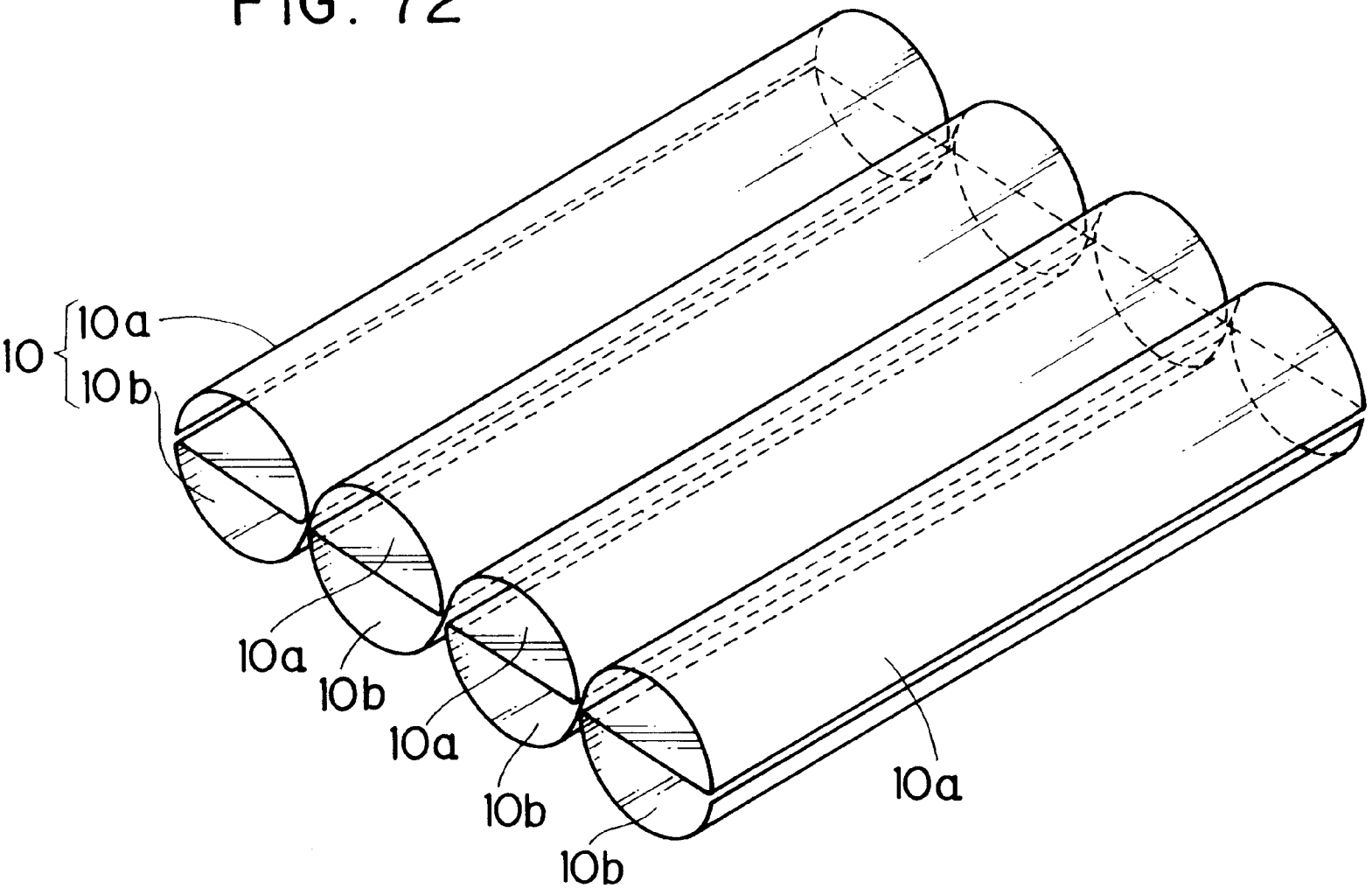
FIG. 72 is a fragmentary perspective view of a connected hollow structure in a sixtieth embodiment according to the present invention.

FIG. 72 shows a connected hollow structure 1 in a sixtieth embodiment as being formed such that a large number of hollow structures 10, each formed by symmetrically combining a first hollow portion 10*a* of an angular section and a second hollow portion 10*b* of an inverse angular section, are arranged densely in parallel to each other, and the hollow structures adjacent to each other are connected together in shape of a letter S or an inverse letter S in section.

The first hollow portions 10*a* in this embodiment have a semicircular section, and the second hollow portions 10*b* have a semicircular section reverse to that of the first hollow portions 10*a*.

The connected hollow structure 1 in this embodiment is suitable for use as a packaging member as a cushioning material for articles to be packaged, and as other packaging members for protecting linear fluorescent lamps or like rod-shaped or cylindrical articles by inserting such articles into the hollow portions 10*a*, 10*b*, since the hollow structures 10 including the hollow portions 10*a*, 10*b* show flexible elasticity.

Further, when the connected hollow structure 11 having more hollow structures 10 is rounded into a cylindrical shape, the hollow portions positioned on the cylindrically inner surface are compressively transformed to easily form a cylindrical connected hollow structure. Thus, such a cylindrical connected hollow structure is suitable for use as a packaging member for protecting bottles or like articles to be packaged.

Incidentally, when a corrugated fiberboard is used as a sheet for forming the connected hollow structure, the hollow structures are preferably formed in parallel to flutes of the corrugated fiberboard (not shown).

(Sixty-first embodiment)

Figure 73:
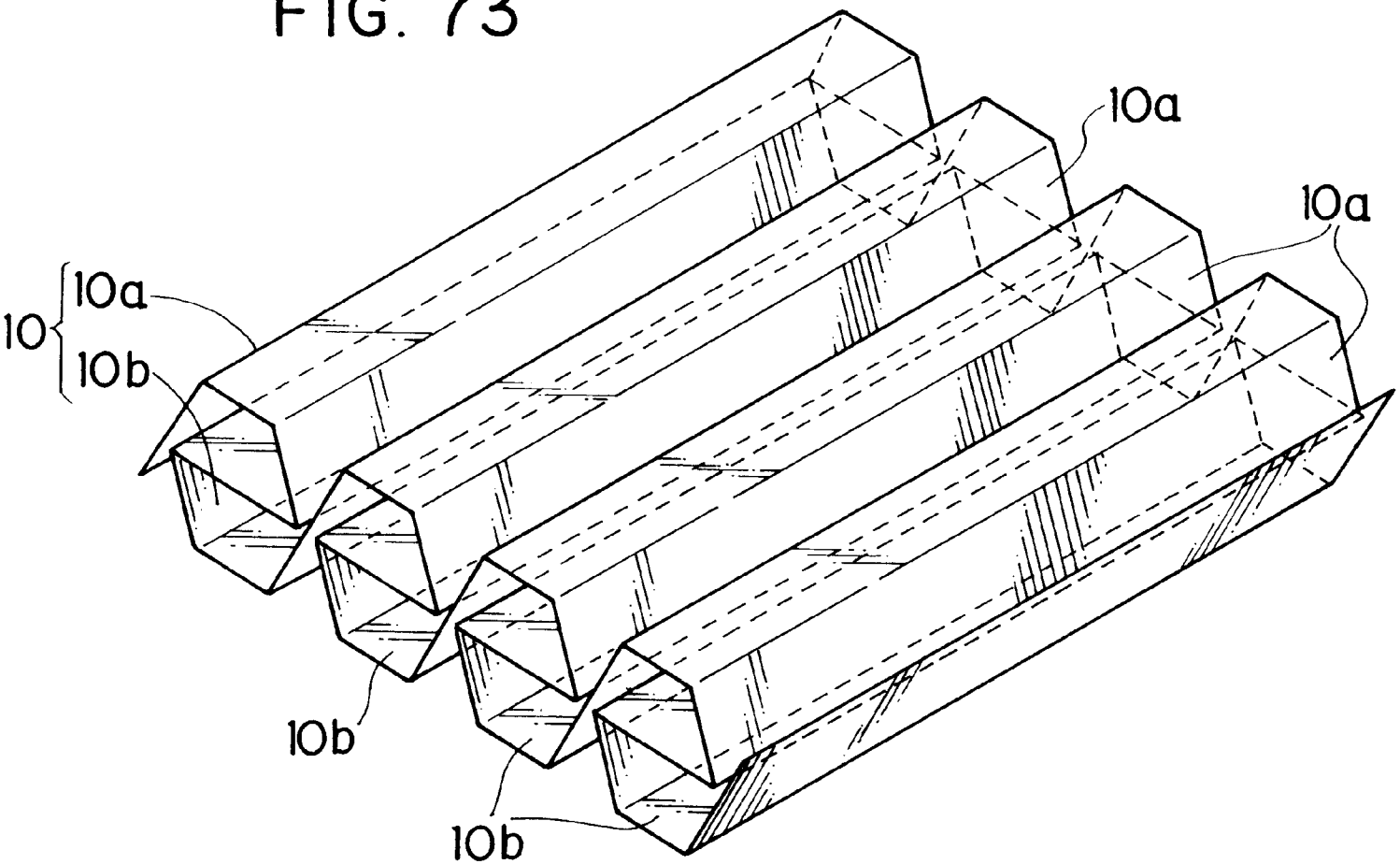
FIG. 73 is a fragmentary perspective view of a connected hollow structure in a sixty-first embodiment according to the present invention.

FIG. 73 shows a connected hollow structure 1 in a sixty-first embodiment as being formed such that the first and second hollow portions 10*a*, 10*b* included in the hollow structures in the connected hollow structure in the sixtieth embodiment are respectively modified into hollow portions of a trapezoidal section and an inverse trapezoidal section.

The other respects of the constitution, functions and effects of the connected hollow structure 1 in the sixty-first embodiment are substantially similar to those of the connected hollow structure in the sixtieth embodiment, and hence, the description thereof will be omitted.

(Sixty-second embodiment)

Figure 74:
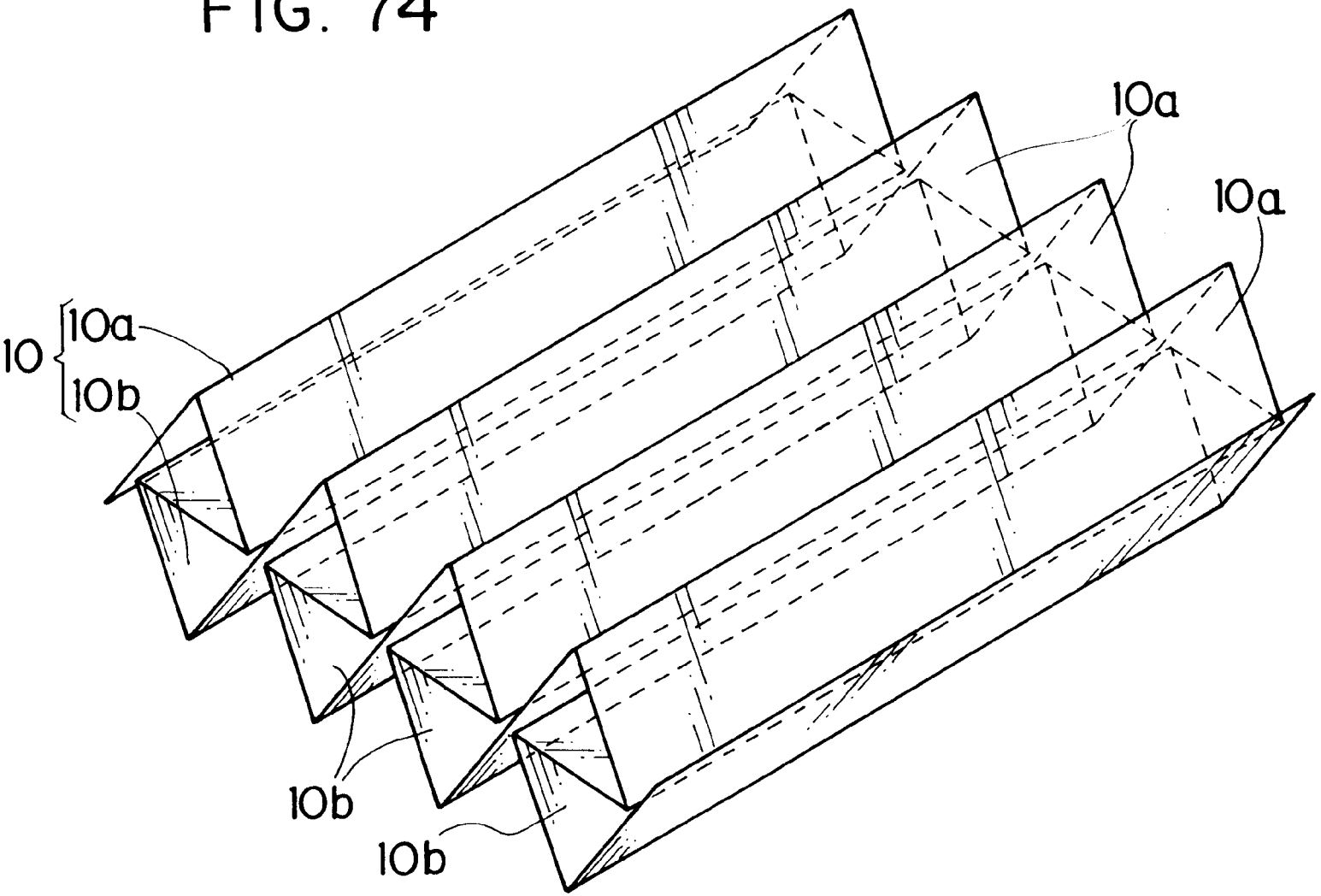
FIG. 74 is a fragmentary perspective view of a connected hollow structure in a sixty-second embodiment according to the present invention.

FIG. 74 shows a connected hollow structure 1 in a sixty-second embodiment as being formed such that the first and second hollow portions 10*a*, 10*b* included in the hollow structures in the connected hollow structure in the sixtieth embodiment are respectively modified into hollow portions of a triangular section and an inverse triangular section.

Other respects of the constitution, functions and effects of the connected hollow structure 1 in the sixty-second embodiment are substantially similar to those of the connected hollow structure in the sixtieth embodiment, and hence, the description thereof will be omitted.

(Other embodiments)

In the connected hollow structure 1 in the twenty-fourth embodiment as shown in FIG. 36 according to the present invention, the second hollow structures 12 may have a quadrangular (parallelogram) section, instead of a triangular section. The connected hollow structure having the second hollow structures 12 of the quadrangular section as described above forms a connected hollow structure.

In the connected hollow structure 1 in the OS twelfth embodiment as shown in FIGS. 23 and 24, and that in the thirteenth embodiment as shown in FIG. 25 according to the present invention, the partial circumference 14 of each first hollow structure 11 maybe composed of a plurality of substantially uniformly projecting side surfaces, similarly to the partial circumference 14 of each first hollow structure 11 in the connected hollow structure 1 shown in FIG. 67, for instance.

In the connected hollow structure 1 in the fifteenth embodiment as shown in FIG. 27, that in the thirty-second embodiment as shown in FIG. 43 and that in the thirty-third embodiment as shown in FIG. 44 according to the present invention, the partial circumference 14 of each second hollow structure 12 may be composed of a plurality of substantially uniformly projecting side surfaces, similarly to the partial circumference 14 of each second hollow structure 12 in the connected hollow structure 1 as shown in FIGS. 46 and 47, for instance.

In the connected hollow structure 1 in the sixteenth embodiment as shown in FIG. 28 according to the present invention, the partial circumference 14 of each second hollow structure may be composed of a plurality of substantially uniformly projecting side surfaces, similarly to the partial circumference 14 of each second hollow structure 12 in the connected hollow structure 1 as shown in FIGS. 46 and 47, for instance.

(Capability of Industrial Utilization)

The connected hollow structure and packaging member according to the present invention is useful as a protection frame structure for packaging, a cushioning material for packaging, a carrying tray, a core material for a heat-insulating panel or other hollow panels, a wall material, a pallet and a carrier for carrying adsorbents.

What is claimed is:

1. A corrugated sheet packaging material formed of a single paper or corrugated fiberboard sheet folded into an array of alternating first and second hollow structures extending parallel to the folds in a longitudinal direction, said sheet packaging material having first and second opposing surfaces;

wherein each of said first and second hollow structures has at least first, second and third side walls joined at corners to define a closed polygon in cross-section perpendicular to the longitudinal direction;

wherein each of said first hollow structures has its first and second side walls meeting at one of said corners and at least in part shared in common with adjacent second hollow structures, said third side walls of said first hollow structures being connected together to form said first opposing surface and said one corner being located at said second opposing surface;

wherein each of said second hollow structures has its first and second side walls meeting at a second of said corners and at least in part shared in common with adjacent first hollow structures, said third side walls of said second hollow structure being connected together to form said second opposing surface and said second corners being located at said first opposing surface; and wherein at least a portion of said third sides of said second hollow structures are convex circular arcs forming protuberances at said second opposing surface.

2. A corrugated sheet packaging material according to claim 1 wherein said first and second opposing surfaces are parallel so that said corrugated sheet packaging material has a substantially uniform thickness.

3. A corrugated sheet packaging material according to claim 1 wherein said first and second opposing surfaces gradually diverge in a direction perpendicular to said longitudinal direction.

4. A corrugated sheet packaging material according to claim 1 wherein said first opposing surface is planar.

5. A corrugated sheet packaging material according to claim 1 wherein at least a portion of said third sides of said first hollow structures are convex circular arcs forming protuberances at said first opposing surfaces.

6. A corrugated sheet packaging material according to claim 1 wherein said third side walls and fourth side walls of said first hollow structures extend beyond said second corners to form protuberances on said first opposing surface.

7. A corrugated sheet packaging material formed of a single paper or corrugated fiberboard sheet folded into an array of alternating first and second hollow structures extending parallel to the folds in a longitudinal direction, said sheet packaging material having first and second opposing surfaces;

wherein each of said first and second hollow structures has side walls joined at corners to define closed polygons in cross-section perpendicular to the longitudinal direction;

wherein each of said first hollow structures has a pair of said side walls meeting at one of said corners and shared in common with adjacent second hollow structures, said one corner defining said first opposing surface; and wherein each of said second hollow structures has first and second of said side walls meeting at a second of said corners and shared in common with adjacent first hollow structures and at least third and fourth of said side walls extending from said first opposing surface to form protuberances thereon.

8. A corrugated sheet packaging material according to claim 7 wherein each of said first hollow structures has an additional one of said side walls opposite said one corner, said additional side walls being joined together to form said second opposing surface as a planar surface.

9. A corrugated sheet packaging material according to claim 7 wherein said third and fourth side walls join at one of said corners.

10. A corrugated sheet packaging material according to claim 7 wherein each of said second hollow structures has a fifth of said side walls joining said third and fourth side walls.

11. A corrugated sheet packaging material according to claim 7 wherein said second corners define said second opposing surface and wherein each of said first hollow structures has at least two additional side walls extending from said second opposing surface to form protuberances thereon.

12. A corrugated sheet packaging material according to claim 11 wherein said first and second hollow structures are square, rectangular or hexagonal in cross-section.

13. A corrugated sheet packaging material according to claim 7 wherein said first and second opposing surfaces are parallel so that said corrugated sheet packaging material has a substantially uniform thickness.

14. A corrugated sheet packaging material formed of a single paper or corrugated fiberboard sheet folded into an array of alternating first and second hollow structures extending parallel to the folds in a longitudinal direction, said sheet packaging material having first and second opposing surfaces;

wherein each of said first and second hollow structures has at least first, second and third side walls joined at corners to define a closed polygon in cross-section perpendicular to the longitudinal direction;

wherein each of said first and second hollow structures has its first and second side walls meeting at one of said corners and at least in part shared in common with adjacent ones of said hollow structures;

wherein third side walls of said first hollow structures are connected together to form said first opposing surface and third side walls of said second hollow structures are connected together to form said second opposing surface; and wherein each of said first and second side walls has a bending node formed therein for bending of said first and second walls at said bending node responsive to application of a force on said opposing surfaces.

15. A corrugated sheet packaging material according to claim 14 wherein the closed polygon of the cross-section of each of said first and second hollow structures is a triangle and wherein said first and second opposing surfaces are parallel so that said corrugated sheet packaging material has a substantially uniform thickness.

16. A corrugated sheet packaging material according to claim 14 wherein said bending node is a groove formed in said first and second side walls and extending in the longitudinal direction.

17. A corrugated sheet packaging material according to claim 14 wherein said bending node is a bend formed in said first and second side walls and extending in the longitudinal direction.

18. A corrugated sheet packaging cylinder having exterior and interior cylindrical surfaces and formed of a single paper or corrugated fiberboard sheet folded to form first and second hollow structures arranged alternating around the circumference of the cylinder, said hollow structures extending parallel to the central axis of the cylinder in a longitudinal direction, wherein each of said first hollow structures has side walls joined at corners to define a closed polygon in cross-section perpendicular to the longitudinal direction, said side walls including a pair of side walls meeting at one of said corners and shared in common with said second hollow structures;

wherein each of said second hollow structures has side walls joined at corners to define a closed polygon in cross-section perpendicular to the longitudinal direction; and wherein first side walls of said first hollow structures together define the interior cylindrical surface as having a cross-section which is polygonal and close to circular and first side walls of said second hollow structures together define the exterior cylindrical surface as having a cross-section which is square with chamfered corners.

19. A corrugated sheet packaging cylinder according to claim 18 wherein said polygons are different triangles and wherein said first side walls are bases of said triangles.

20. A corrugated sheet packaging cylinder according to claim 19 wherein the bases of the triangles of said first hollow structures are convex circular arcs forming protuberances on said inner cylindrical surface.

21. A corrugated sheet packaging cylinder according to claim 18 wherein said side walls of said first hollow structures include additional side walls extending from said inner polygonal cylindrical surface to form protuberances thereon.

22. A corrugated sheet packaging cylinder according to claim 18 wherein said first side walls of said first hollow structures are convex circular arcs forming protuberances on said inner cylindrical surface.

23. A corrugated sheet packaging cylinder according to claim 22 wherein said first side walls of said second hollow structures are connected together.

24. A corrugated sheet packaging cylinder formed of a single sheet of paper or corrugated fiberboard folded into an array of parallel hollow structures which are circular or ellipsoidal in cross-section and which extend in parallel along one dimension of corrugated sheet packaging material, with intervening sections of said sheet joining said hollow structures together and defining one surface of said corrugated packaging material.

25. A corrugated packaging material according to claim 24 formed into a cylinder having said one surface as its external surface.

26. A corrugated packaging material formed of a single sheet of paper or corrugated fiberboard folded into a parallel array of alternating first and second hollow structures having a closed drop-shaped cross-section and sharing side wall portions in common, adjacent first hollow structures being attached at points of maximum dimension across said drop-shaped cross-section and adjacent second hollow structures being attached at points of maximum dimension across said drop-shaped cross-section.

27. A corrugated packaging material according to claim 26 formed into a cylinder.

28. A corrugated packaging material formed of a sheet of paper or corrugated fiberboard folded into an array of parallel hollow structures with a fold of said sheet bisecting each of said hollow structures into two symmetrical sections.

29. A corrugated packaging material according to claim 28 wherein said symmetrical sections are semicircular, trapezoidal or triangular in cross-section.

30. A channel-shaped corrugated packaging material formed as a sheet of paper or corrugated fiberboard folded into parallel and alternating first and second hollow structures extending in a longitudinal direction, said hollow structures arranged to form a pair of parallel side members connected by a planar member;

wherein each of said first and second hollow structures has side walls joined at corners to define a closed polygon in cross-section perpendicular to the longitudinal direction;

wherein each of said first hollow structures has a pair of said side walls meeting at one of said corners and at least in part shared in common with adjacent second hollow structures; and wherein each of said second hollow structures has first and second of said side walls meeting at a second of said corners and at least in part shared in common with adjacent first hollow structures.

31. A channel-shaped corrugated sheet packaging material according to claim 30 wherein said parallel side members have chamfered edges sloping inwardly toward said planar member.

32. A corrugated packaging material formed of a single sheet of paper or corrugated fiberboard folded into plural linear arrays of parallel alternating first and second hollow structures extending in a longitudinal direction, one of said plural arrays forming a bottom planar member, a second of said plural arrays forming a first side member extending at a right angle from said bottom planar member and a third of said plural arrays forming a second side member extending at a right angle from said bottom planar member and at a right angle from said first side member;

wherein said bottom planar member and said first and second side members define an interior for said corrugated packaging material; and wherein each of said first and second hollow structures has side walls joined at corners to define a closed polygon in cross-section perpendicular to the longitudinal direction;

wherein each of said first hollow structures has a pair of said side walls meeting at one of said corners and at least in part shared in common with adjacent second hollow structures; and wherein each of said second hollow structures has first and second of said side walls meeting at a second of said corners and at least in part shared in common with adjacent first hollow structures.

33. A corrugated packaging material according to claim 32 wherein at least a portion of sides of said polygons facing said interior are convex circular arcs.

34. A corrugated packaging material according to claim 33 wherein:

the first and second hollow structures of said first side member are substantially perpendicular to the first and second hollow structures of said bottom planar member;

the first and second hollow structures of said second side member are parallel to the first and second hollow structures of said bottom planar member and perpendicular to the first and second hollow structures of said first side member; and said first and second side members are connected to said bottom planar member through connecting portions of said single sheet.

35. A corrugated packaging material according to claim 32 wherein:

the first and second hollow structures of said first side member are substantially perpendicular to the first and second hollow structures of said bottom planar member;

the first and second hollow structures of said second side member are parallel to the first and second hollow structures of said bottom planar member and perpendicular to the first and second hollow structures of said first side member; and said first and second side members are connected to said bottom planar member through connecting portions of said single sheet.

36. A corrugated packaging material according to claim 33 wherein a fourth or said plural arrays forms a third side member extending at a right angle from said bottom planar member;

wherein a fifth of said plural arrays forms a fourth side member extending at a right angle from said bottom planar member; and wherein said first, second, third and fourth side members are joined to each other at right angles to form, in cooperation with said bottom planar member, an open box structure.

37. A corrugated packaging material according to claim 36 wherein:

the first and second hollow structures of said first and third side members are perpendicular to the first and second hollow structures of said bottom planar member;

the first and second hollow structures of said second and fourth side members are parallel to the first and second hollow structures of said bottom planar member and perpendicular to the first and second hollow structures of said first and second hollow structures of said first and third side members; and said first, second, third and fourth side members are connected to said bottom planar member through connecting portions of said single sheet.

38. A packaging material comprising a corrugated planar member folded into a block structure of superimposed folds, said corrugated planar member being formed of a sheet folded into a linear array of alternating first and second hollow structures extending in parallel to the folds in said sheet and in a longitudinal direction, and said corrugated planar member having first and second opposing surfaces;

wherein each of said first and second hollow structures has side walls jointed at corners to define a closed polygon in cross-section perpendicular to the longitudinal direction;

wherein each of said first hollow structures has a pair of said side walls meeting at one of said corners and shared in common with adjacent second hollow structures; and wherein each of said second hollow structures has first and second of said side walls meeting at a second of said corners and shared in common with adjacent first hollow structures.

39. A packaging material according to claim 38 wherein evenly spaced, parallel cuts are formed in said corrugated planar member perpendicular to said longitudinal direction, said cuts alternating between said first and second opposing surfaces, said corrugated planar member being folded at said cuts to form said block structure.

* * * * *

UNITED STATES PATENT AND TRADEMARK OFFICE

CERTIFICATE OF CORRECTION

PATENT NO. : 6,190,756 B1 
DATED : February 20, 2001
INVENTOR(S) : Yokoyama et al.

It is certified that error appears in the above-identified patent and that said Letters Patent is hereby corrected as shown below:

Column 3,
Line 54, begin a new paragraph at “with” and “with” should read -- With --.

Column 24,
Line 16, “a22” should read -- a11 --.

Column 27,
Line 57, “in” should read -- 1n --.

Column 28,
Line 36, “in” should read -- 1n --.

Column 54,
Line 8, delete “14:7”.

Signed and Sealed this

Tenth Day of September, 2002

*Attest:*

*Attesting Officer*

JAMES E. ROGAN
*Director of the United States Patent and Trademark Office*